US012350560B1

(12) United States Patent
Evans et al.

(10) Patent No.: US 12,350,560 B1
(45) Date of Patent: Jul. 8, 2025

(54) SYSTEMS AND METHODS FOR A CLUB HEAD WITH A VARIABLE CENTER OF GRAVITY

(71) Applicant: Cobra Golf Incorporated, Carlsbad, CA (US)

(72) Inventors: D. Clayton Evans, Vista, CA (US); Michael S. Yagley, Carlsbad, CA (US); Ryan L. Roach, Encinitas, CA (US); Bryce W. Hobbs, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 18 days.

(21) Appl. No.: 18/083,391

(22) Filed: Dec. 16, 2022

Related U.S. Application Data

(60) Provisional application No. 63/291,096, filed on Dec. 17, 2021.

(51) Int. Cl.

| | |
|---|---|
| ***A63B 37/06*** | (2006.01) |
| ***A63B 53/06*** | (2015.01) |
| ***A63B 53/08*** | (2015.01) |
| *A63B 53/04* | (2015.01) |

(52) U.S. Cl.
CPC ..... *A63B 53/06* (2013.01); *A63B 53/08* (2013.01); *A63B 2053/0491* (2013.01)

(58) Field of Classification Search
CPC . A63B 53/06; A63B 53/08; A63B 2053/0491; A63B 2053/0495
See application file for complete search history.

(56) References Cited

U.S. PATENT DOCUMENTS

| | | | | |
|---|---|---|---|---|
| 5,464,211 | A | 11/1995 | Atkins, Sr. | |
| 8,376,878 | B2 | 2/2013 | Bennett | |
| 9,072,951 | B1 * | 7/2015 | Tang | A63B 60/02 |
| 9,180,349 | B1 | 11/2015 | Seluga | |
| 9,717,962 | B1 | 8/2017 | Seluga | |
| 9,814,954 | B2 | 11/2017 | Westrum | |
| 10,518,146 | B2 | 12/2019 | Myers | |
| 10,543,406 | B2 | 1/2020 | Carter | |
| 10,716,984 | B2 * | 7/2020 | Frederickson | A63B 53/06 |
| 10,912,970 | B1 | 2/2021 | Hanhart | |
| 11,123,619 | B2 * | 9/2021 | Kline | A63B 53/0466 |
| 2007/0099720 | A1 * | 5/2007 | Gillig | A63B 53/0466 473/324 |
| 2020/0054926 | A1 * | 2/2020 | Frederickson | A63B 53/06 |
| 2020/0330834 | A1 * | 10/2020 | Northcutt | A63B 53/045 |

* cited by examiner

*Primary Examiner* — Raeann Gorden
(74) *Attorney, Agent, or Firm* — Quarles & Brady LLP

(57) ABSTRACT

Systems and methods for a club head having a weighting system configured to selectively move a front weight vertically within the interior of the club head to raise the center of gravity position of the club head.

13 Claims, 42 Drawing Sheets

SYSTEMS AND METHODS FOR A CLUB HEAD WITH A VARIABLE CENTER OF GRAVITY

CROSS REFERENCE TO RELATED APPLICATIONS

This application claims the benefit of and priority to U.S. Provisional Application No. 63/291,096, filed on Dec. 17, 2021, which is incorporated by reference herein in its entirety.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates generally to golf clubs, and more specifically, to club heads having improved performance by providing adjustability for the center of gravity ("CG") position of a club head.

2. Description of the Background

Many golfers at all skill levels constantly seek to improve their performance and lower their golf scores. As a result, players are frequently seeking out updated and improved equipment. The performance of a golf club can vary based on several factors, including weight distribution about a club head of the golf club. The weight distribution about the club head generally affects a location of the center of gravity of the club head, as well as the mass moment of inertia. Distributing weight about the head in a targeted fashion can provide more forgiveness in a club head, improve accuracy, enhance spin control, and optimize golf ball trajectory. Still further, varying the weight in one or more regions of the club head can allow for increased weight at alternative locations that can improve club head performance.

Manipulating a CG position of a club head (e.g., a driver) has been a design feature provided to golfers in recent years. Moving the CG position in the toe-heel direction (i.e., along a horizontal axis) helps to reduce or increase the golf ball's sidespin tendencies, dependent on face impact point, face orientation, or club head path into the ball. Moving the CG position in the sole-crown direction (i.e., along a vertical axis) helps to reduce or increase the golf ball's backspin tendencies, also dependent on face impact point, face orientation, or club head path into the ball.

However, adjusting the CG position vertically is challenging for many reasons. As an initial matter, adjusting the CG position has conventionally been done by moving the CG position in the face-aft direction (e.g., towards or away from the face in a direction perpendicular to the plane created by the horizontal and vertical axis directions mentioned above), which can also reduce or increases the golf ball's backspin tendencies. In addition, moving the CG position in the face-aft direction is less complex to employ. For example, moving the CG position in the face-aft direction is conventionally done by moving or repositioning weights located on the sole towards the face or towards the aft regions of the head. Further, since the United States Golf Association ("USGA") presently allows the distance of a driver club head to be longer in the face-aft direction than the sole-crown direction, weight movements in the face-aft direction can be more advantageous in changing the club's moment of inertia ("MOI") around the horizontal axis, which can aid in reducing or increasing backspin on center and off-center hits, relative to what can be achieved by moving a weight vertically to change the CG position by conventional methods. Owing to these reasons, face-aft weighting methodologies have traditionally been employed.

There are many conventional weighting scenarios currently used along or within drivers to help golfers hit the ball longer, straighter, and with more control. Some use a combination of toe-heel weighting, some use a combination of back-front weighting. In many cases a weight is moveable or repositionable such as in a track that allows it to slide forward, backward, toe-ward, or heel-ward. Other weighting systems provide two or more weights of different masses that can be swapped with one another to create a weighting condition that is biased forward, backward, toe-ward, or heel-ward. The variety of such weighting methods is quite numerous in its application.

However, many unwanted side effects are introduced when conventional methods of moving the CG position of the club head in the vertical direction are employed. For example, the creation of undesirable sound when the head impacts the ball, a lower MOI for the entire club head due to the moveable weight being near to the center of the head, and the weight needing a stable and supportive design to secure it firmly in place to react the high forces that occur during ball impact. One such conventional design that is known in the art includes a driver club head having a rod with one end having a 12 g weight and an opposing end having 1.5 g weight. The rod can be installed in two orientations to place the heavier weight in either a higher or lower position. Depending on the orientation of the rod in the club head, the CG position of the head would move vertically lower or higher. This particular conventional design positions the rod in the center of the club head, connecting with the crown and sole portions of the club head, which is a location that is typically not ideal to produce a more pleasing club head sound. In addition, the rod position also has negative effects on the MOI of the club head.

Given the above shortcomings of conventional club heads described above, methods and systems for providing a vertically variable CG position within a club head are desired.

SUMMARY

A golf club for varying a position of the center of gravity of a club head is provided. According to one embodiment, the golf club can include a shaft, a hollow club head coupled to an end of the shaft, and a weighting system within an interior cavity formed by the hollow club head. The hollow club head includes a face, a crown, and a sole. The weighting system can include a bridge or cage rigidly coupled to the hollow club head adjacent to an interior surface of the face, a pivot housing pivotally coupled to the sole of the hollow club head, a shaft coupled to the pivot housing and extending towards the cage, and a weight coupled to the shaft and configured to engage the cage. The weight can move along the cage as the pivot housing is rotated relative to the hollow club head.

In some embodiments, a weighting system for a club head is provided. According to one embodiment, the weighting system can include a weight supported within an interior of a club head, a cage rigidly coupled to the club head and oriented in a sole-crown direction, a pivot housing pivotally coupled to a sole of the club head, and a shaft coupled to the pivot housing and extending towards the cage. The weight is coupled to the shaft and configured to engage the cage. The weighting system is selectively switchable between a locked configuration and an unlocked configuration. When the weighting system is in the unlocked configuration, the weight is selectively movable along the cage between a plurality of positions. When the weighting system is in the locked configuration, the weight is fixed relative to the cage in one of the plurality of positions.

A method of adjusting the center of gravity in a club head in a sole-crown direction is also provided. The method can include providing a shaft having a weight coupled to a first end and a pivot body coupled to a second end, loosening a set screw threadably received within a pivot body that is pivotally coupled to an interior surface of a sole of the club head, and pivoting the pivot body relative to the club head to rotate the weight about a pivot axis defined by the pivot body. The set screw is accessible from an exterior of the sole of the club head. The weight, the shaft, and the pivot body are received within an interior of the club head.

In another embodiment, the golf club can include a shaft, a hollow club head coupled to an end of the shaft, and a weighting system within an interior cavity formed by the hollow club head. The hollow club head includes a face, a crown, and a sole. The weighting system can include a cage rigidly coupled to the hollow club head adjacent to an interior surface of the face, which has a plurality of engagement locations that are arranged in the sole-crown direction where a weight can be securely attached during the manufacturing process at any of the engagement locations to create a variety of head offerings to the consumer with different preset weight positions.

In some aspects, a weighting system for a club head includes a cage rigidly coupled to the club head and oriented in a sole-crown direction. A weight assembly is disposed adjacent to the face and rigidly attached onto the cage in a plurality engagement positions.

In some embodiments, a static weight is secured in a receptacle in a rear region of the club head. In some embodiments, a center of gravity of the weight component that is attached to the cage is at least 5 mm away from a rear surface of the face. In some embodiments, the weight component that is attached to the cage is at least 8 grams. In some embodiments, the cage has at least two engagement positions for the weight component to be attached. In some embodiments, when the weight component is located in a lowermost position, the location of the weight component is about 15 mm or less from an inner surface of a sole of the club head in a crown-sole direction.

DETAILED DESCRIPTION OF THE DRAWINGS

Figure 1:
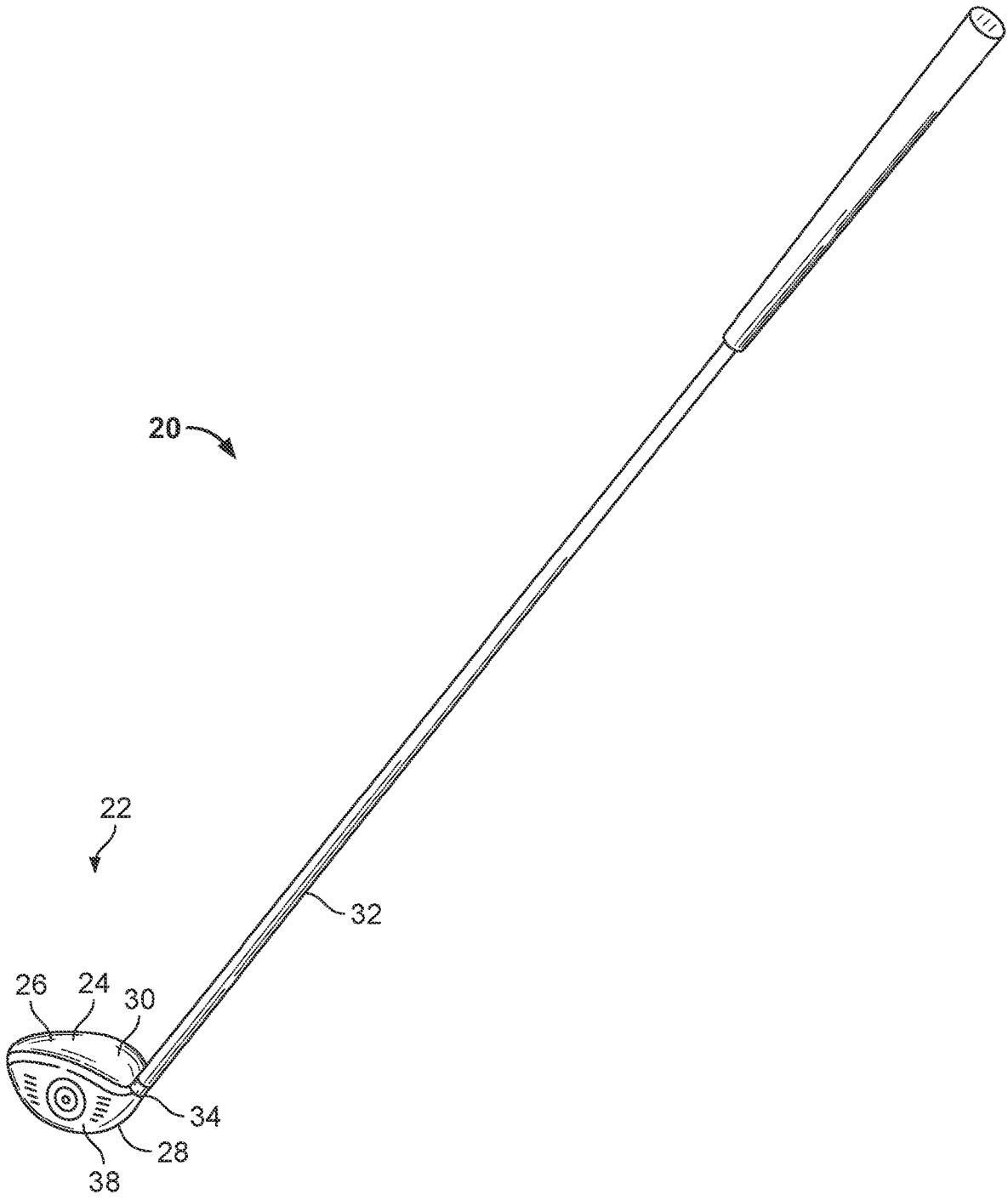
FIG. 1 is a front, top, and left perspective view of a golf club having a club head in accordance with the present disclosure.

The following discussion and accompanying figures disclose various embodiments or configurations of a club head comprising a weight adjustment assembly for vertically varying the CG position of the club head. Varying the CG position vertically (i.e., in a sole-crown direction), and particularly in a forward portion of the club head (e.g., adjacent to the club face) allows for improved performance of the club head. As used herein, the terms "mass" and "weight" are used interchangeably, although it is understood that these terms refer to different properties in a strict physical sense, one of ordinary skill in the art can readily convert between the two properties.

The following discussion and accompanying figures disclose various embodiments or configurations of a golf club that includes a shaft and a club head. Although embodiments are disclosed with reference to a wood-type golf club, such as a driver, concepts associated with embodiments of the wood-type golf club may be applied to a wide range of golf clubs. For example, embodiments disclosed herein may be applied to a number of golf clubs including hybrid clubs, fairway wood clubs, putter-type clubs, iron-type golf clubs, utility-type golf clubs, and the like. The term "about," as used herein, refers to variation in the numerical quantity that may occur, for example, through typical measuring and manufacturing procedures used for articles of manufacture that may include embodiments of the disclosure herein. Throughout the disclosure, the terms "about" and "approximately" refer to a range of values+10% of the numeric value that the term precedes.

Example golf club and club head structures in accordance with this disclosure may relate to "wood-type" golf clubs and club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods", e.g., "metal woods" or "fairway woods." Alternatively, golf club and club head structures of the disclosure may relate to "iron-type" golf clubs and club heads.

One conventional weighting system that is preferred by many golfers and manufacturers is to configure a driver's mass distribution with a weight positioned forward on the sole and to have it paired with another weight positioned in a far aft location on the club head. This provides a desirable CG position and MOI around the horizontal and vertical axis through the clubhead's CG. Unfortunately, it has been found that if the forward weight gets too heavy, golfers with slower swing speeds or with certain head delivery tendencies find it hard to generate enough backspin to get the desired launch angle, trajectory, and consequently the desired distance. However, having the heavy forward weight helps other golfers with higher swing speeds or swing tendencies gain greater distance.

The purpose of the following disclosure is to provide a golf club head to assist different golfers with varying and unique swing characteristics to attain improved distance with the above-mentioned preferred weighting configuration that provides good MOI around both the horizontal and vertical axis to achieve straighter shots. The following disclosure provides a club head with a weighting system configured to elevate a front weight within an interior of the club head to raise the CG position of the club head. The higher positioning of a forward weight helps to create higher backspin while not appreciably reducing the desirable MOI characteristics of the clubhead. The weighting system and club head described herein assists those who do not hit a low-forward weighted head with enough backspin to achieve improved backspin characteristics such that they are capable of hitting the ball farther than before. To that end, by raising or lowering a heavy forward weight to several different height settings to dial in the best backspin for their head speed and head delivery tendencies, the swing styles of a variety of golfers having swing speeds ranging from 80 mph to 125 mph can be achieved with a single club head.

It should be noted that adjusting a heavy forward weight in a vertical direction is challenging from a manufacturing standpoint, which is why such systems have not yet been developed or manufactured. For example, it is uniquely challenging to move a weight of enough mass (e.g., 15 g or more) high enough to produce the backspin increases that could be perceived and measured so that an average shot could be different enough to be an improvement for a wide range of golfers, or significant enough to be "felt" by the golfers. In addition, repositioning a weight is only one component of the weighting system disclosed herein. The weighting system should also be strong enough to withstand the extremely high stresses that occur when a heavy weight is affixed onto a golf club head. Multiple different embodiments are described herein that create sufficient weighting configurations that provide the durability requirements of golfers. In addition, some embodiments include an indicator to communicate how the clubhead is currently configured to a golfer. Finally, the embodiments described herein take into consideration the importance of maintaining a desirable sound from ball impact.

Referring now to FIG. 1, a golf club 20 is illustrated according to the present disclosure, the golf club 20 being shown at address and comprising a club head 22 that includes a club body 24 having a crown 26, a sole 28, and a face 38. The crown 26 comprises an exterior shell or crownplate 30. A golf club shaft 32 extends from a hosel 34 that extends from the club body 24 of the club head 22.

Figure 2:
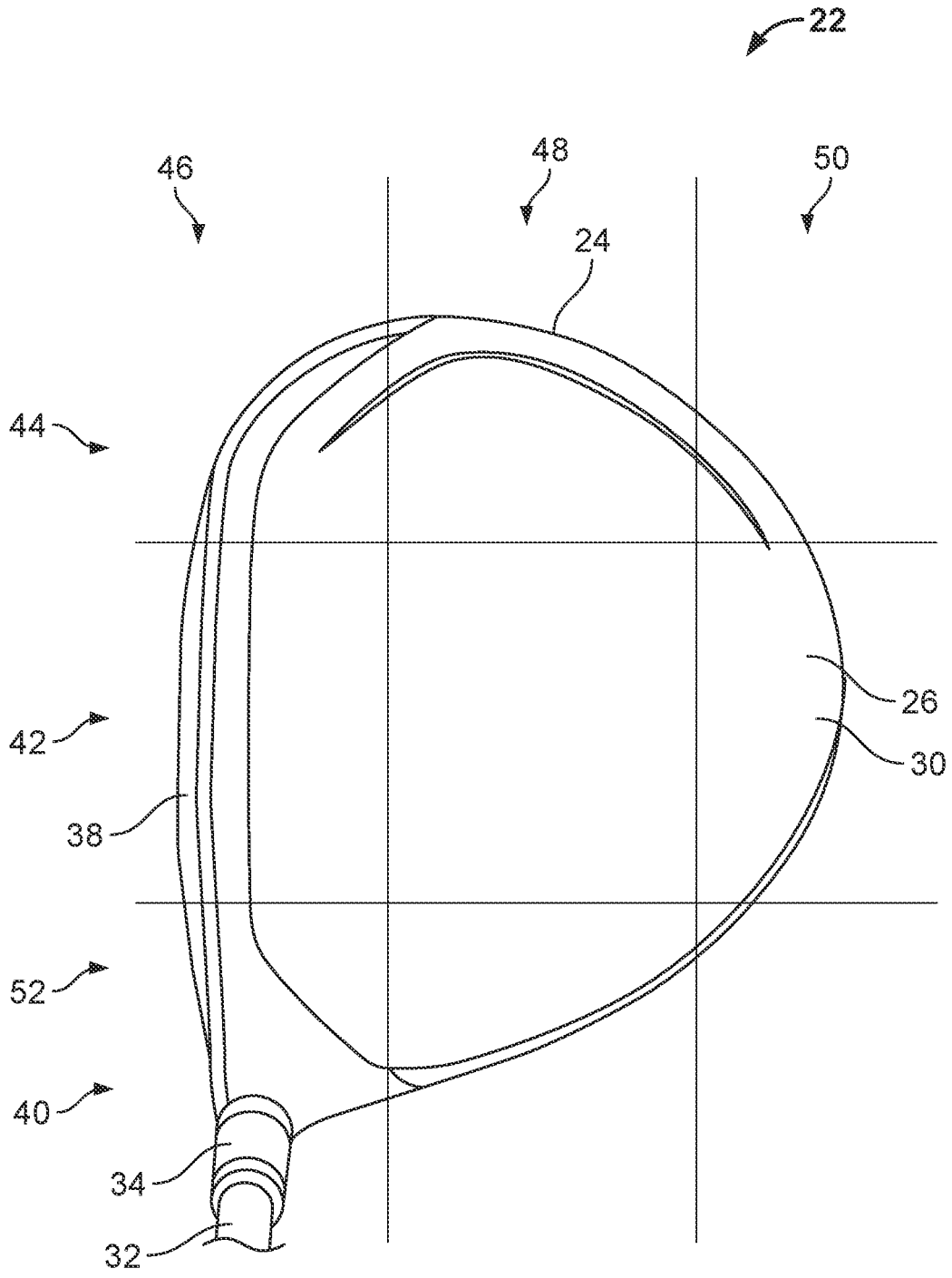
FIG. 2 is a detail top view highlighting a crown of the club head of FIG. 1.

FIG. 2 illustrates a top view of the club head 22 of FIG. 1, which highlights the crown 26 and the crownplate 30, and varying regions of the club head 22 that are illustrated with a coordinate system overlaid thereon. The golf club shaft 32 is shown extending from the hosel 34 within a heel region 40. A medial region 42 is disposed adjacent the heel region 40, the medial region 42 being disposed between the heel region 40 and a toe region 44. The toe region 44 is shown opposite the heel region 40. The club head 22 further defines a front region 46, which comprises the face 38, and an intersection of the face 38 with the crownplate 30. A central region 48 is disposed adjacent the front region 46, and a rear region 50 is separated from the front region 46 by the central region 48. Each of the regions 40, 42, 44, 46, 48, 50 may be referred to herein as a first region, a second region, a third region, a fourth region, a fifth region, or a sixth region, and need not be limited to a serial or numerical limitation, but instead are used to distinguish or identify various regions. To that end, unless otherwise specified, the terms first, second, third, fourth, fifth, and sixth as used herein need not be limited to a serial or numerical limitation.

S Still referring to FIG. 2, the regions 40, 42, 44, 46, 48, 50 define a grid that comprises three rows and three columns, i.e., an m×n grid where m and n are each 3. The grid defines nine sub-regions, each of which is disposed in one of the heel region 40, the toe region 44, and the medial region 42, and one of the front region 46, the central region 48, and the rear region 50. While all of the sub-regions are not specifically referenced herein, it should be appreciated that each location along the crownplate 30 defines a coordinate that can be considered to be disposed within a subregion defined by two of the regions 40, 42, 44, 46, 48, 50. For example, the hosel 34 is located within the heel region 40 and the front region 46, and may be referred to as being disposed within a front, heel subregion 52 of the crownplate. While there are nine subregions that are defined by the grid, only certain subregions are identified herein to avoid confusion. However, it should be noted that the various subregions are defined by the intersections of the various regions 40, 42, 44, 46, 48, 50 disclosed herein. The following disclosure describes varying configurations of thickened regions in accordance with the grid overlaid upon the club head 22 depicted in FIG. 2.

Figure 3:
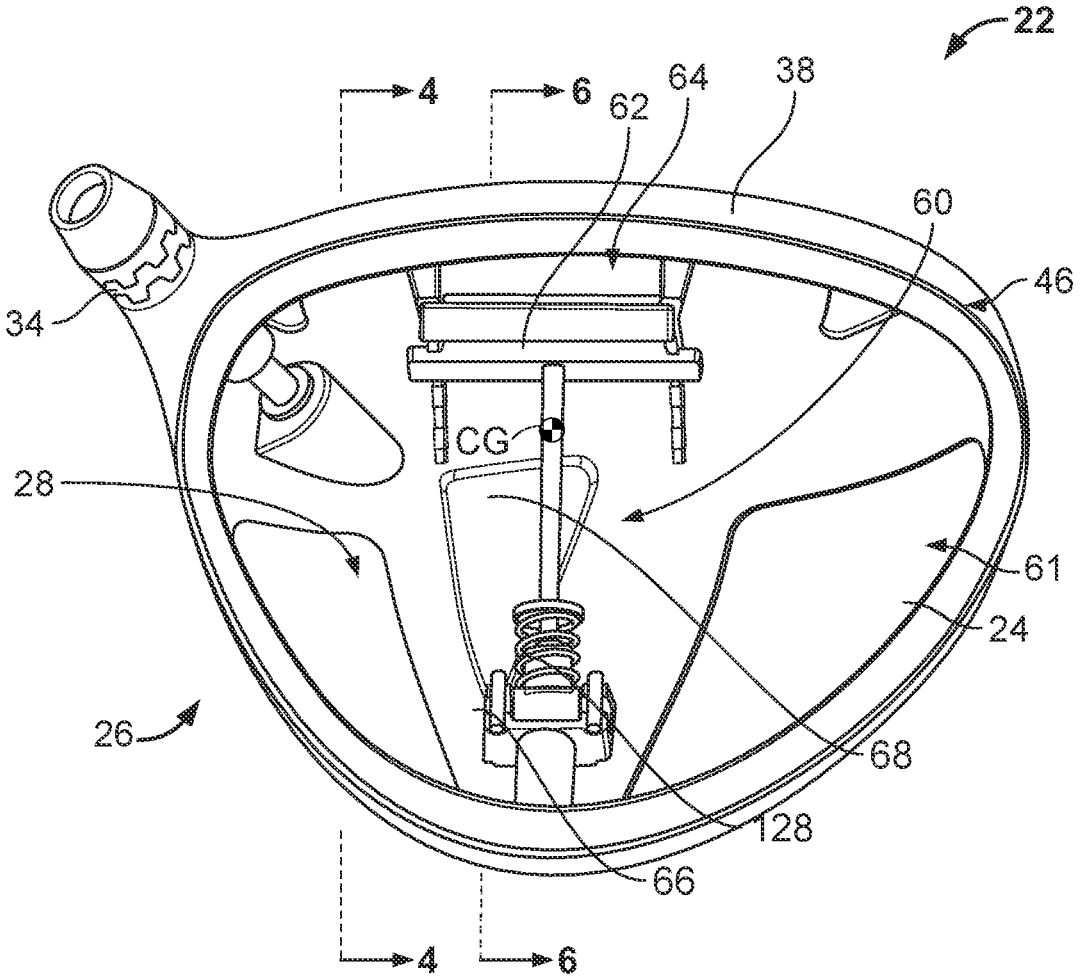
FIG. 3 is a top-back perspective view of a club head having a first embodiment of a weighting system in accordance with the present disclosure.
Figure 4:
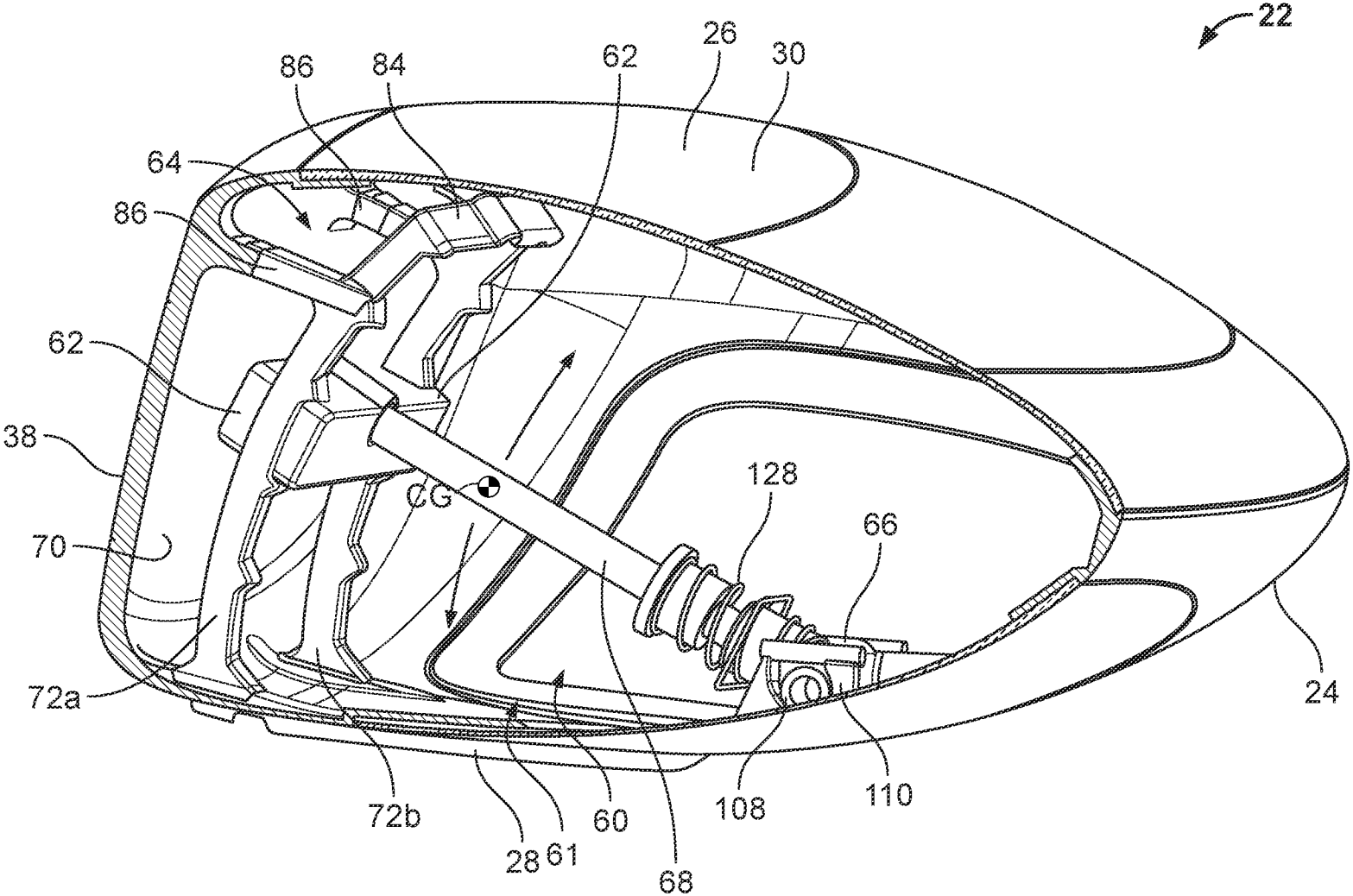
FIG. 4 is a cross-section view of the club head of FIG. 3 taken along line 4-4 of FIG. 3.
Figure 5:
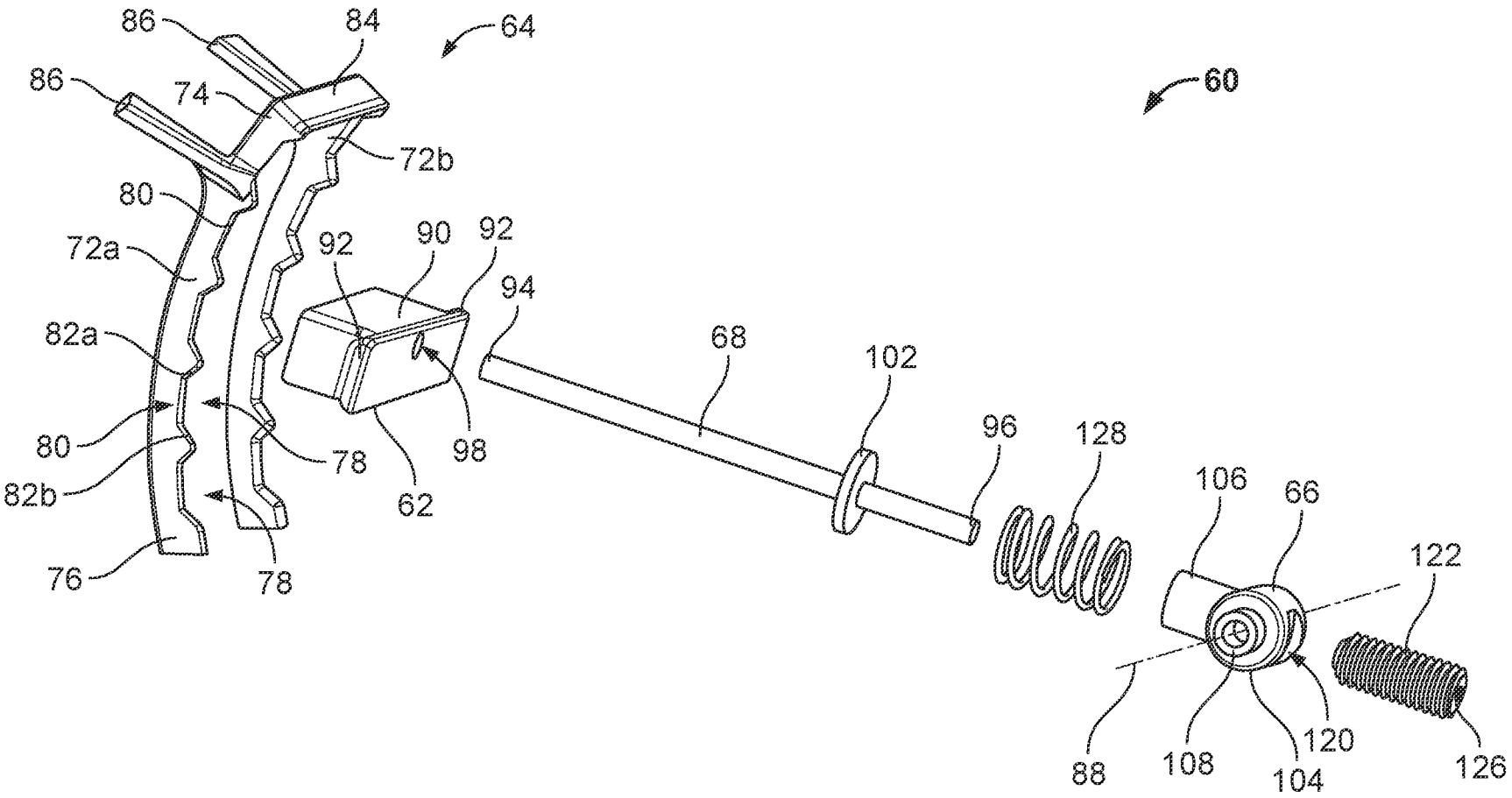
FIG. 5 is an exploded view of an adjustable weight assembly of the club head of FIG. 3.

In general, the present disclosure provides a club head 22 having a weighting system that can move a front weight in a sole-crown direction. FIGS. 3-8 illustrate a club head 22 having a weight that is pivotable around a pivot axis to move the weight in a sole crown direction. Referring now to FIGS. 3-5, a weighting system 60 for the club head 22 is illustrated. As shown in FIG. 3, the crownplate 30 is illustrated as being removed to reveal a hollow interior cavity 61 of the club head 22. As will be described in detail below, the weighting system 60 is configured to adjust a CG position of the club head 22 in a vertical direction (e.g., sole-crown direction) via the selective positioning of a weight 62 arranged in the front region 46 of the club head 22.

As best illustrated in FIGS. 4 and 5, the weighting system 60 can include the weight 62, a cage structure 64, a pivot housing 66, and a shaft 68. The cage structure 64 can be rigidly coupled to the interior 61 of the club head 22 adjacent to an interior surface or rear surface 70 of the face 38. The pivot housing 66 can be pivotally coupled within the interior 61 of the club head 22 to the sole 28. The shaft 68 can be coupled to the pivot housing 66 and extend towards the cage structure 64. The weight 62 is coupled to an end of the shaft 68 and is configured to engage the cage structure 64. As will be described in greater detail below, the weighting system 60 is configured such that, as the pivot housing 66 is rotated relative to the club head 22, the weight 62 moves along the cage structure 64 to adjust a CG position of the club head 22 in the vertical direction.

With specific reference to FIG. 5, the cage structure 64 can include at least one rail configured to guide the weight 62 as the weight 62 traverses the cage structure 64 during adjustment of the CG position. The cage structure 64 can include a first rail 72*a* and a second rail 72*b* that is separated from the first rail 72*a* in a heel-toe direction. In the following paragraphs, only details regarding the first rail 72*a* will be described. It is to be understood that the second rail 72*b* includes the same features, unless otherwise illustrated or described. The first rail 72*a* extends between a first end 74 and an opposing second end 76. In the illustrated embodiment, the first rail 72*a* extends in a crown-sole direction between the first end 74 and the second end 76.

Still referring to FIG. 5, the weight 62 is configured to be selectively secured along the first and second rails 72*a*, 72*b* in a plurality of positions. In the illustrated embodiment, the first rail 72*a* defines a plurality of distinct positions 78 for receiving the weight 62. Each of the plurality of distinct positions 78 includes a recess 80 extending forward into the rail toward the face 38. Each recess 80 is defined by ramped surfaces 82 leading into and out of the recess 80. The ramped surfaces 82 are configured to aid in retention of the weight 62 while the weight 62 is received within the recess 80. In addition, the ramped surfaces 82 are also configured to provide a lead-in to reduce the effort or force required to move the weight 62 between the plurality of positions 78.

Figure 6A:
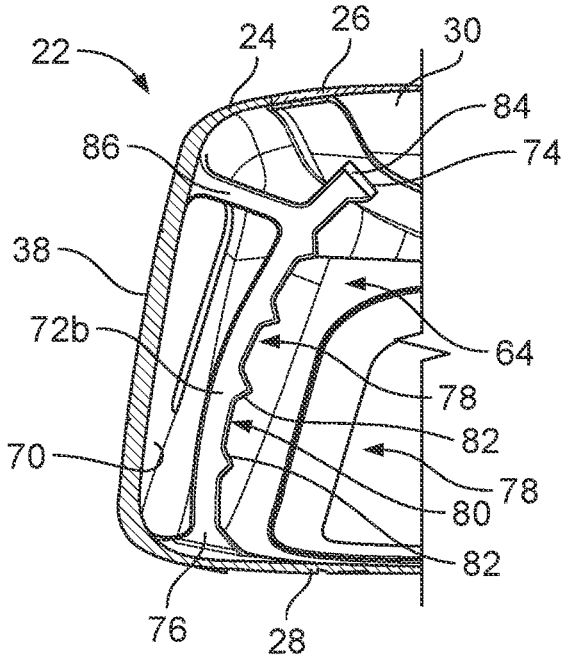
FIG. 6A is a detail cross-section view of a first embodiment of a cage structure taken along line 6-6 of the club head of FIG. 3.
Figure 6B:
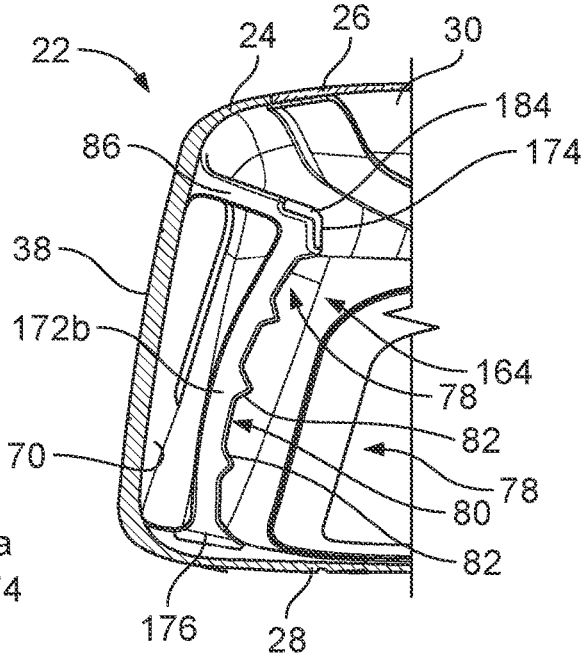
FIG. 6B is a detail cross-section view of a second embodiment of a cage structure.
Figure 6C:
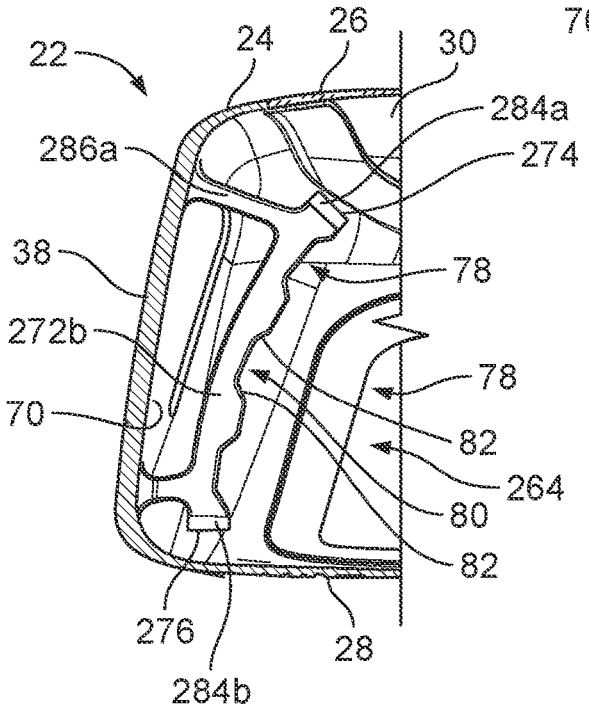
FIG. 6C is a detail cross-section view of a third embodiment of a cage structure.

According to some embodiments, the cage structure 64 can include at least three distinct positions 78 (see, e.g., cage structure 264 of FIG. 6C). According to the illustrated embodiment, the cage structure 64 includes five distinct positions 78 (see also, FIG. 6A), however, other configurations are also possible. For example, FIG. 6B illustrates an embodiment in which a cage structure 164 includes four distinct positions 78 (see also, FIG. 7). According to other embodiments, the cage structure 64 can include an infinite number of positions to receive the weight 62. For example, a cage structure could be formed without recesses, thereby allowing a weight to be positioned in an infinite number of positions between the first end 74 and second end 76 of the first and second rails 72*a*, 72*b*.

Referring again to FIG. 5, the cage structure 64 can further include one or more crossbars 84 spanning between the first and second rails 72*a*, 72*b*. In the illustrated embodiment, the crossbar 84 spans between the first and second rails 72*a*, 72*b* at the first ends 74 thereof (see also, FIGS. 6A, 6B, and 6C). In the embodiment illustrated in FIG. 6C, the cage structure 264 includes two cross bars, including a first crossbar 284*a* and a second crossbar 284*b*. The first crossbar 284*a* spans between the first and second rails 272*a*, 272*b* at the first ends 274 thereof and the second crossbar 284*b* spans between the first and second rails 272*a*, 272*b* at the second ends 276 thereof. In other embodiments, one or more crossbars could be disposed to span between first and second rails in medial regions between the first and second ends.

Referring to FIGS. 6A-6C, three differing embodiments of a cage structure 64, 164, 264 are illustrated. In the following figures, like elements are labeled with like reference numbers (e.g., cage structure 64 and cage structure 164). In general. the cage structures 64, 164, 264 can include one or more posts 86, 186, 286 extending from the first and second rails to couple the cage structure to other structures of the club head 22, such as one or more of the face 38, sole 28, or crown 26. In FIGS. 6A-6C, only the second rail 72*b*, 172*b*, 272*b* is illustrated and described, however it is to be understood that the first rail 72*a* also includes the same features, unless otherwise described or illustrated below.

As illustrated in FIGS. 6A and 6B, the second rail 72*b*, 172*b* can be coupled to the face 38 and the sole 28 of the club head 22. In the illustrated embodiments, the second rail 72*b*, 172*b* is coupled to the face 38 adjacent to the first end 74, 174 by the post 86, 186 and the second rail 72*b*, 172*b* is directly coupled to the sole 28 at the second end 76, 176. As illustrated in FIG. 6C, the second rail 272*b* can be coupled to the face 38 of the club head 22. In the illustrated embodiment, the second rail 272*b* is coupled to the face 38 adjacent to the first end 74 by a first post 286*a* and the second rail 272*b* is also coupled to the face 38 adjacent to the second end 276 by a second post 286*b*.

According to other embodiments, the second rail 72*b* can be coupled to the face 38 and the crown 26 of the club head 22 (not shown). For example, the second rail 72*b* can be coupled to the crown 26 at or adjacent to the first end 74 and the second rail 72*b* can be coupled to the face 38 at or adjacent to the second end 76. According to other embodiments, the second rail 72*b* can be coupled to the crown 26 and the sole 28 of the club head 22 (not shown). For example, the second rail 72*b* can be coupled to the crown 26 at or adjacent to the first end 74 and the second rail 72*b* can be coupled to the sole 28 at or adjacent to the second end 76. According to other embodiments, the second rail 72*b* can be coupled to the crown 26, the sole 28, and the face 38 of the club head 22 (now shown). In some implementations, mounting the cage structure 64 to a portion of the face 38 of the club head 22 can reduce the stresses in the face 38 caused by the impact with a golf ball (not shown).

Referring generally to FIG. 6A, as also applicable to FIGS. 6B and 6C, the first and second rails 72*a*, 72*b* of the cage structure 64 define an arcuate shape extending generally away from the sole 28 towards the crown 26 of the club head 22. The arcuate shape of the first and second rails 72*a*, 72*b* define an arcuate path of travel traversed by the weight 62 (see FIG. 7) during adjustment of the CG position. In the illustrated embodiments, the first and second rails can define a radius of curvature of between about 200 mm and about 25 mm, or between about 175 mm and about 50 mm, or between about 160 mm and about 50 mm, or between about 150 mm and about 50 mm. According to the illustrated embodiments, the center of the radius of curvature for the first and second rails 72*a*, 72*b* can be defined by the position of a pivot axis 88 of the pivot housing 66, about which the weight 62 pivots, relative to the first and second rails 72*a*, 72*b* (see FIGS. 5 and 7). There may be situations due to the club head shape, modal responses, inertial needs, weight limitations, rail durability, pivot housing location, and other needs or metrics of club head performance, operation, and strength where the shape of the cage rails 72*a*, 72*b* may be differently shaped and sized to fit within the club head 22 and to provide additional positions 78 for the weight 62. The cage rails 72*a*, 72*b* may have a much higher radius of curvature, e.g., 800 mm or more. In some embodiments, the cage rails 72*a*, 72*b* may extend linearly or may have a convex curvature relative to the face 38 as they extend from the first end 74 to the second end 76 to provide the weight 62 with additional or different positions 78 in cooperation with the rotational pivot housing 66 or to secure the cage 64 to the club head 22.

In the illustrated embodiments, the cage structure 64 can be integrally formed (e.g., monolithically formed) with the club head 22. For example, the cage structure 64 can be integrally formed with the club body 24 by 3D printing or investment casting. For example, the club head 22 and cage structure 64 can be 3D printed as an integral component out of metal via a powder-bed welding process or a laser deposition process, just to name two specific examples of 3D printing processes known in the art. According to other embodiments, the cage structure 64 could be formed as a separate component to be coupled to the club head 22, for example, with fasteners or by welding.

Referring again to FIG. 5, the weight 62 can be configured to interface with the first and second rails 72*a*, 72*b* to move therealong and be selectively locked among one of the plurality of distinct positions 78. The weight 62 can include a weight body 90 that is at least partially received between the first and second rails 72*a*, 72*b* (see, e.g., FIG. 4). In the illustrated embodiment, the weight 62 defines a rectangular cross-section, although other configurations are also possible. The weight 62 can also include weight flanges 92 extending laterally from the weight body 90 (e.g., from a heel-facing side and a toe-facing side of the weight). The weight flanges 92 are configured to interface along the first and second rails 72*a*, 72*b* within the recesses 80. In the illustrated embodiment, the flanges include surfaces that are complementary to the surfaces defining the recess 80. For example, the weight flanges 92 include a flat surface arranged between two angled surfaces that are configured to engage with the recess 80 and the ramped surfaces 82, respectively. As a result, the weight can be secured into place along the first and second rails 72*a*, 72*b* in one of the plurality of positions 78 therealong.

Still referring to FIG. 5, the shaft 68 includes a weight end 94 and a pivot end 96 opposite the weight end 94. The weight end 94 of the shaft 68 is configured to be received within a weight aperture 98 arranged on the aft-facing side of the weight 62. The pivot end 96 is configured to be received within a shaft aperture 100 in the pivot housing 66 (see, e.g., FIG. 7). The shaft 68 can also include a seating flange or spring flange 102 extending radially outwards from the shaft 68 between the weight end 94 and the pivot end 96.

The pivot housing 66 is also shown in FIG. 5, which includes a pivot body 104 and a shaft body 106. The pivot body 104 extends laterally (e.g., within a toe-heel direction) and defines the pivot axis 88 about which the pivot housing 66 rotates. The shaft body 106 extends radially away from the pivot body 104 (e.g., relative to the pivot axis 88) and is arranged orthogonal to the pivot body 104. The shaft body 106 includes the shaft aperture 100 that slidably receives at least a portion of the pivot end 96 of the shaft 68 within the shaft body 106 of the pivot housing 66. The pivot housing 66 also includes pivot flanges 108 that extend away from opposing lateral ends of the pivot body 104 and are configured to engage with a pivot mount 110 attached to (or integrally formed with) the sole 28 of the club head 22 (see FIG. 4).

In the illustrated embodiment, the pivot housing 66 includes a threaded recess 120 that is configured to receive a set screw 122 therein. The threaded recess 120 extends into the pivot body 104 and the shaft body 106 along an axis aligned with the shaft 68. As will be described in greater detail below, the set screw 122 can be adjusted to selectively lock and unlock the weight 62 in one position among the plurality of distinct positions 78. The set screw 122 includes a shaft recess 124 (see FIG. 7) extending into the set screw 122 from an end opposite the head 126 of the set screw 122. The shaft recess 124 is configured to slidably receive the pivot end 96 of the shaft 68 therein such that as the set screw 122 is threaded into the pivot housing, the shaft 68, and thereby the weight 62, is pushed away from the pivot housing 66 to forcibly engage the weight 62 into the cage structure 64.

Still referring to FIG. 5, the weighting system 60 further includes a spring 128 that is arranged between the shaft 68 and the pivot housing 66. In the illustrated embodiment, the spring 128 is seated between the spring flange 102 on the shaft 68 and the pivot body 104 of the pivot housing 66. The spring 128 is configured to bias the shaft 68, and thereby the weight 62, toward the cage structure 64. The biasing from the spring 128 can allow the weight 62 to selectively shift between positions 78 when the weighting system 60 is in an unlocked configuration, as described in greater detail below. The weighting system 60 can also include a spring sleeve 129 (see FIG. 7) extending radially outward from the shaft 68 adjacent to the spring flange 102 to meet an inside of the spring 128. The spring sleeve 129 can be configured to maintain concentricity between the spring 128 and the shaft 68. According to some embodiments, the spring sleeve 129 can be configured as a second weight of the weighting system 60 to allow further control over a CG position of the club head 22. According to some embodiments, the weighting system 60 can further include a third weight (not shown) coupled to the sole 28 of the club head 22 in an aft or rear region 50 (see FIG. 2).

Figure 7:
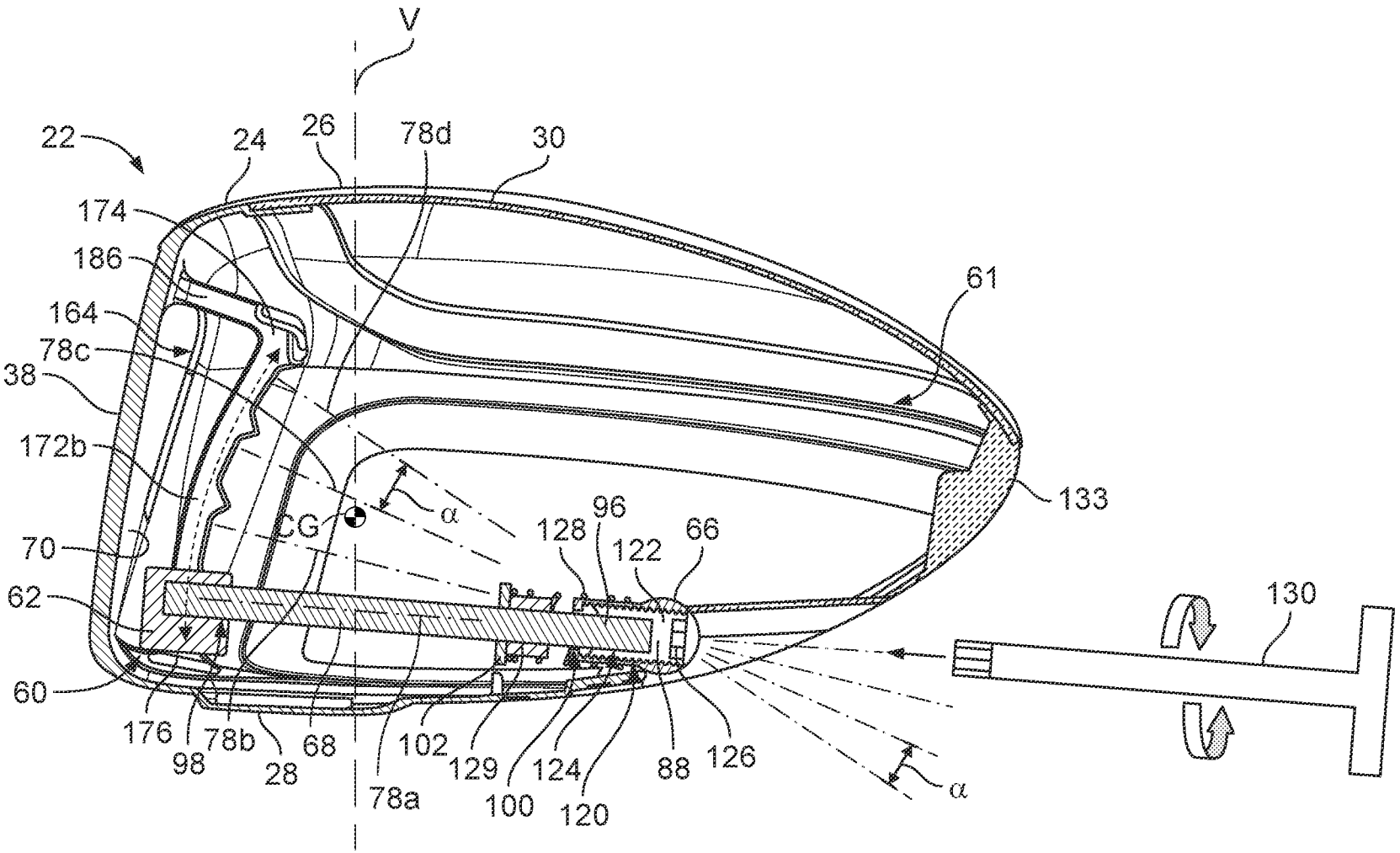
FIG. 7 is a cross-section view of the club head of FIG. 3 taken along line 6-6 of FIG. 3.
Figure 8:
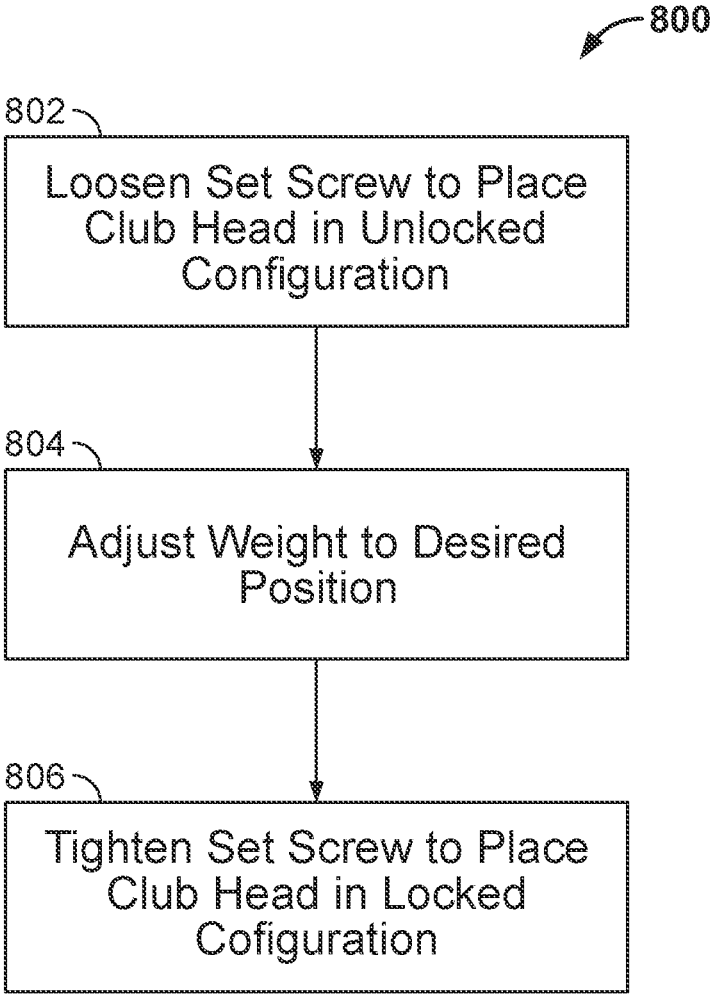
FIG. 8 is a schematic of a method of adjusting the CG position of the club head of FIG. 3.

Referring now to FIGS. 7 and 8, a method 800 of selectively adjusting the CG position of the club head 22 will be described. It is noted that FIG. 7 illustrates a club head 22 having the cage structure 164 as depicted in FIG. 6B, although the method described herein is applicable to all of FIGS. 6A-6C. In general, the weighting system 60 can be placed between a locked configuration (shown), in which the weight 62 is fixed in a position 78, and an unlocked configuration, in which the weight 62 is selectively movable between the plurality of positions 78.

In the locked configuration, the set screw 122 is threaded into the pivot housing 66 (e.g., with a tool 130), and a base of the shaft recess 124 within the set screw 122 is engaged with the shaft 68, thereby forcing the shaft 68, and the weight 72 coupled on the end thereof, into the first and second rails 172*a*, 172*b* of the cage structure 164. The force that is applied to the shaft 68 by the set screw 122, and the interactions between the weight flanges 92 and the surfaces of the recess 80, act to securely retain (e.g., lock) the weight 62 into a selected position among the plurality of distinct positions 78. In the locked configuration, the weighting system 60 is able to maintain the position of the weight 62 during use of the golf club, including withstanding the substantial forces acting on the weight 62, and the components the weight 62 is in contact with, during a swing and subsequent contact with a golf ball.

When V adjustment of the CG position is desired, the tool 130 can be inserted into the head 126 of the set screw 122 and the set screw 122 can be loosened to place the weighting system 60 in the unlocked configuration (block 802, FIG. 8). In the unlocked configuration, the set screw 122 is loosened such that a gap is present between the base of the shaft recess 124 and the pivot end 96 (see FIG. 5) of the shaft 68. The weight 62 can then be moved from a first position 78*a* to a second position 78*b* by insertion of the tool 130 into the head of the set screw 122, and then pivoting the pivot housing 66 via the tool 130 (block 804, FIG. 8).

As the pivot housing 66 rotates about the pivot axis 88, the shaft 68 having the weight 62 coupled to the end thereof also pivots, and one of the ramped surfaces 82 of the recess 80 (see FIG. 5) engages the weight flanges 92 of the weight 62. For example, during rotation of the pivot housing 66 in a first direction (e.g., clockwise from the perspective of FIG. 7), an upper ramped surface 82*a* becomes engaged with the weight flanges 92 of the weight 62 (see FIG. 5). Conversely, during rotation of the pivot housing 66 in an opposing second direction (e.g., counter-clockwise from the perspective of FIG. 7), a lower ramped surface 82*b* becomes engaged with the weight flanges 92 of the weight 62 (see FIG. 5). A component of the contact force between the ramped surfaces 82 of the recess 80 and the weight flanges 92 of the weight 62 axially displace the weight 62 and the shaft 68 towards the pivot housing 66, thereby compressing the spring 128. The compression of the spring 128 causes the gap between the base of the shaft recess 124 and the pivot end 96 of the shaft 68 to become reduced.

As the pivot housing 66 continues to rotate, the weight 62 also continues to move toward the second position 78*b*. When the weight 62 is at or near the second position 78*b*, the spring 128 "snaps" or displaces the weight 62 away from the pivot housing 66 such that the weight flanges 92 of the weight 62 become engaged within the recess 80 of the second position 78*b*. At this point, the gap between the base of the shaft recess 124 and the pivot end 96 of the shaft 68 increases. The spring 128 maintains the weight in the second position 78*b*, at least momentarily, to allow the user to determine whether the current position, i.e., the second position 78*b*, is desired. If the second position 78*b* is the desired position, then the set screw 122 can be threaded back into the pivot housing 66 to lock the weight 62 into the second position 78*b*, thereby placing the weighting system back into a locked configuration (block 806, FIG. 8). If the second position 78*b* is not the desired position, then the pivot housing 66 can continue to be pivoted by the tool 130 until the weight 62 reaches the desired position 78. The "snapping" of the weight 62 caused by the spring 128 can provide tactile and audible feedback to a golfer or user during the adjustment, thereby providing feedback to the golfer that the weight 62 is in the next position.

In the illustrated embodiment, the rotation of the pivot housing 66 to move the weight 62 from the first position 78*a* to the adjacent second position 78*b* defines a rotation (e.g., angle $\alpha$ in FIG. 7) of at least about 5 degrees. According to some embodiments, the rotation of the pivot housing 66 to move the weight 62 from the first position 78*a* to the adjacent second position 78*b* defines a rotation of between about 5 degrees and about 30 degrees. According to other embodiments, the rotation of the pivot housing 66 to move the weight 62 from the first position 78*a* to the adjacent second position 78*b* defines a rotation of between about 5 degrees and about 15 degrees.

Still referring to FIG. 7, the weight 62 can be adjusted between a first end position (e.g., position 78*a*), in which the weight 62 is at the vertically lowest position near the second end 176 of the first and second rails 172*a*, 172*b*, and a second end position (e.g., position 78*d*), in which the weight 62 is at the vertically highest position near the first end 174 of the first and second rails 172*a*, 172*b*. The weight 62 is also adjustable between a plurality of intermediate positions (e.g., positions 78*b*, 78*c*) between the first and second end positions. The first end position corresponds to a "low CG" position setting and the second end position corresponds to a "high CG" position setting, with the intermediate positions providing a CG position between the low and high CG position settings.

Still referring to FIG. 7, a rear segment 133 of the club body 24 is provided as a thickened area to position mass rearward, within the rear region 50, to increase the MOI of the club head 22 for balancing and/or compensating for the mass provided in the front region 46 of the club head 22. For example, conventional club heads with weighting systems include a rod positioned at or near the center of the club head and in connection with the crown and sole portions of the club head, which negatively impacts the MOI of the club head. To avoid such negative impacts, the rear segment 133 is provided to add balancing mass in the rear region 50 of the club head 22 to provide a MOI greater than 4000 g-cm^2 relative to a vertical axis V, i.e., in the C-S direction, extending through the CG. The rear segment 133 can be integrally formed (e.g., monolithically formed) with the club head 22 as part of the club body 24. In some embodiments, balancing mass can be added externally and separately as a weight piece (see FIG. 17). The balancing mass may be within the range of about 4 g to about 25 g, depending on the associated mass and volume of the club head.

In the illustrated embodiments, adjusting the weight 62 between the low CG position setting and the high CG position setting can adjust the CG of the club head 22 vertically by at least 3 mm. According to some embodiments, adjusting the weight 62 between the low CG position setting and the high CG position setting can adjust the CG of the club head 22 vertically by about 5 mm. In the illustrated embodiments, the weight 62 can have a mass of at least 8 grams. According to some embodiments, the weight 62 can have a mass of between about 15 grams and about 100 grams, or between about 15 grams and about 50 grams, or about 24 grams.

In the embodiments of FIGS. 6A-7, the first and second rails 172*a*, 172*b* can be oriented substantially parallel to the face 38 of the club head 22. For example, a straight line can be drawn to pass between the first and second ends 174, 176, and that line can have an angle relative to a plane defined by the face 38 of the club head. According to some embodiments, the first and second rails 172*a*, 172*b* can define an angle relative to the club head of between about 0 degrees (i.e., parallel) and about 25 degrees, or between about 0 degrees and about 20 degrees, or between about 5 degrees and about 15 degrees.

Owing to the first and second rails 172*a*, 172*b* being substantially parallel to the face 38, a CG position of the weight 62 relative to the club face 38 in a face-aft direction remains within a predefined range away from the interior surface 70 of the face 38 with the weight 62 in any one of the plurality of positions 78. For example, a CG position of the weight 62 can be positioned within between about 2 mm to about 35 mm away from the face 38 (e.g., aft of the interior surface 70 of the face 38), or between about 2 mm and about 35 mm, or between about 4 mm and about 25 mm, or between about 6 mm and 20 mm. According to some embodiments, a CG position of the weight 62 relative to the face 38 (e.g., relative to an interior surface 70 of the face 38) in a face-aft direction with the weight in the low CG position (e.g., the lowest position) can be less than or equal to about 20 mm, or less than or equal to about 15 mm, or less than or equal to about 10 mm.

In the embodiments of FIGS. 6A-7, a CG position of the weight 62 relative to the sole 28 (e.g., relative to an interior surface of the sole 28) in a sole-crown direction with the weight in the low CG position (e.g., the lowest position) can be less than or equal to about 20 mm, or less than or equal to about 15 mm, or less than or equal to about 10 mm.

Figure 9:
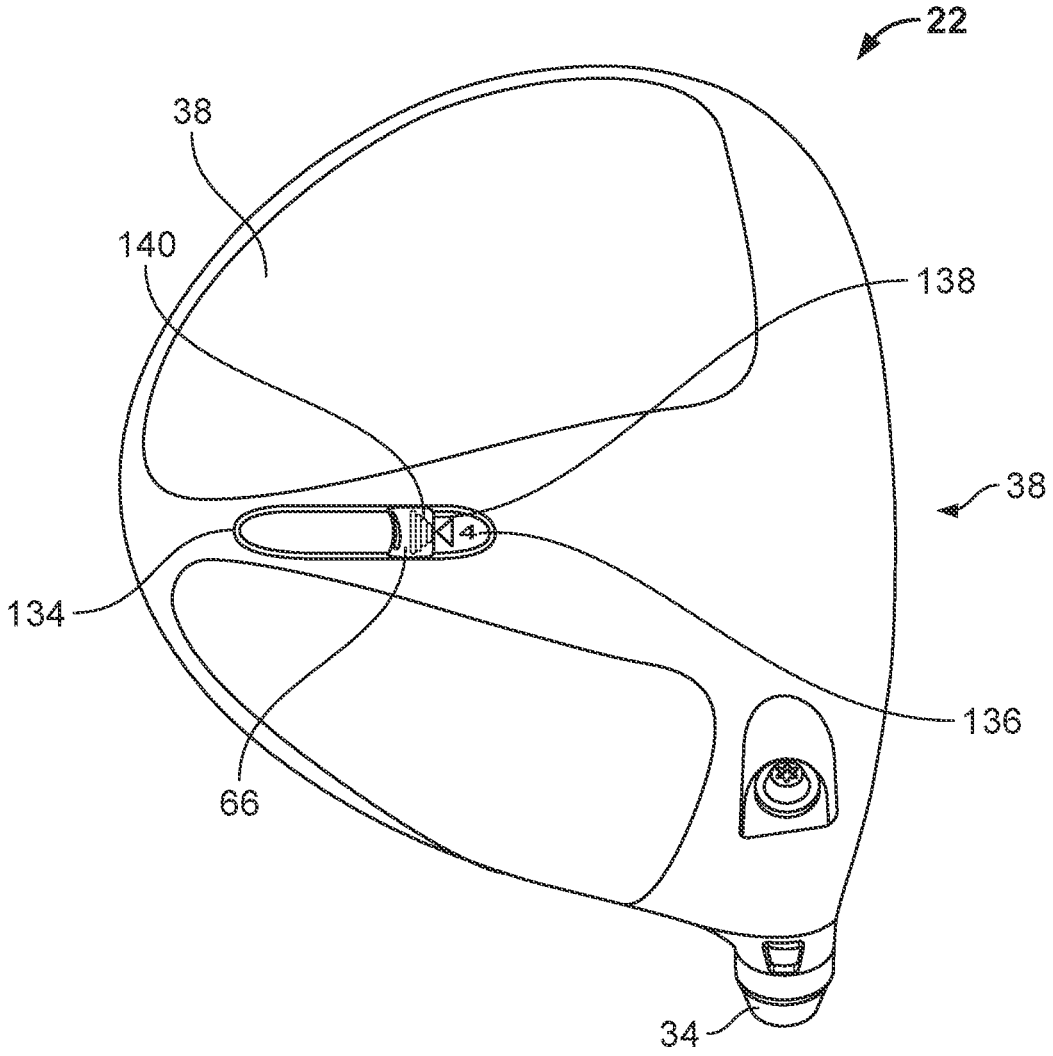
FIG. 9 is a detail bottom view highlighting a sole of the club head of FIG. 3.

Referring now to FIG. 9, the sole 28 of the club head 22 includes a sole recess 134. The sole recess 134 can include a club marker 136 to indicate the club type. For example, in the illustrated embodiment the club marker 136 indicates that this club is a "4-wood." The sole recess 134 can also include a cutout or window 138 that reveals a portion of the pivot housing 66. In the illustrated embodiment, the pivot body 104 (see FIG. 5) of the pivot housing 66 includes indicia 140 along the surface of the pivot body 104 which serves to indicate to a golfer the CG position setting of the weight 62. The indicia 140 can be in the form of a plurality of linear markings, wherein each of the plurality of linear markings can align with an edge of the window 138 when the weight 62 is in one of the plurality of positions 78 (see FIG. 5).

In the embodiments illustrated in FIGS. 3-8, the cage structure 64 forms an arcuate shape and the weight 62 pivots about the pivot axis 88 to move the weight along the cage structure 64 in a sole-crown direction. However, other configurations to allow for more adjustability are also contemplated. For example, the cage structure could include a plurality of rails that together form a semi-circular surface having a plurality of indentations or positions in which the weight can be received. In this embodiment, the pivot housing can be a spherical joint to allow for movement of the weight along the cage structure in a sole-crown direction and a heel-toe direction.

Figure 10:
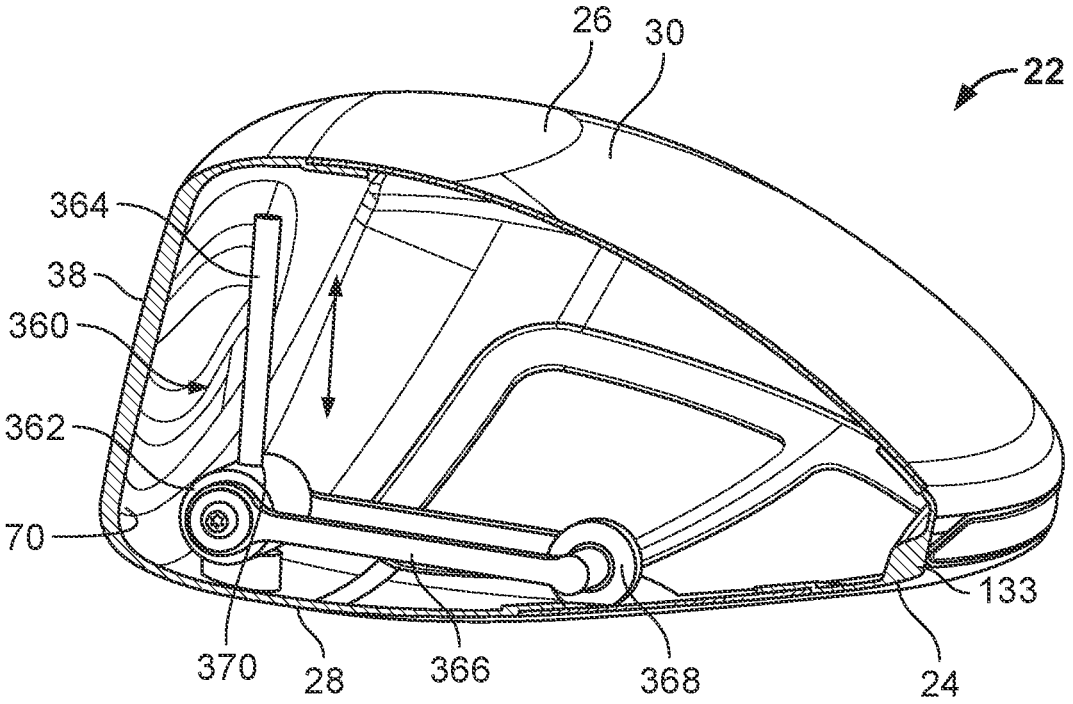
FIG. 10 is a cross-section view of a club head having a second embodiment of a weighting system in accordance with the present disclosure.

In the embodiments illustrated in FIGS. 3-7, the weight 62 pivots about the pivot axis 88 to move the weight along the cage structure 64 in a sole-crown direction by pivoting of the pivot housing 66 coupled to the weight 62 by rotating the tool 130. However, other forms of adjustment of a weight are also contemplated. For example, FIG. 10 illustrates a weighting system 360 for a club head 22 that includes a weight 362 that is linearly moveable in a sole-crown direction. In the illustrated embodiment, the weighting system includes the weight 362, a threaded shaft 364, a set of support legs 366, and a bearing 368. The threaded shaft 364 extends from the sole 28 of the club head 22 and defines a linear path of travel for the weight 362. The threaded shaft 364 can include a fastener head accessible from an exterior of the sole 28 to facilitate rotation of the threaded shaft 364. In the illustrated embodiment, the threaded shaft 364 is not supported at the upper end thereof. However, in other embodiments, the threaded shaft can be supported by the crown 26 of the club head 22. The threaded shaft 364 is rotatable relative to the club head 22 and is received within a threaded aperture 370 within the weight 362. The support legs 366 are pivotally coupled to the weight 362 at a first end and pivotally coupled to the bearing 368 at a second end. The support legs 366 extend away from the weight 362 towards the back of the club head 22. The bearing 368 is configured to roll along an interior surface of the sole 28 during the adjustment of the position of the weight 362.

With continued reference to FIG. 10, the position of the weight 362 can be adjusted by rotation of the threaded shaft 364 relative to the club head 22, for example, via a tool that can be inserted to an end of the threaded shaft 364. As the threaded shaft 364 is rotated, the weight 362 moves linearly in a sole-crown direction owing to the interaction between the threads of the threaded shaft 354 and the threaded aperture 370. During adjustment of the position of the weight 362, the angle of the support legs 366 relative to the sole 28 increases or decreases and the bearing 368 moves forward or backward along the sole 28.

Figure 11:
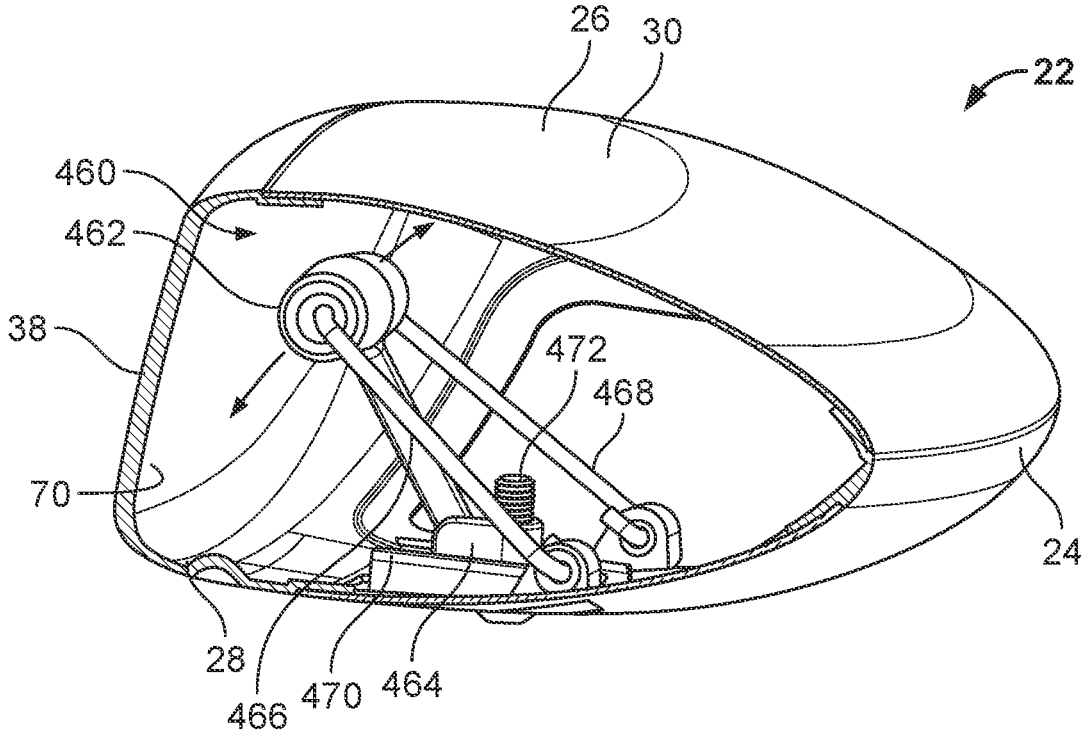
FIG. 11 is a cross-section view of a club head having a third embodiment of a weighting system in accordance with the present disclosure.

FIG. 11 illustrates a weighting system 460 for a club head 22 that includes a weight 462 that is moveable in a sole-crown direction about a pivot axis via linear motion of a support base 464 along a sole 28 of the club head 22. The weighting system 460 includes the weight 462, the support base 464, a support leg 466, and a set of pivot legs 468. The support base 464 is slidably received within a slot 470 in the sole 28 of the club head 22. The support base 464 can be locked in position along the slot 470 by tightening a fastener 472 accessible from the exterior of the sole 28. The support leg 466 is rigidly coupled to the weight 462 at a first end and is pivotally coupled to the support base 464 at a second end. The pivot legs 468 are pivotally coupled to the weight 462 at a first end and are pivotally coupled to the sole 28 at a second end.

With continued reference to FIG. 11, the position of the weight 462 can be adjusted by linearly moving the support base 464 along the slot 470 in the sole 28 of the club head 22. For example, the fastener 472 can be loosed via a tool that can be inserted to a head of the fastener 472 and the support base 464 can then be moved into a desired position and locked into plate by tightening of the fastener 472. As the support base 464 is moved along the slot 470, the weight 462 moves along an arcuate path of travel in a sole-crown direction. The arcuate path of travel is caused by the rotation of the weight being constrained by the pivotal coupling of the pivot legs 468 at the sole 28 of the club head 22. During adjustment of the position of the weight 462, the angle of the support leg 466 relative to the sole 28, and the angle of the pivot legs 468 relative to the sole 28, increases or decreases as the support base 464 moves forward or backward along the sole 28.

Figure 12:
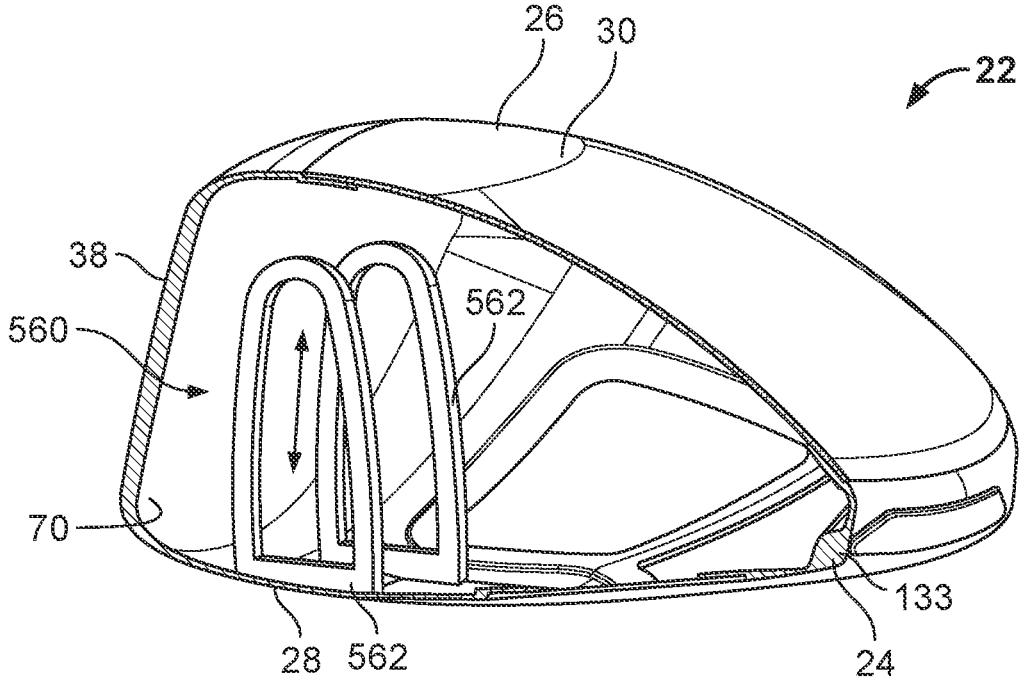
FIG. 12 is a cross-section view of a club head having a fourth embodiment of a weighting system in accordance with the present disclosure.
Figure 13:
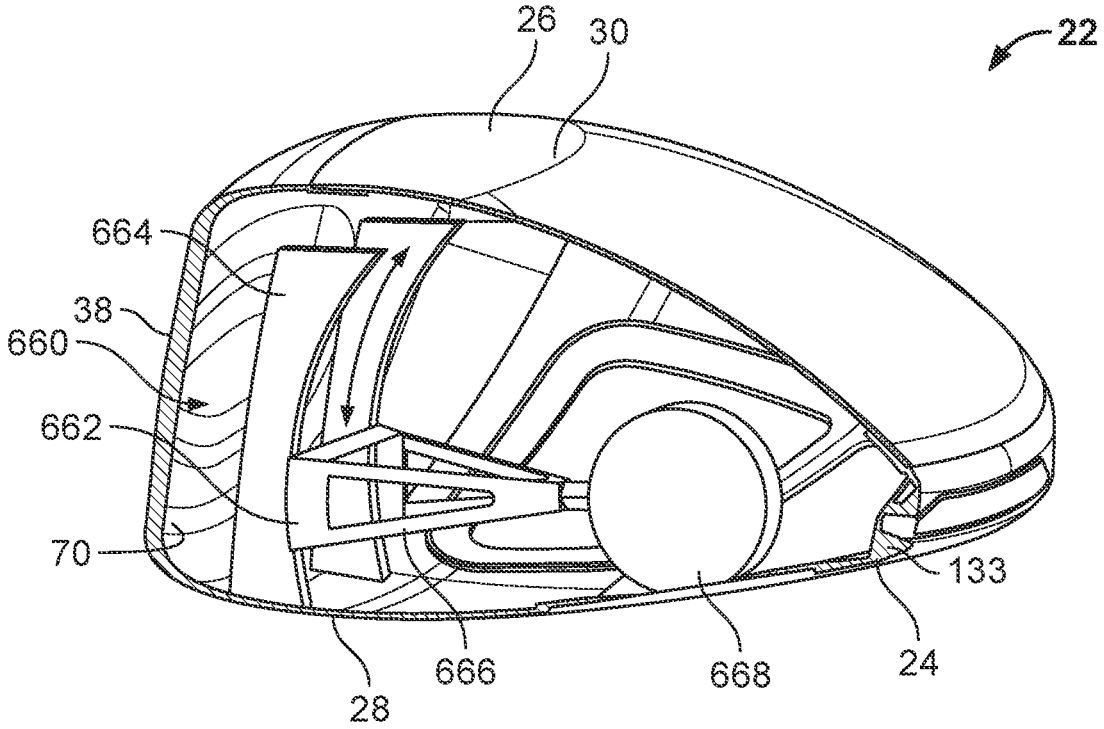
FIG. 13 is a cross-section view of a club head having a fifth embodiment of a weighting system in accordance with the present disclosure.

FIG. 12 illustrates a weighting system 560 for a club head 22 that includes a weight (not shown) that is moveable in a sole-crown direction by adjusting the position of the weight along a cage structure 562 in the form of a set of rails coupled to and extending from a sole 28 of the club head 22. FIG. 13 illustrates a weighting system 660 for a club head 22 that includes a weight 662 that is moveable in a sole-crown direction. In the illustrated embodiment, the weighting system 660 includes the weight 662, a cage structure 664, a support legs 666, and a bearing 668. The cage structure 664 includes a set of rails coupled to and extending from the sole 28 of the club head 22 and defines an arcuate path of travel for the weight 662. In the illustrated embodiment, the cage structure 664 is not supported at the upper end thereof. However, in other embodiments, the cage structure 664 can be supported by the crown 26 of the club head 22. The bearing 668 is rotatable relative to the club head 22 and is arranged adjacent to the sole 28 of the club head 22. The support legs 666 are coupled to the weight 662 at a first end and coupled to the bearing 668 at a second end. The support legs 666 extend away from the weight 662 towards the back of the club head 22. The bearing 668 is configured to pivot relative to an interior surface of the sole 28 during the adjustment of the position of the weight 662. With continued reference to FIG. 13, the position of the weight 662 can be adjusted by rotation of the bearing 668 relative to the club head 22, for example, via a tool that can be inserted into the bearing 668. As the bearing 668 is rotated, the weight 662 moves in a sole-crown direction along the cage structure 664.

Figure 14C:
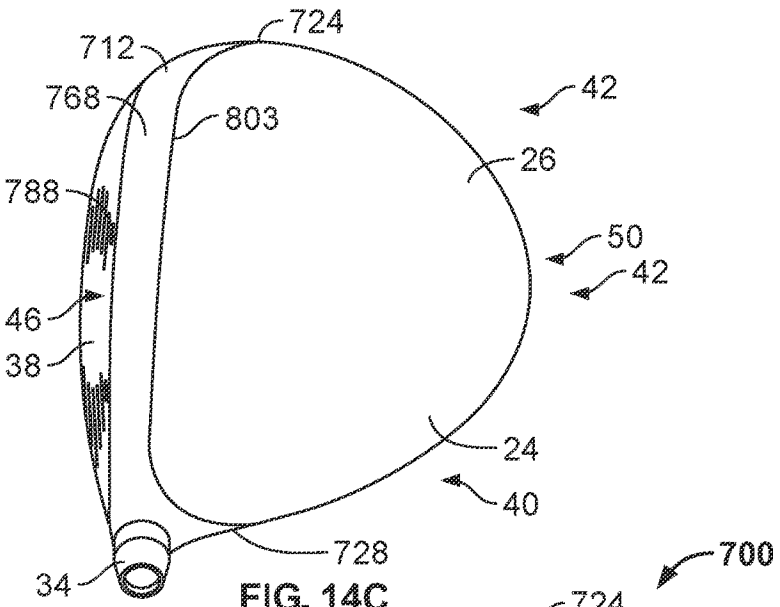
FIGS. 14A-14D illustrate various views of a club head having a sixth embodiment of a weighting system in accordance with the present disclosure.
Figure 14D:
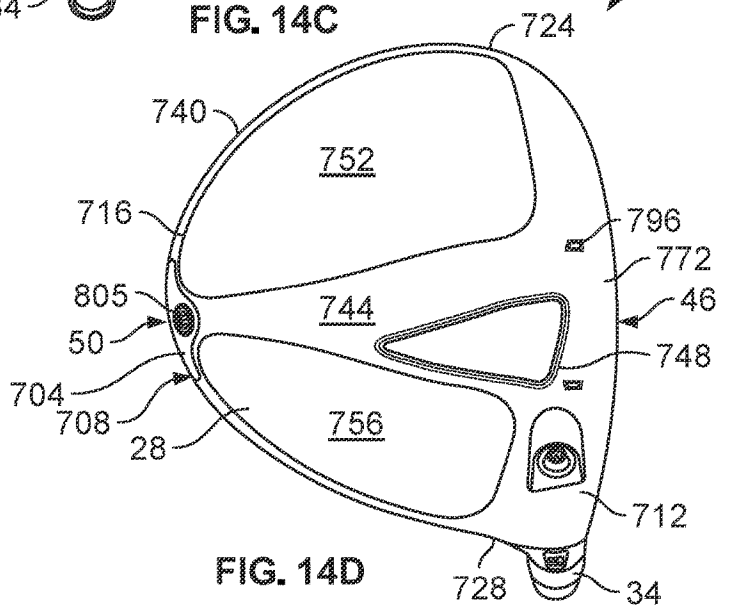
Figure 14A:
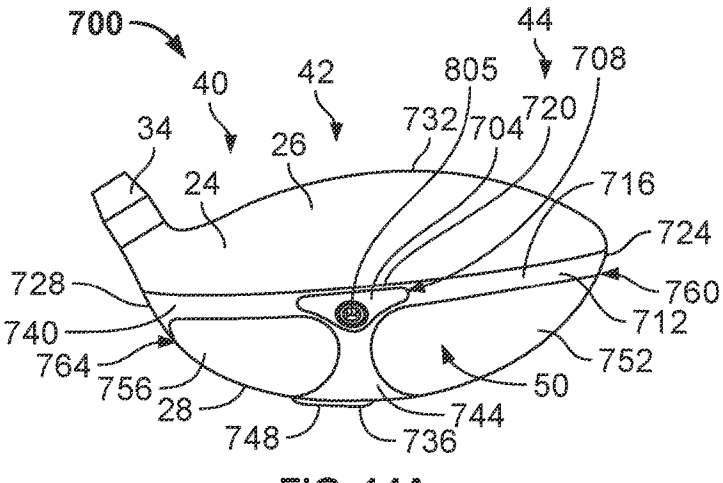

FIGS. 14A-14D illustrate another embodiment of a golf club head 700 that is configured for adjusting a CG location, which shares aspects with the golf club head 22 of FIGS. 1-13. Accordingly, like reference numerals will be used to indicate like elements. FIG. 14A depicts the rear region 50 of the golf club head 700 having a weight piece 704 that is sized and shaped to be received within a receptacle 708 formed in a chassis 712 of the club body 24. In the illustrated embodiment, the weight piece 704 is substantially flush with an outer surface 716 of the club body 24 (see FIGS. 14D and 17C). In some embodiments, the weight piece 704 is disposed entirely within the receptacle 708. In some embodiments, the weight piece 704 extends outwardly, e.g., rearwardly, from the receptacle 708, such that the weight piece 704 is not disposed entirely within the receptacle 708. As described above, the weight piece 704 may be provided to add balancing mass to the club head 700 for maintaining a MOI, such as the MOI about the vertical axis VA, within a desired or optimal range. The chassis 712 of the club head 700 includes an intersection 720 formed in the rear region 50. The intersection 720 is located approximately centrally between a toe side 724 and a heel side 728 of the club head 700 and approximately centrally between an uppermost point 732 of the crown 26 and a lowermost point 736 of the sole 28. The chassis 712 includes a skirt brace 740 that is connected to the face 38 (see FIG. 14C) at the heel side 728 and extends in a curvilinear fashion rearwardly toward the intersection 720 in the rear region 50 and also is connected to the face 38 at the toe side 724 and extends in a curvilinear fashion rearwardly toward the intersection 720 in the rear region 50.

Further, the chassis 712 includes a hull brace 744 that extends within the medial region 42 from the face 38 to the intersection 720 in a curvilinear fashion, such that the hull brace 744 curves vertically upward (e.g., S-C direction) along the sole 28 toward the intersection 720 to join the skirt brace 740. In the illustrated embodiment, the hull brace 744 incudes a detent or boss panel 748 formed on the sole 28 to define the lowermost point 736 of the club head 700. In some embodiments, the chassis 712 is a unitary component, such that the skirt brace 740 and the hull brace 744 are integrally or monolithically formed, such as by 3D printing, casting, forging, molding, or any suitable technique. In some embodiments, the skirt brace 740 is joined to the hull brace 744 by any suitable attachment technique, such as, e.g., welding, fastening, or the like.

Still referring to FIG. 14A, the club head 700 includes a toe side panel 752 and a heel side panel 756 that are received by the chassis 712 to form part of the sole 28 of the club body 24. Each of the toe side panel 752 and the heel side panel 756 are curved segments that are provided as part of the club body 24 to enclose the club head 700. As such, the toe side panel 752 covers a toe side void 760 formed by the chassis 712 in the toe region 44 and the heel side panel 756 covers a heel side void 764 formed by the chassis 712 in the heel region 40. In the illustrated embodiment, the skirt brace 740 at least partially surrounds the crown 26 and separates the crown 26 from the toe side panel 752 and the heel side panel 756. In addition, the toe side panel 752 and the heel side panel 756 are separated by the hull brace 744 extending within the medial region 42. Further, the intersection 720 of the chassis 712 is positioned adjacent converging portions of the toe side panel 752, the heel side panel 756, and the crown 26. In some embodiments, at least one of the crown 26, the toe side panel 752, or the heel side panel 756 are attached to the chassis 712 using any suitable technique, such as, e.g., fastening, welding, or the like. In some embodiments, at least one of the crown 26, the toe side panel 752, and the heel side panel 756 are integrally or monolithically formed with the chassis 712 using any suitable technique, such as, e.g., 3D printing, forging, casting, molding, or the like.

Figure 14B:
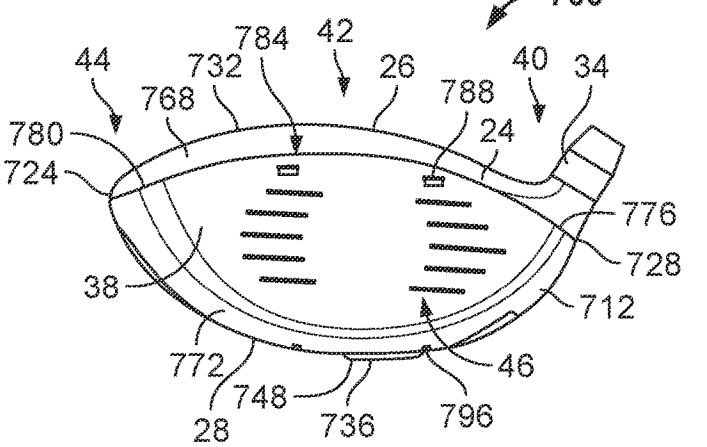

FIG. 14B depicts the front region 46 of the club head 700 with the face 38 being connected to the chassis 712 along an upper front brace 768 and a lower front brace 772, at a heelward intersection 776 formed by the upper front brace 768 joining the skirt brace 740 and the lower front brace 772 adjacent the heel side 728, and at a toeward intersection 780 formed by the upper front brace 768 joining the skirt brace 740 and the lower front brace adjacent the toe side 724. Accordingly, the face 38 spans across the chassis 712 to cover a front side void 784 thereof. In some embodiments, the chassis 712 and the face 38 are integrally formed using any suitable technique, such as, e.g., 3D printing, forging, casting, molding, or the like. In some embodiments, the face 38 is attached to the chassis 712 using any suitable technique, such as, e.g., fastening, welding, or the like. As depicted in FIG. 14B, upper connection points 788 are located on the face 38 adjacent the upper front brace 768 of the chassis 712 and spaced laterally, e.g., in the H-T direction, from one another. The upper connection points 788 are associated with connections between the face 38 and portions of a cage 792 (see FIG. 15A) disposed within the club head 700. In the illustrated embodiment, the upper connection points 788 are visible on the face 38. In some embodiments, the upper connection points 788 may not be visible on the face 38 and, instead, may be concealed by covers or caps (not shown) or by finishing techniques suitable for the particular materials and connections used, or by a thickness of the face 38 itself. Further, lower connection points 796 are located on the lower front brace 772 of the chassis 712 adjacent the sole 28 and spaced laterally, e.g., in the H-T direction, from one another. The lower connection points 796 are associated with connection between the chassis 712 and cage 792 (see FIG. 15A) disposed within the club head 700. In the illustrated embodiment, the lower connection points 796 are visible on the chassis 712. In some embodiments, the lower connection points 796 are not visible on the chassis 712 and, instead, may be concealed by covers or caps (not shown) or by finishing techniques suitable for the particular materials and connections used, or by a thickness of the chassis 712 itself.

FIG. 14C depicts the crown 26 of the club head 700 extending from the front region 46 to the rear region 50 and from the heel side 728 to the toe side 724 of the club body 24. The crown 26 is positioned entirely rearwardly of the face 38 and curves along a seam 803 formed with the chassis 712. In FIG. 14D, the sole 28 of the club head 700 is shown with the boss 748 having a triangular shape on the chassis 712. In the illustrated embodiment, the boss 748 is positioned closer to the heel side 728 than to the toe side 724 of the club head 700 and at least partially between the lower connection points 796 on the chassis 712. In some embodiments, the boss 748 may be differently sized and shaped, and may be positioned elsewhere on the chassis 712. It will be appreciated that the boss 748 can be provided in the form of a thickened perimeter of material, deformation of portions of material, or additions of material introduced during the manufacturing process to strengthen portions of the chassis, e.g., the hull brace 744 and the lower front brace 772, especially along the sole 28 where impact with ground surfaces (not shown) is foreseeable. As will be appreciated from FIGS. 14A and 14D, the weight piece 704 is mounted to the chassis 712 via a fastener 805 driven through a hole 808 (see FIGS. 17A and 17B) formed through the weight piece 704. It is contemplated that the weight piece 704 may be referred to herein as a static weight due to its singular mounting location on the club head 700. That is, the weight piece 704 is static and not configured to be repositioned among a variety of other locations on the club head 700 to adjust the CG location.

Figure 15C:
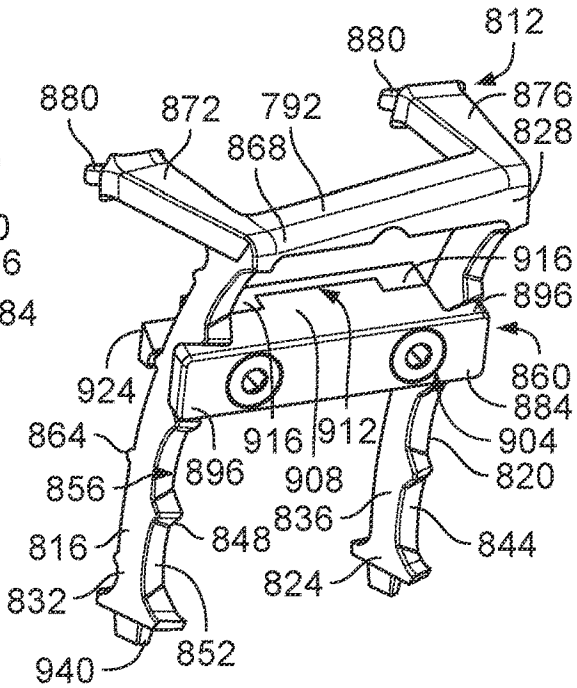
FIG. 15C illustrates a perspective view of the weight assembly attached to the cage of FIG. 15A.
Figure 15B:
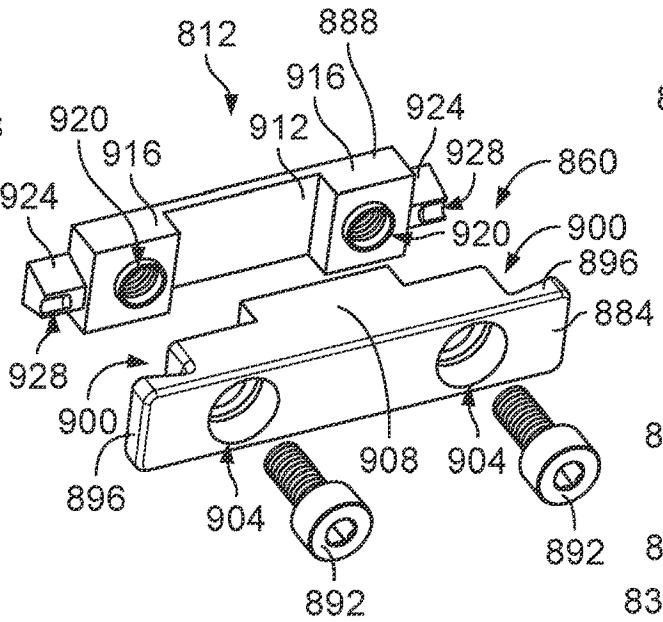
FIG. 15B illustrates a perspective view of another embodiment of a weight assembly for a weighting system for use with the cage of FIG. 15A.
Figure 15A:
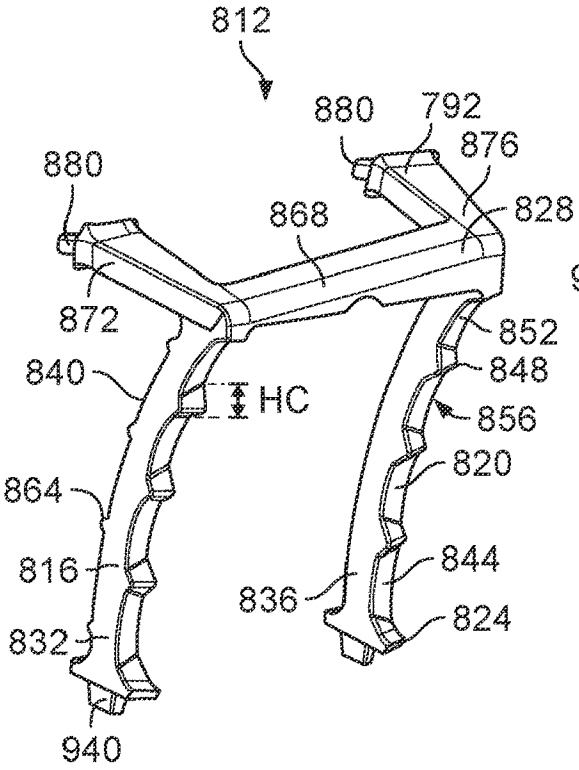
FIG. 15A illustrates a perspective view of another embodiment of a cage for a weighting system in accordance with the present disclosure.

Referring to FIGS. 15A-15C, a weighting system 812 is depicted for use with a golf club head, such as the club head 700 of FIGS. 14A-14C. The cage 792 is configured to be disposed within the club head 700. In this embodiment, the cage 792 includes a first rail 816 and a second rail 820 extending between a lower end 824 and an upper end 828. The first and second rails 816, 820 are arranged parallel with laterally spaced apart from one another, e.g., in the H-T direction. Each of the first and second rails 816, 820 includes an outer side 832, an inner side 836 that is opposite the outer side 832, a front side 840, and a back side 844 that is opposite the front side 840. It will be appreciated that the inner side 836 of the first rail 816 is configured to face the inner side 836 of the second rail 820, and that the outer side 832 of the first rail 816 is configured to face away from the outer side 832 of the second rail 820. A plurality of catches 848 and a plurality of recesses 852 are formed along the back side 844 of each of the first and second rails 816, 820. The plurality of catches 848 are spaced apart from one another between the upper end 828 and the lower end 824 of the first rail 816 and the second rail 820, e.g., in the C-S direction. Accordingly, the plurality of recesses 852 are also spaced apart from one another between the upper end 828 and the lower end 824 of the first rail 816 and the second rail 820, e.g., in the C-S direction.

In the illustrated embodiment, each catch of the plurality of catches 848 has a generally triangular profile that increases in a height dimension HC, e.g., in the C-S direction between the lower end 824 and the upper end 828, moving from the outer side 832 toward the inner side 836 of each of the first and second rails 816, 820. The plurality of catches 848 on the first rail 816 are equal in number to the plurality of catches 848 provided on the second rail 820. In the illustrated embodiment, the plurality of catches 848 include three catches on each of the first rail 816 and the second rail 820. The plurality of recesses 852 and the plurality of catches 848 are configured to provide a plurality of positions 856 along the cage 792 for receiving a weight assembly 860 (see FIG. 15B). As such, the plurality of recesses 852 extend along the back side 844 of the first rail 816 and second rail 820 between at least one of the catches of the plurality of catches 848 and another catch, the upper end 828, or the lower end 824. The plurality of positions 856 are spaced apart from one another between the upper end 828 and the lower end 824 of the first rail 816 and the second rail 820, e.g., in the C-S direction. A plurality of nubs 864 extend from the front side 840 of the first and second rails 816, 820. The plurality of nubs 864 are spaced apart from one another between the upper end 828 and the lower end 824 of the first and second rails 816, 820. The nubs 864 are arranged in correlation with the plurality of positions 856 and the plurality of recesses 852 disposed on the back side 844 of the first and second rails 816, 820, such that the nubs 864 are disposed in positions that are complementary to the plurality of positions 856.

A crossbar 868 extends laterally across the upper end 828 to join the first rail 816 to the second rail 820. The crossbar 868 varies in a height dimension, e.g., in the C-S direction, between the first rail 816 and the second rail 820. In the illustrated embodiment, the height dimension of the crossbar 868 increases from the first rail 816 to the second rail 820, which may be described as a gradual increase. In this way, the crossbar 868 provides reinforcement in the lateral direction, e.g., the H-T direction, to the first and second rails 816, 820 of the cage 792 and, further, locates a greater amount of mass toward the second rail 820 of the cage 792. First and second side bars 872, 876 extend in the forward direction, e.g., in the R-F direction, from opposite ends of the crossbar 868, such that the first side bar 872 is disposed adjacent to the first rail 816 and the second side bar 876 is disposed adjacent to the second rail 820. Each of the first and second side bars 872, 876 includes an upper mounting post 880 and tapers or narrows from the upper mounting post 880 to the crossbar 868.

FIG. 15B depicts the weight assembly 860 for use with the cage 792 of FIG. 15A. The weight assembly 860 includes a first component 884 that is removably attached to a second component 888 via fasteners 892. The first component 884 includes flanges 896 extending outwardly to define notches 900 for mating with first and second rails 816, 820. The flanges 896 increase in thickness moving outwardly of the first component 884, such that the notches 900 are configured to mate tightly within the plurality of recesses 852 and to complement the angle or curvature of the back side 844 of the first and second rails 816, 820, as illustrated in FIG. 15C. Further, when the weight assembly 860 is secured to the cage 792, the weight assembly 860 is reinforced against lateral displacement or dislodgement from the cage 792 by the varying height dimension of the plurality of catches 848 and the varying thickness dimension of the flanges 896 on the first component 884 of the weight assembly 860. That is, the plurality of catches 848 and the flanges 896 of the weight assembly 860 are configured, e.g., sized and shaped, to prevent displacement or dislodgement of the weight assembly 860 from the cage 792 in multiple directions.

In the illustrated embodiment, the first component 884 includes through holes 904 that are unthreaded and extend entirely through the first component 884 for receiving portions of the fasteners 892 therethrough. The through holes 904 are disposed inwardly of the flanges 896 of the first component 884 while being positioned outwardly of a detent 908 that is generally rectangular in shape and is disposed centrally between the flanges 896. The detent 908 protrudes from the first component 884 to be received within a complementary indent 912 formed in the second component 888 when assembled. Accordingly, the second component 888 defines the indent 912 between thickened portions 916 through which threaded holes 920 are formed to receive the fasteners 892. That is, during assembly the through holes 904 of the first component 884 are aligned axially with the threaded holes 920 of the second component 888, the detent 908 is brought into engagement with the indent 912 of the second component 888, and the fasteners 892 are inserted through the through holes 904 of the first component 884 to become threadably engaged and tightened within the threaded holes 920 of the second component 888, as illustrated in FIG. 16A. The threaded holes 920 of the second component 888 may be provided in the form of sheaths or tubes that are affixed to the second component 888 and protrude outwardly therefrom, e.g., in the rear or F-R direction. The second component 888 further includes support tabs 924 extending outwardly from the thickened portions 916, opposite to and away from the indent 912, to define curved slots 928 that are configured to receive the plurality of nubs 864, as illustrated in FIG. 15C. The support tabs 924 have a generally trapezoidal profile and are at least partially thinner and smaller in size than the thickened portions 916 of the second component 888.

FIG. 16A illustrates the weight assembly 860 coupled to the cage 792 inside of an interior volume 932 defined by the club head 700. The weight assembly 860 may be referred to herein as a dynamic weight due to the variety of adjustable positions in which the weight assembly 860 may be located along the cage 792. The second component 888 of the weight assembly 860 is configured to mate with the front side 840 of the first and second rails 816, 820, while the first component 884 is configured to mate with the back side 844 of the first and second rails 816, 820. The weight assembly 860 is positioned in one of the plurality of positions 856 along the first and second rails 816, 820. In the illustrated embodiment, the lower end 824 of the cage 792 is attached to the chassis 712 at the lower connection points 796. Further, the first and second side bars 872, 876 of the cage 792 are attached to a rear surface 936 of the face 38. It will be appreciated that the first and second side bars 872, 876 and the first and second rails 816, 820 are sized and shaped to locate the weight assembly 860 adjacent to but separated from the rear surface 936 of the face 38 and between the sole 28 and the crown 26 (see FIG. 14A). As illustrated in FIG. 16A, the cage 792 and the weight assembly 860 occupy a proportion of the interior volume 932 of the club head 700. In some embodiments, the cage 792 and the weight assembly 860 occupy less than 50% of a total volume of the interior volume 932, or less than 40% of the total volume, or less than 30% of the total volume.

Figure 16B:
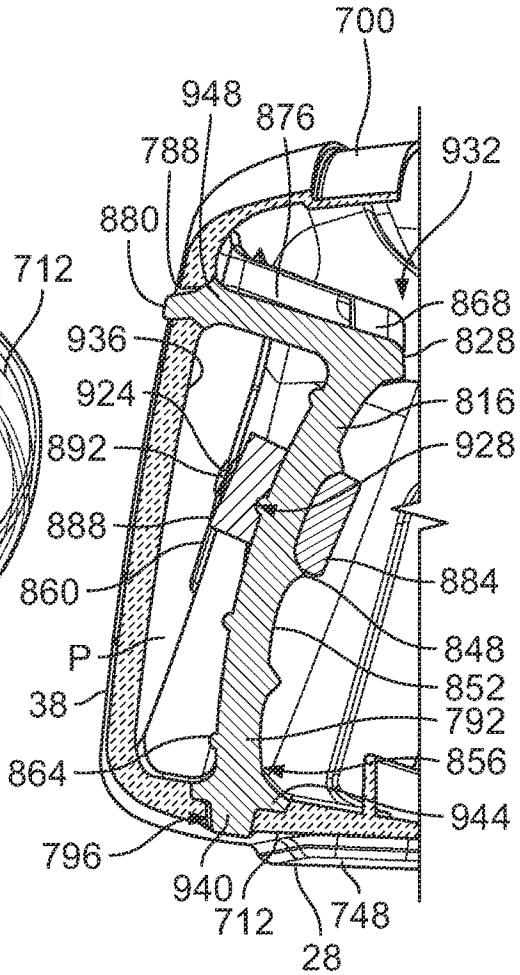
FIG. 16B illustrates a partial, sectional view of the golf club head and weighting system of FIG. 16B.
Figure 16A:
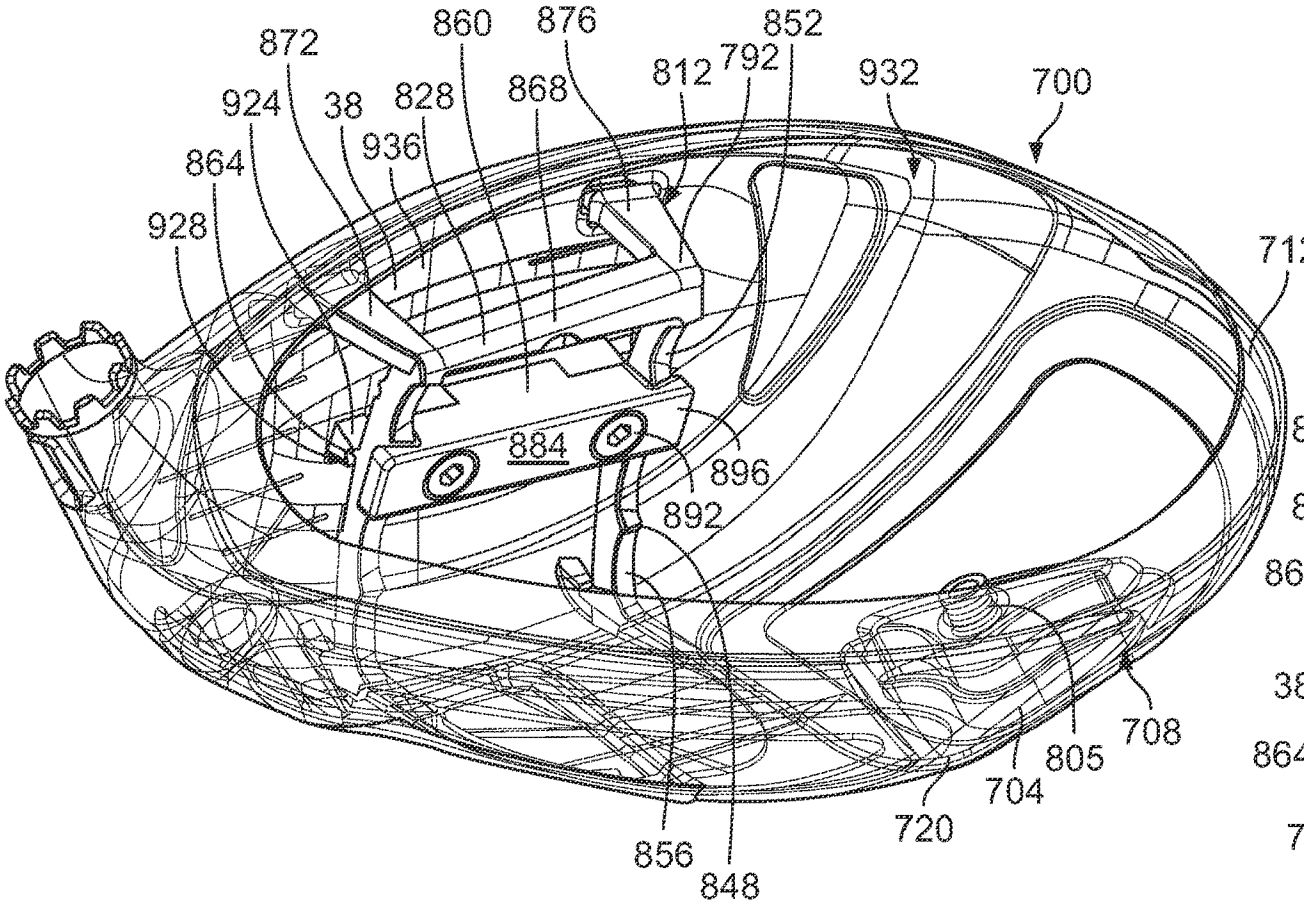
FIG. 16A illustrates a partial view of the weighting system of FIGS. 15A-15C installed within a golf club head in accordance with the present disclosure, the golf club head being represented as transparent.

FIG. 16B illustrates a partial cross-sectional view of the cage 792 and the weight assembly 860 attached to the club head 700. In the illustrated embodiment, the upper end 828 of the first rail 816 and the second rail 820 are disposed a greater distance from the rear surface 936 of the face 38 than a distance between the lower ends 824 of the first and second rails 816, 820 and the rear surface 936 of the face 38. The first and second rails 816, 820 curve convexly relative to the face 38 between the lower end 824 and the upper end 828. In other words, the first and second rails 816, 820 curve from the lower end 824 to the upper end 828 in a direction away from a plane P that is defined along and coplanar with the rear surface 936 of the face 38 in the C-S direction and the H-T direction. As such, the plurality of positions 856 provided along the first and second rails 816, 820 allow for adjustment of the weight assembly 860 in multiple directions, including the C-S direction and the F-R direction. As a result, the CG location of the club head 700 can be adjusted in multiple directions by relocating the weight assembly 860 among the plurality positions 856. For example, positioning the weight assembly 860 toward the lower end 824 of the cage 792, adjacent the sole 28, causes the CG location to be positioned lower and forwardly in comparison to when the weight assembly 860 is located toward the upper end 828 which is associated with the CG location being positioned higher and farther rearward.

Referring to FIG. 16B, the first and second side bars 872, 876 extend from the face 38 downwardly at an angle relative to the plane P of the rear surface 936. In the illustrated embodiment, the upper mounting posts 880 are received within the face 38 at the upper connection points 788, which are provided in the form of apertures extending through the face 38. Accordingly, a portion of the upper mounting posts 880 protrudes from the face 38, so as to be visible from an exterior of the club head 700. Additionally, lower mounting posts 940 (see FIGS. 15A and 15C) of the cage 792 are received within the chassis 712 at the lower connection points 796, which are provided in the form of apertures extending through the chassis 712. The lower end 824 of the first and second rails 816, 820 each have a flared base 944 that is attached to the chassis 712 for distributing or expanding the interface therebetween to reinforce the cage 792 against impact forces. A portion of the lower mounting posts 940 protrudes from the sole 28 through the chassis 712, so as to be visible from an exterior of the club head 700. Further, the first and second side bars 872, 876 each have a flared end 948 for distributing or expanding the interface therebetween and reinforcing the connection between the cage 792 and the face 38 against impact forces.

Figure 17B:
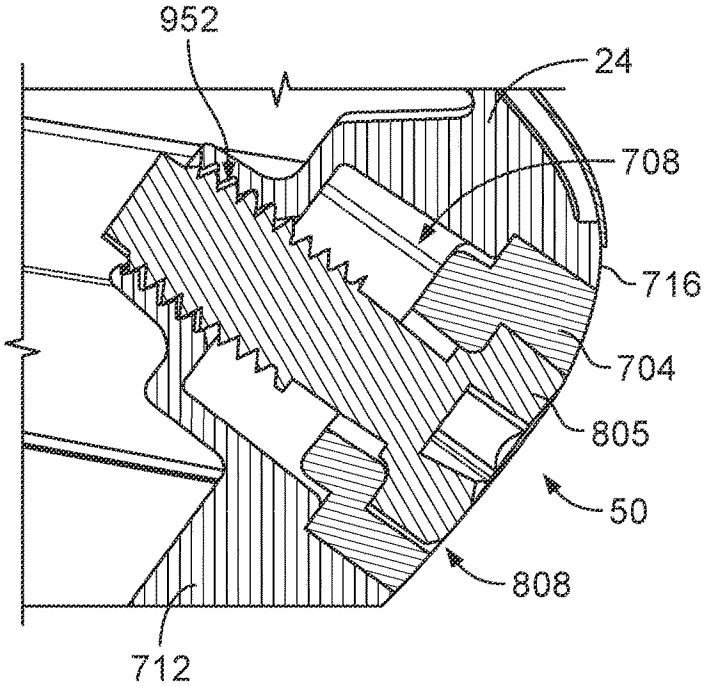
FIG. 17B illustrates a partial, sectional view of the static weight mounted to the golf club head of FIGS. 14A-D.
Figure 17A:
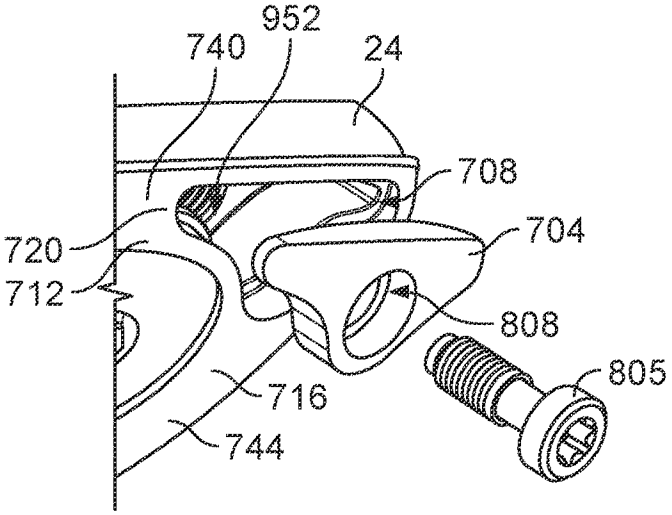
FIG. 17A illustrates a partial, exploded view of a static weight for the golf club head of FIGS. 14A-D.

Turning to FIGS. 17A and 17B, the weight piece 704 is configured to be removably attached to the chassis 712 via the fastener 805 threadably engaging a threaded hole 952 formed in the receptacle 708 of the chassis 712. The weight piece 704 has the hole 808 that is countersunk to receive the fastener 805 therethrough and retain the fastener 805 therein, such that the fastener 805 and the weight piece 704 can be mounted flush with the outer surface 716 of the club body 24, which may prevent dirt and debris from interfering with the connection. In the illustrated embodiment, the weight piece 704 occupies less than an entire volume defined by the receptacle 708. In some embodiments, the weight piece 704 occupies at least 50% of a volume defined by the receptacle 708. In some embodiments, the weight piece 704 occupies at least 90% of the volume defined by the receptacle 708.

Figure 18:
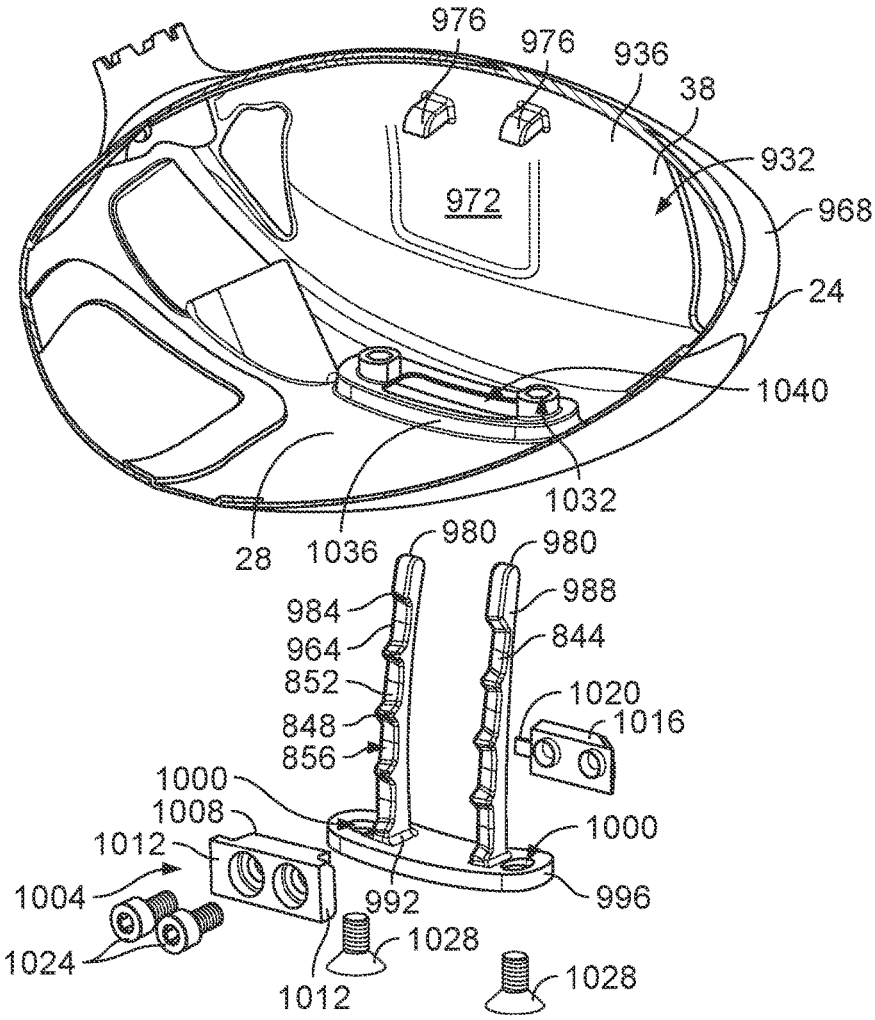
FIG. 18 illustrates an exploded view of another embodiment of a weighting system for a golf club head in accordance with the present disclosure.

Turning to FIGS. 18-24, another embodiment of a weighting system 960 including a cage 964 is depicted in connection with a club head 968. For purposes of clarity and brevity, like reference numerals will be used to indicate like elements, and the disclosure will focus on features and aspects of the cage 964 and club head 968 which differ from embodiments described above and shown in FIGS. 1-17B. Referring specifically to FIG. 18, the club head 968 has the multi-component club body 24 that defines the interior volume 932 in which the cage 964 is configured to be disposed. The face 38 of the club head 968 has a variable thickness, e.g., in the F-R direction, such that a contoured area 972 is formed approximately centrally on the face 38, which may correspond with a "sweet spot" or frequently impacted area of the face 38. A pair of hooks 976 extend rearwardly from the rear surface 936 of the face 38. The hooks 976 are disposed just above the contoured area 972 and are spaced apart laterally from one another, e.g., in the H-T direction. The hooks 976 are configured to receive upper ends 980 of first and second rails 984, 988 of the cage 964. In the illustrated embodiment, the first and second rails 984, 988 are connected to one another at a lower end 992 by a base 996 that is generally oval-shaped or oblong and curves convexly between opposing ends thereof to conform to the curved shape of the sole 28 when mated with the club head 968. The base 996 includes through holes 1000 disposed at opposite ends thereof, such that the first and second rails 984, 988 extend from the base 996 at locations inwardly of and between the through holes 1000. The first and second rails 984, 988 extend substantially parallel with one another away from the base 996 in a generally vertical, e.g., S-C direction. The first and second rails 984, 988 include the plurality of catches 848 and the plurality of recesses 852 arranged along the back sides 844 thereof.

Figure 19:
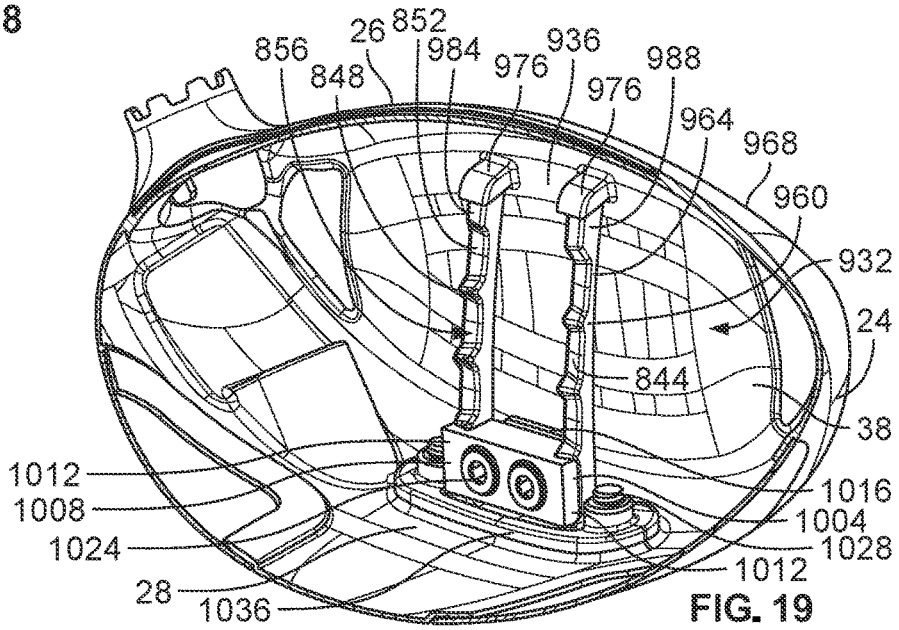
FIG. 19 illustrates a partial, cut-away view of the weighting system installed within the golf club head of FIG. 18.

Additionally, the upper ends 980 of the first and second rails 984, 988 are disconnected and spaced apart from one another, such that the first and second rails 984, 988 are cantilevered from the base 996. A weight assembly 1004 is configured to be attached to the first and second rails 984, 988 of the cage 964 in one of the plurality of positions 856 between the upper ends 980 and lower ends 992. The weight assembly 1004 includes a first component 1008 having opposing flanges 1012 and a second component 1016 having a support tab 1020. The first and second components 1008, 1016 of the weight assembly 1004 are joined together and to the cage 964 by fasteners 1024, as illustrated in FIG. 19. Further, the cage 964 is attached to the sole 28 of the club head 968 by fasteners 1028 that are configured to be inserted through the through holes 1000 of the base 996 and threadably engaged in mounting holes 1032 formed in an inwardly protruding boss 1036 of the club head 968, as illustrated in FIG. 19. When installed within the club head 968, the upper ends 980 of the first and second rails 984, 988 are received within and retained by the hooks 976 protruding from the face 38.

Figure 20:
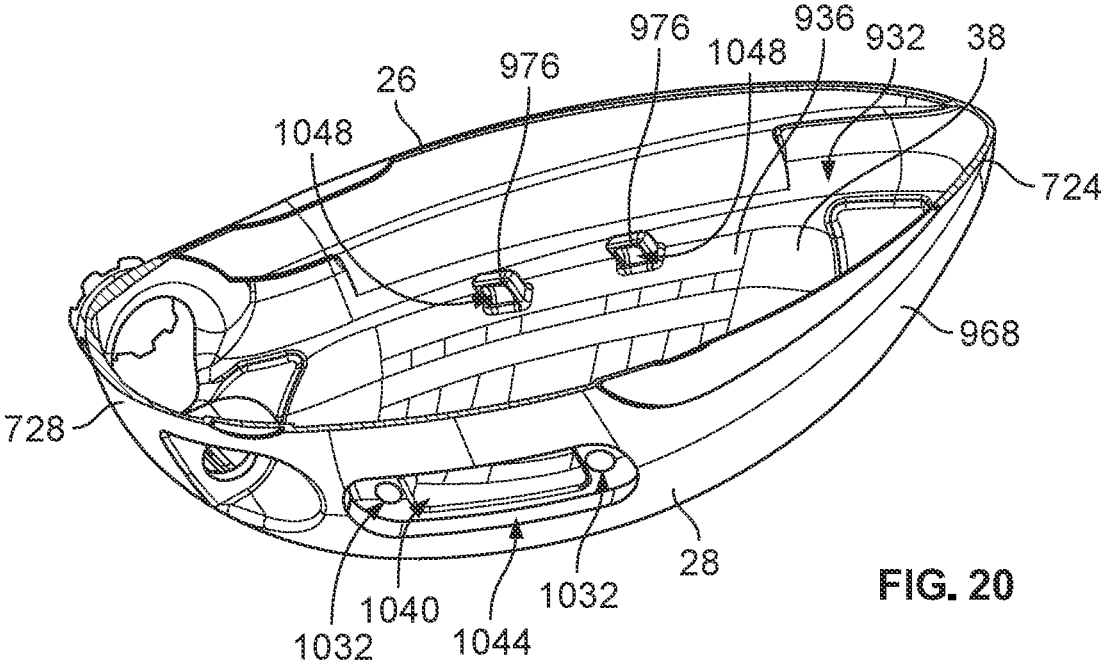
FIG. 20 illustrates a partial, cut-away view of the golf club head of FIG. 18.
Figure 21:
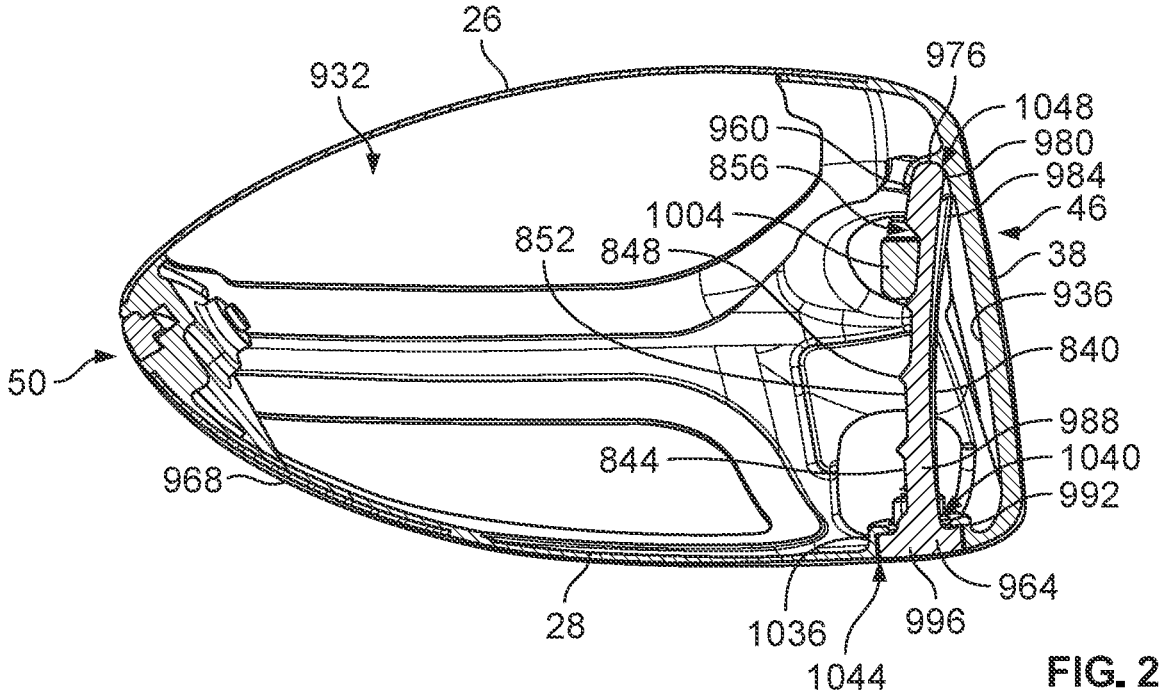
FIG. 21 illustrates a sectional view of the weighting system installed within the golf club head of FIG. 18.

As described above, the hooks 976 are configured to receive the upper ends 980 of the first and second rails 984, 988 when the cage 964 is installed within the club head 968. With reference to FIGS. 20 and 21, the cage 964 is installed by inserting the first and second rails 984, 988 through a slot 1040 formed within a recess 1044 on the sole 28 of the club head 968. The upper ends 980 of the first and second rails 984, 988 are passed through the interior volume 932 toward the crown 26 until being received within pockets 1048 formed by the hooks 976, at which point the base 996 is received within the recess 1044 on the sole 28. Further, the fasteners 1028 are axially aligned with and inserted through the through holes 1000 of the base 996 to become threadably engaged and tightened with the mounting holes 1032 of the club head 968. It will be appreciated that the weight assembly 1004 is, preferably, joined to the cage 964 in one of the plurality of positions 856 along the first and second rails 984, 988 prior to installing the cage 964 within the club head 968, although other configurations are possible.

As depicted in FIG. 21, the first and second rails 984, 988 extend from the base 996 toward the upper ends 980 with relatively less curvature when compared with, e.g., the first and second rails 816, 820 of the cage 792 of FIG. 16B. Further, the first and second rails 984, 988 are curved concavely relative to the rear surface 936 of the face 38 of the club head 968, such that the upper ends 980 are located closer to the face 38 at a smaller distance from the rear surface 936 than a distance between the base 996 and the rear surface 936 of the face 38. As such, locating the weight assembly 960 closer to the upper end 980 moves the CG location higher and more forward in comparison to when the weight assembly 1004 is located closer to the lower end 992.

Figure 22:
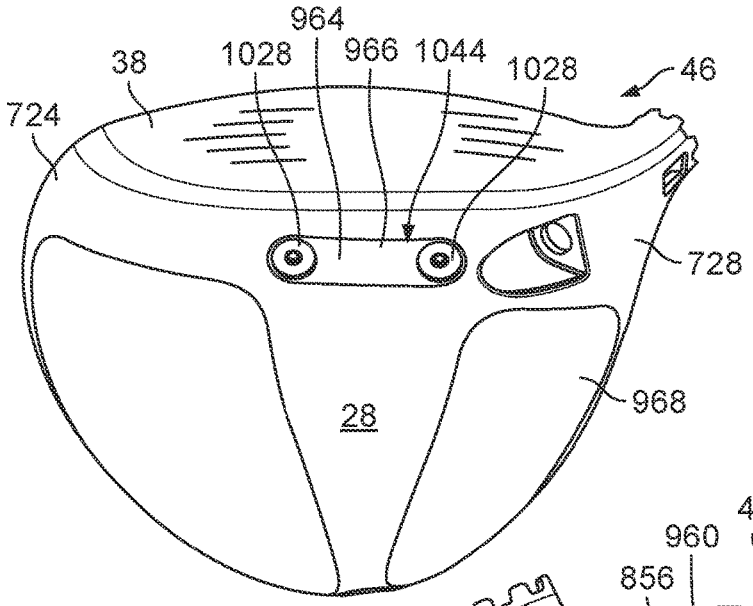
FIG. 22 illustrates a perspective view of a bottom and front of the golf club head of FIG. 18.
Figure 23:
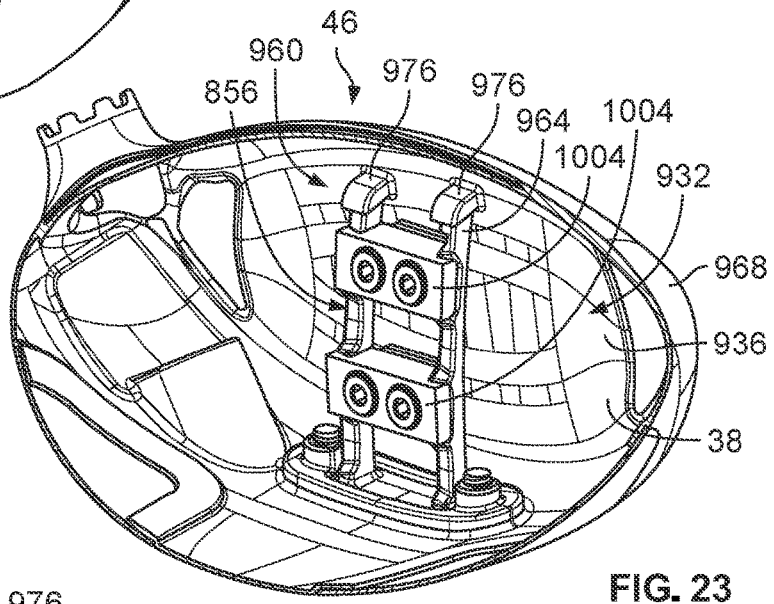
FIG. 23 illustrates a partial, cut-away view of the weighting system installed within the golf club head of FIG. 18, in which the weighting system is in a semi-loaded configuration.
Figure 24:
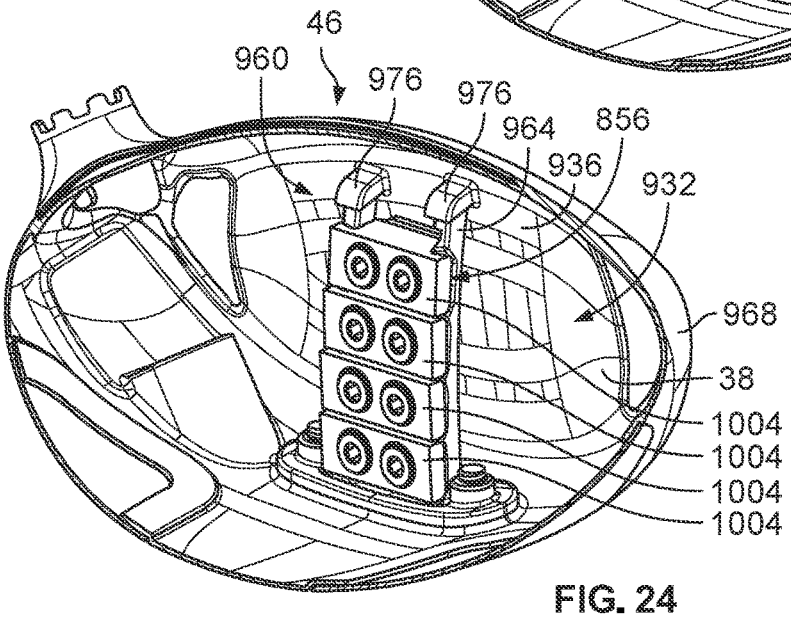
FIG. 24 illustrates a partial, cut-away view of the weighting system installed within the golf club head of FIG. 18, in which the weighting system is in a fully loaded configuration.

As illustrated in FIG. 22, the recess 1044 is formed on the sole 28 rearwardly of the face 38 and approximately centrally between the heel side 728 and the toe side 724 of the club head 968. The fasteners 1028 and the base 996 of the cage 964 are received within the recess 1044 to be generally flush with, or at least to avoid protruding outwardly from, the sole 28. As will be appreciated from FIGS. 23 and 24, the cage 964 may be provided with a plurality of weight assemblies 1004 along the first and second rails 984, 988. Accordingly, the cage 964 may receive the plurality of weight assemblies 1004, each occupying a different one of the plurality of positions 856, prior to being installed within the club head 968. The cage 964 may be fully loaded, such that all of the plurality of positions 856 are occupied by weight assemblies 1004, as depicted in FIG. 24. Alternatively, the cage 964 may be semi or partially loaded, such that less than all of the plurality of positions 856 are occupied by weight assemblies 1004, as depicted in FIG. 23.

Figure 25:
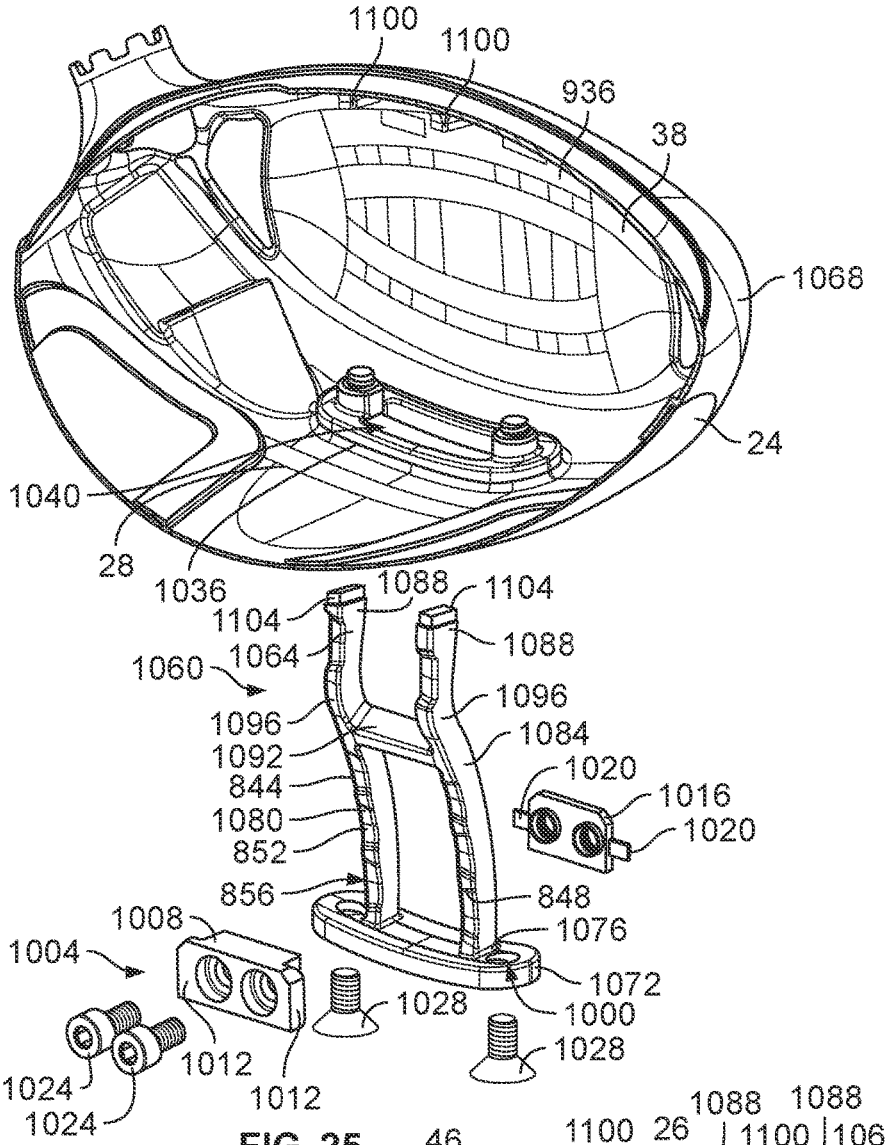
FIG. 25 illustrates an exploded view of another embodiment of a weighting system for a golf club head in accordance with the present disclosure.
Figure 26:
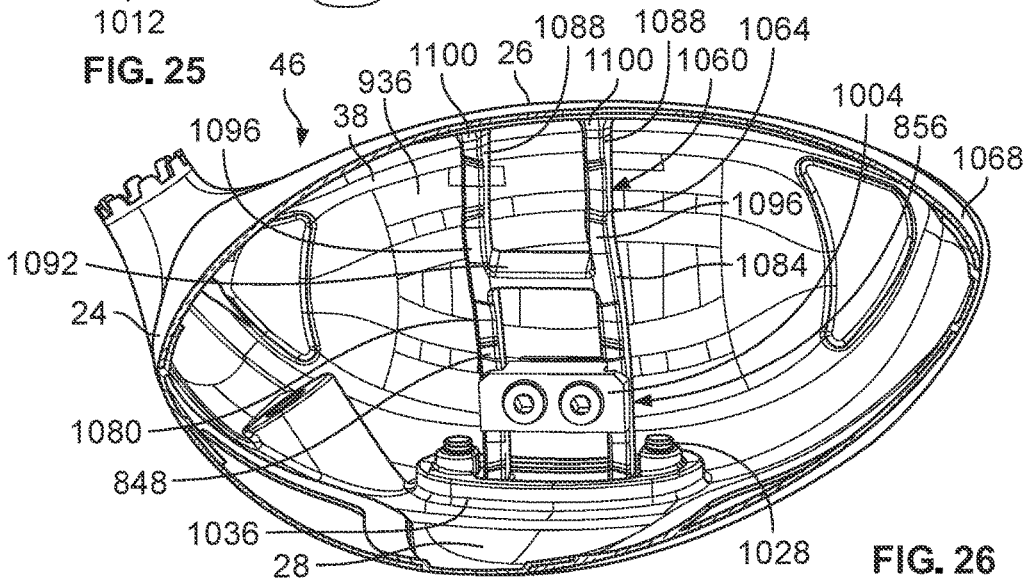
FIG. 26 illustrates a partial, cut-away view of the weighting system installed within the golf club head of FIG. 26.

FIGS. 25-30 illustrate another embodiment of a weighting system 1060 including a cage 1064 in connection with a club head 1068. For purposes of clarity and brevity, like reference numerals will be used to indicate like elements, and the disclosure will focus on features and aspects of the cage 1064 and club head 1068 which differ from embodiments described above and shown in FIGS. 1-24. As illustrated in FIG. 25, the cage 1064 includes a base 1072 that forms a lower end 1076 from which a first rail 1080 and a second rail 1084 extend substantially parallel with one another toward upper ends 1088. A crossbar 1092 extends between the first and second rails 1080, 1084 at a position that is interposed between the upper ends 1088 and the base 1072. In the illustrated embodiment, the crossbar 1092 is located closer to the upper ends 1088 than to the lower end 1076, although other configurations are possible. The crossbar 1092 is located adjacent to inflection points or bends 1096 of the first and second rails 1080, 1084. The bends 1096 are formed by a change in curvature of the first and second rails 1080, 1084. Accordingly, the first and second rails 1080, 1084 curve convexly from the base 1072 to the bends 1096 and then change to a generally linear or slightly concave curvature from the bends 1096 to the upper ends 1088. In some embodiments, the first and second rails 1080, 1084 include multiple inflection points or bends 1096 between the upper ends 1088 and the base 1072. In some embodiments, only the first rail 1080 or only the second rail 1084 includes the bend 1096. In some embodiments, the bend 1096 of the first rail 1080 and the bend 1096 of the second rail 1084 are disposed at different elevations relative to the base 1072. The crossbar 1092 is positioned between the curved segments of the first and second rails 1080, 1084, such that the crossbar 1092 is tilted at an angle between the front side 840 and the back side 844.

Figure 27:
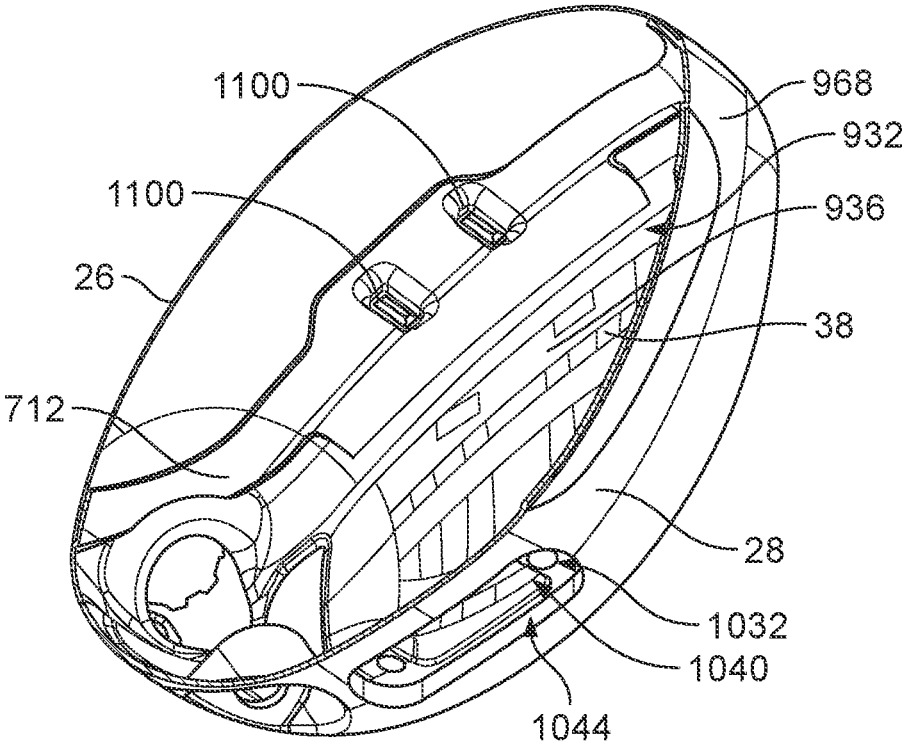
FIG. 27 illustrates a partial, cut-away view of the golf club head of FIG. 26.
Figure 28:
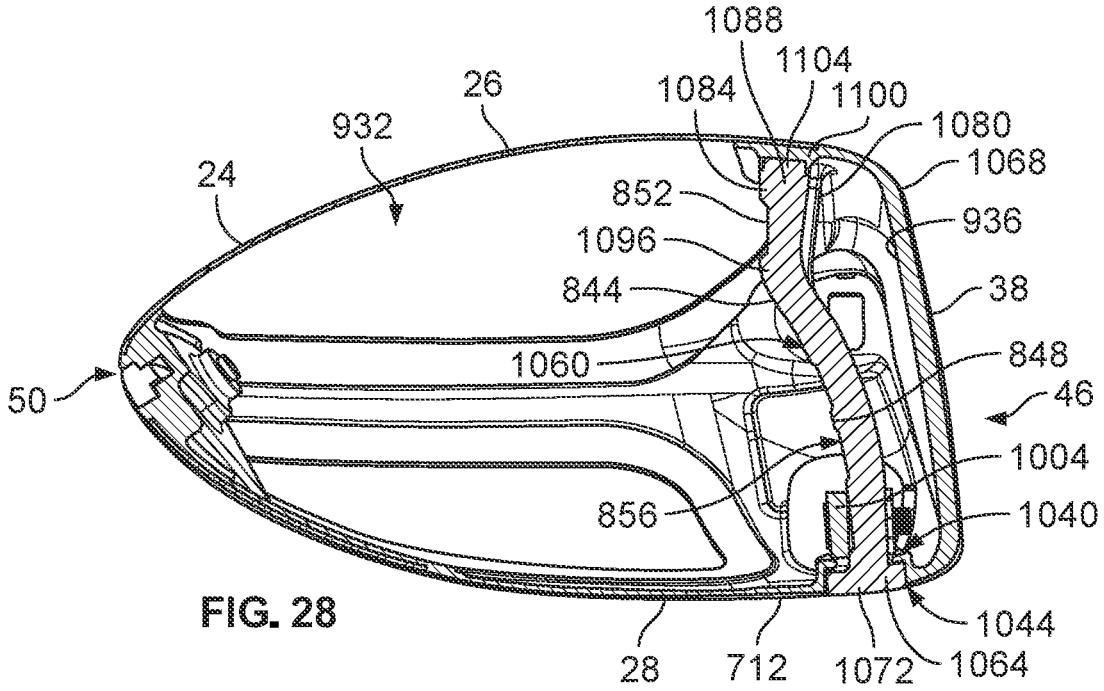
FIG. 28 illustrates a sectional view of the weighting system installed within the golf club head of FIG. 26.
Figure 29:
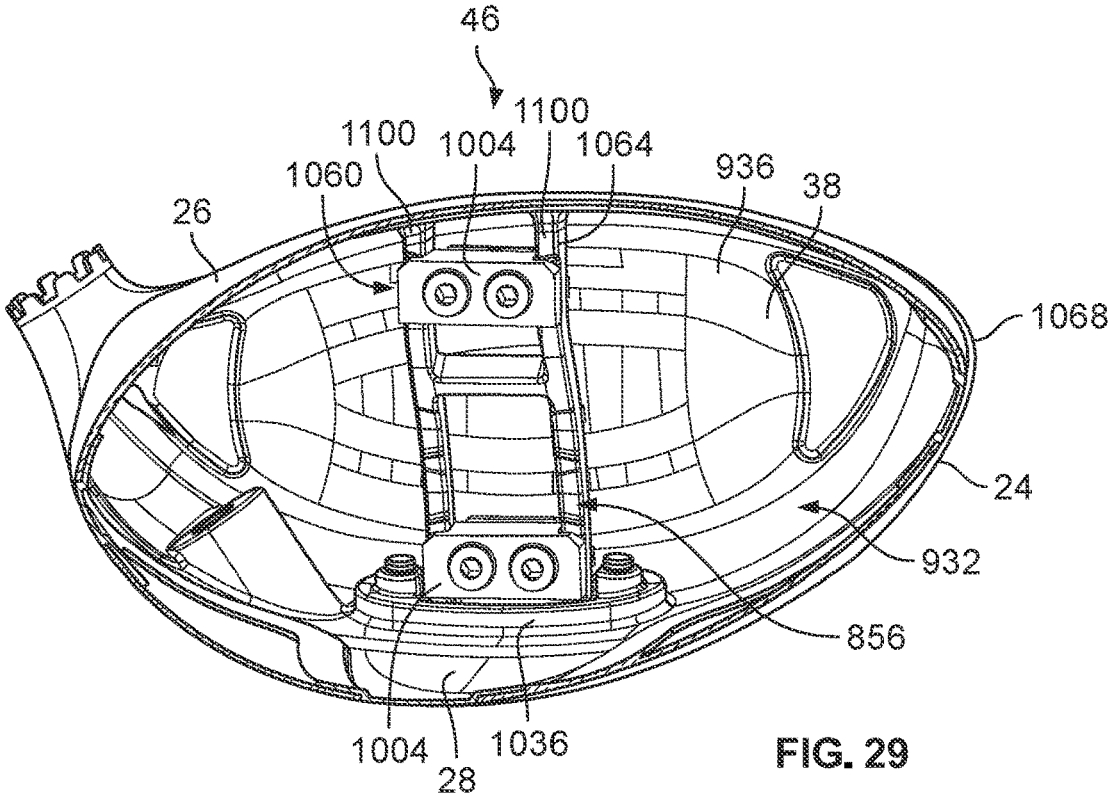
FIG. 29 illustrates a partial, cut-away view of the weighting system installed within the golf club head of FIG. 26, in which the weighting system is in a semi-loaded configuration.
Figure 30:
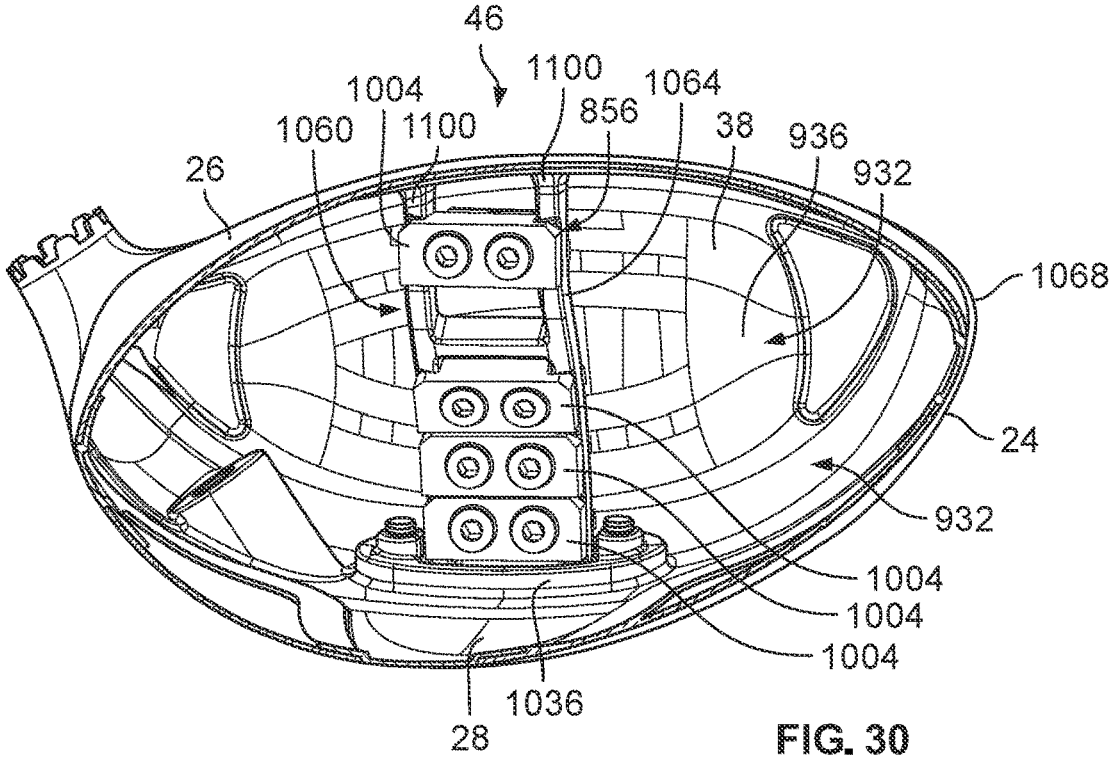
FIG. 30 illustrates a partial, cut-away view of the weighting system installed within the golf club head of FIG. 26, in which the weighting system is in a fully loaded configuration.

As illustrated in FIG. 27, upper connection points 1100 are formed within the interior volume 932 of the club head 968 for receiving the upper ends 1088 of the first and second rails 1080, 1084 of the cage 1064. The upper connection points 1100 are provided in the form of receptacles at the crown 26 of the club head 968 and spaced laterally from one another, e.g., in the H-T direction. The upper connection points 1100 are located along the chassis 712 and spaced rearwardly of the face 38. It is contemplated that the upper connection points 1100 can be located different distances from the face 38 relative to one another. Each of the upper connection points 1100 receives an upper mounting post 1104 formed on the upper end 1088 of the first and second rails 1080, 1084, as shown in FIG. 28. A distance between the rear surface 936 of the face 38 and the first and second rails 1080, 1084 varies between the upper ends 1088 and the lower ends 1076, the distance increasing when moving from the upper ends 1088 toward the bends 1096, and then the distance reducing when moving from the bends 1096 to the lower end 1076. As a result, the weight assembly 1004 is configured to adjust the CG location in the C-S direction and the F-R direction when moved among the plurality of positions 856 provided by the plurality catches 848 and the plurality of recesses 852 arranged along the first and second rails 1080, 1084. In the illustrated embodiment, the highest position of the plurality of positions 856 corresponds with the highest and rearmost CG location. The lowest position of the plurality of positions 856 corresponds with the lowest and forwardmost CG location. The cage 1064 may be fully loaded, such that all of the plurality of positions 856 are occupied by weight assemblies 1004, as depicted in FIG. 30. Alternatively, the cage 1064 may be semi or partially loaded, such that less than all of the plurality of positions 856 are occupied by weight assemblies 1004, as depicted in FIG. 29.

Figure 31:
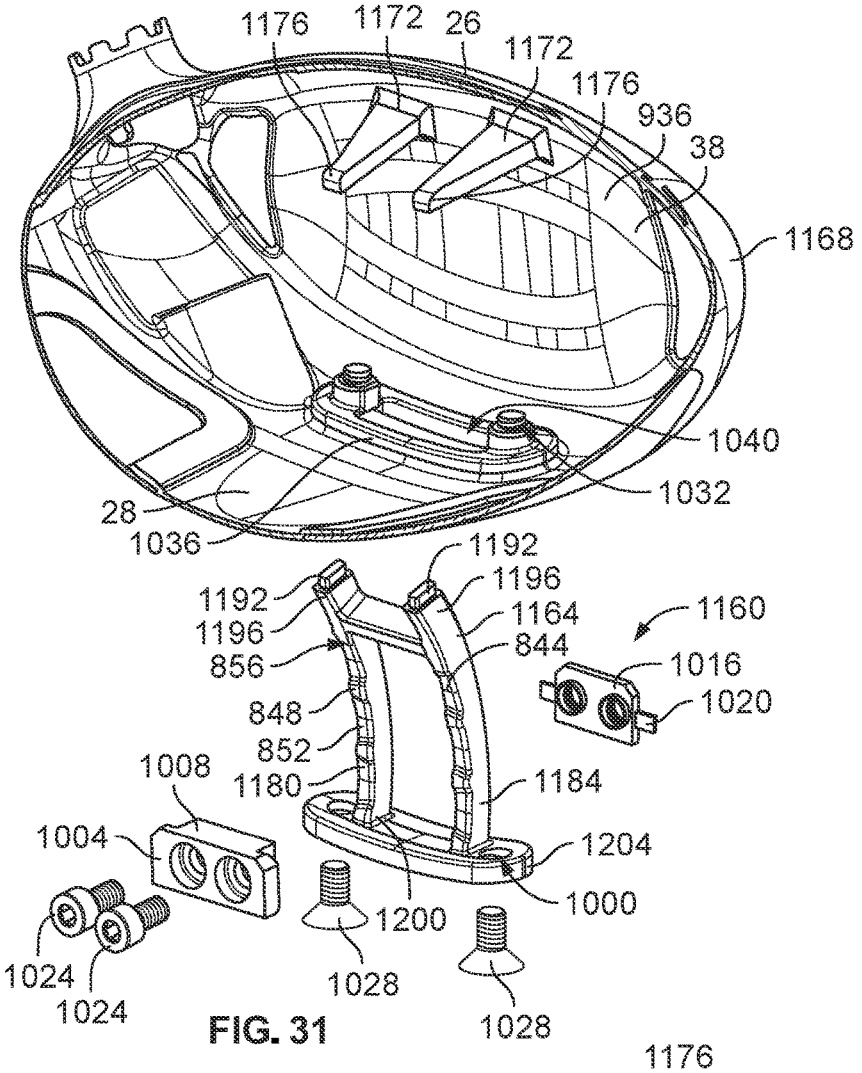
FIG. 31 illustrates an exploded view of another embodiment of a weighting system for a golf club head in accordance with the present disclosure.
Figure 32:
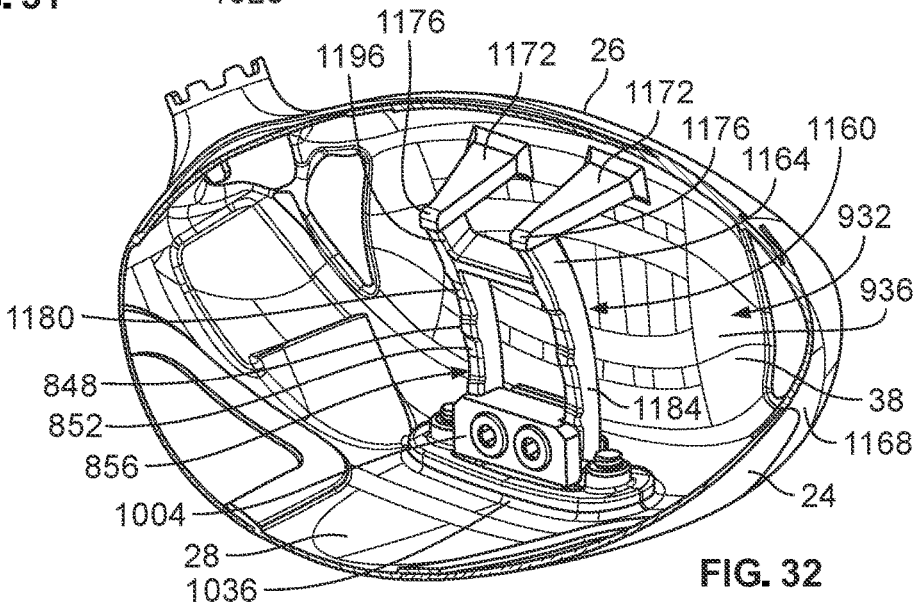
FIG. 32 illustrates a partial, cut-away view of the weighting system installed within the golf club head of FIG. 31.
Figure 33:
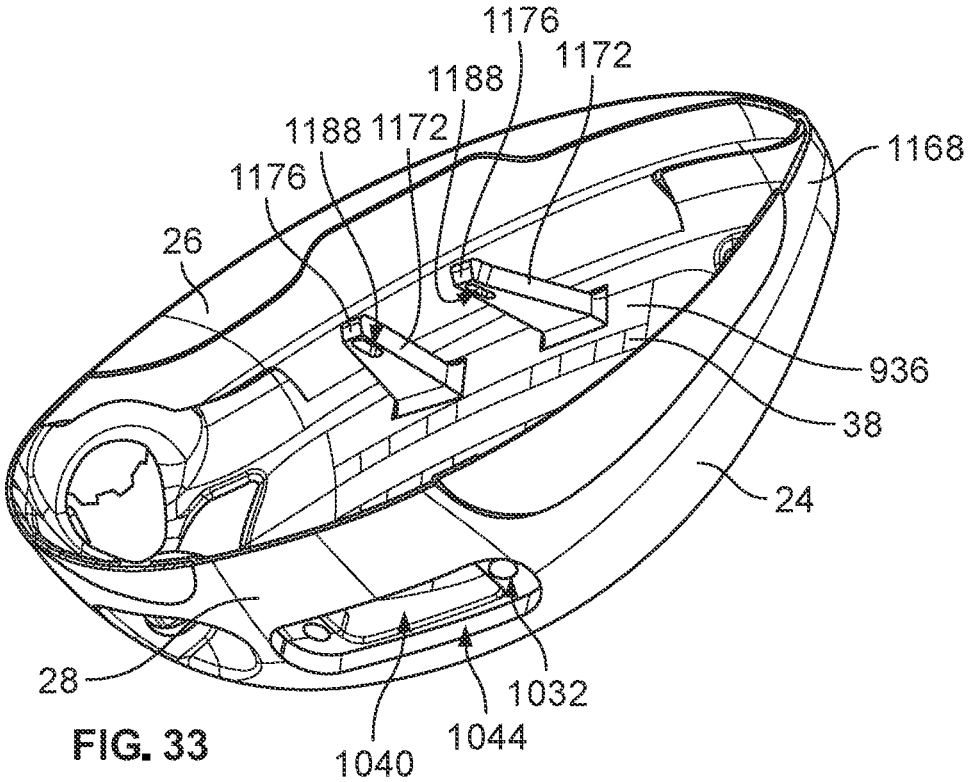
FIG. 33 illustrates a partial, cut-away view of the golf club head of FIG. 31.
Figure 34:
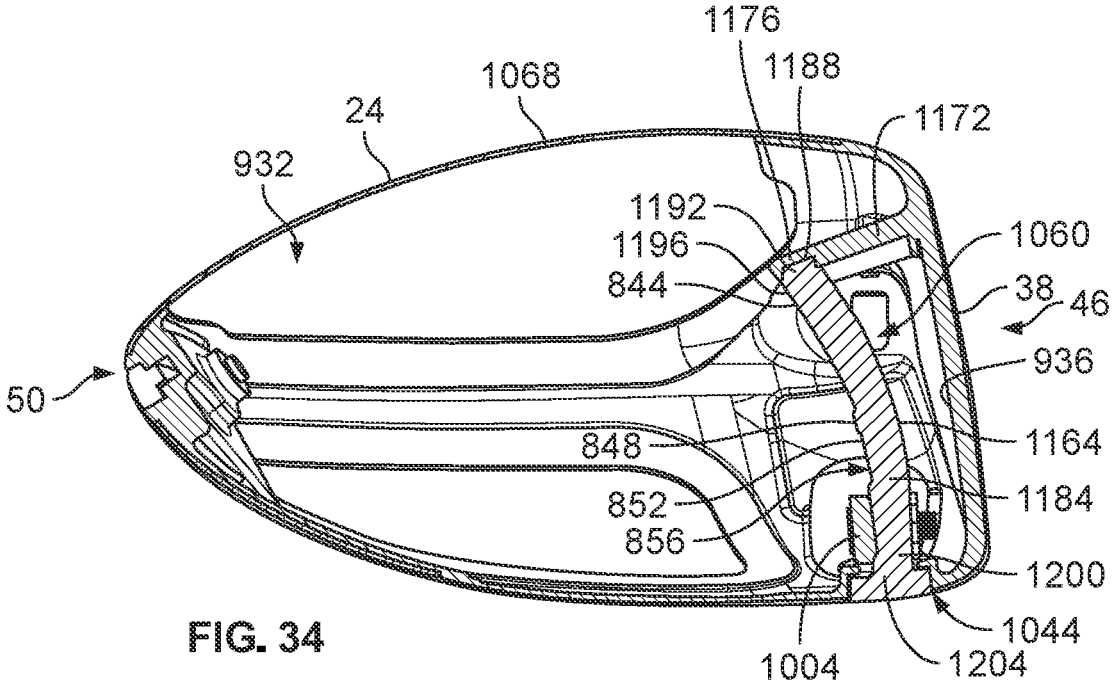
FIG. 34 illustrates a sectional view of the weighting system installed within the golf club head of FIG. 31.
Figure 35:
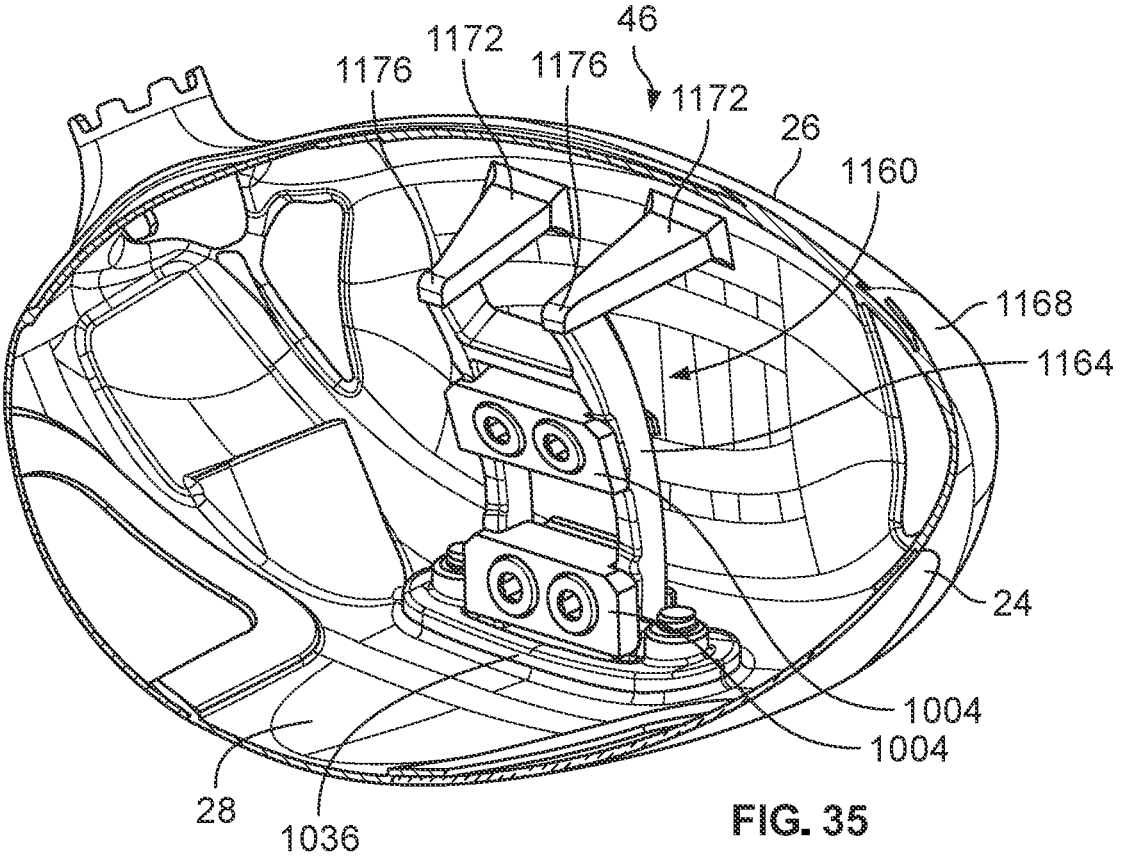
FIG. 35 illustrates a partial, cut-away view of the weighting system installed within the golf club head of FIG. 31, in which the weighting system is in a semi-loaded configuration.
Figure 36:
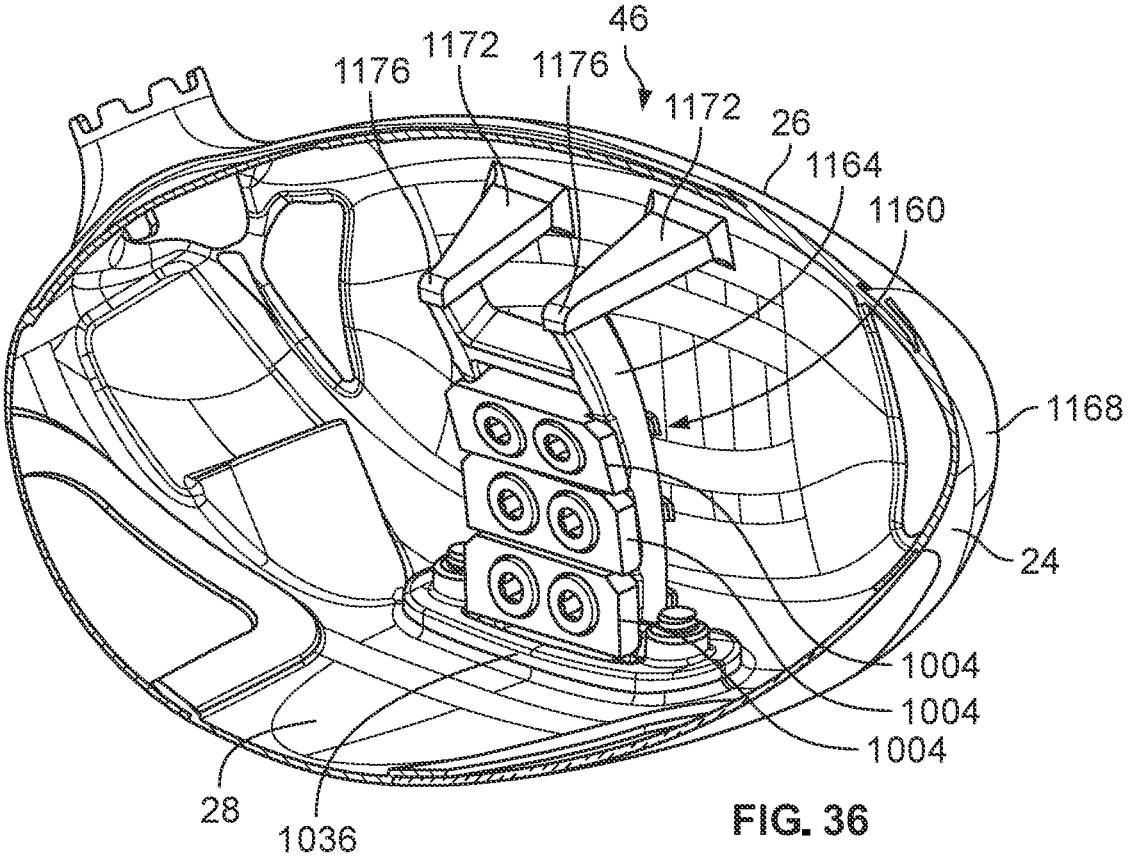
FIG. 36 illustrates a partial, cut-away view of the weighting system installed within the golf club head of FIG. 31, in which the weighting system is in a fully loaded configuration.

FIGS. 31-36 illustrate another embodiment of a weighting system 1160 including a cage 1164 in connection with a club head 1168. For purposes of clarity and brevity, like reference numerals will be used to indicate like elements, and the disclosure will focus on features and aspects of the cage 1164 and club head 1168 which differ from embodiments described above and shown in FIGS. 1-30. As depicted in FIG. 31, a pair of elongated hooks 1172 extend rearwardly from the rear surface 936 of the face 38 into the interior volume 932 of the club head 1168. The elongated hooks 1172 are disposed closer to the crown 26 of the club head 1168 than to the sole 28. The elongated hooks 1172 taper or narrow from the rear surface 936 to distal ends 1176 thereof. The cage 1164 includes first and second rails 1180, 1184 with the plurality of recesses 852 and the plurality of catches 848 arranged therealong. With reference to FIGS. 33 and 34, each of the elongated hooks 1172 includes a pocket 1188 that is configured to be receive upper mounting posts 1192 formed on upper ends 1196 of the first and second rails 1180, 1184 of the cage 1164. The elongated hooks 1172 extend downwardly at an angle relative to the rear surface 936 of the face 38. Further, the elongated hooks 1172 extend rearwardly from the face 38 to position the pockets 1188 a greater distance from the rear surface 936 than a distance between the rear surface 936 and the mounting holes 1032 formed in the sole 28 of the club head 1168. The first and second rails 1080, 1084 of the cage 1164 extend from a lower end 1200 at which a base 1204 is formed to the upper ends 1196. The first and second rails 1180, 1184 curve convexly relative to the rear surface 936 of the face 38, such that a highest position of the plurality of positions 856 locates the weight assembly 1004 farther from the face 38 than when the weight assembly 1004 is secured in a lowest position of the plurality of positions 856. As illustrated in FIG. 35, the cage 164 may be semi or partially loaded, such that less than all of the plurality of positions 856 are occupied by weight assemblies 1004. Alternatively, the cage 1164 may be fully loaded, such that all of the plurality of positions 856 are occupied by weight assemblies 1004, as depicted in FIG. 36.

Figure 37:
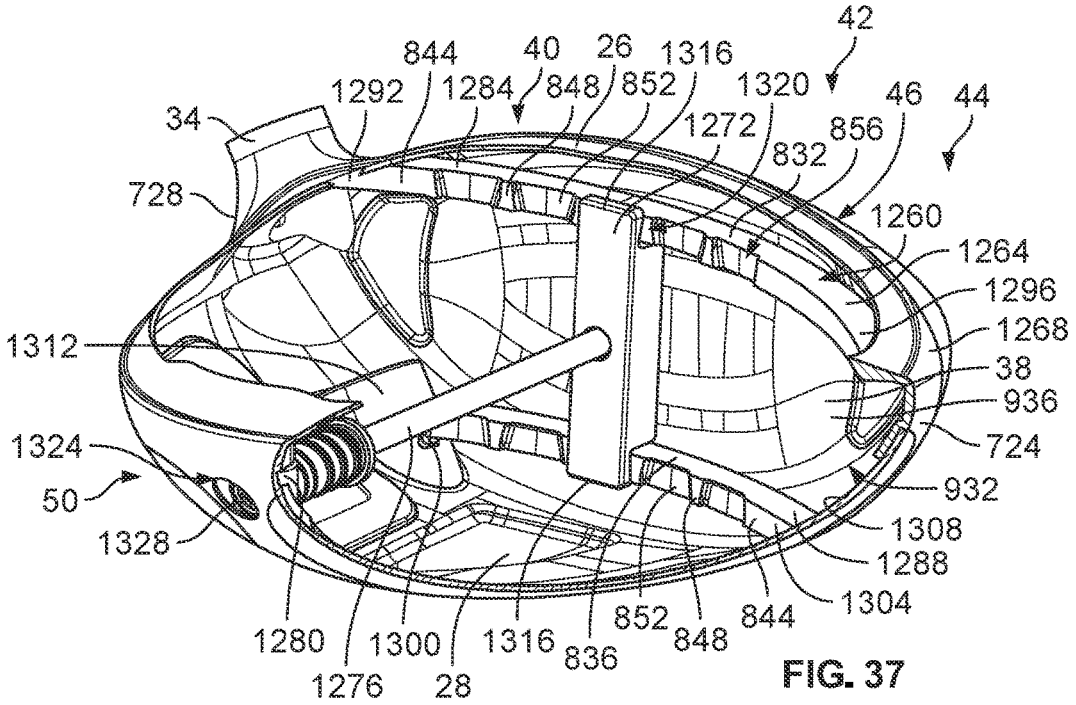
FIG. 37 illustrates a partial, cut-away view of another embodiment of a weighting system for a golf club head in accordance with the present disclosure.
Figure 38:
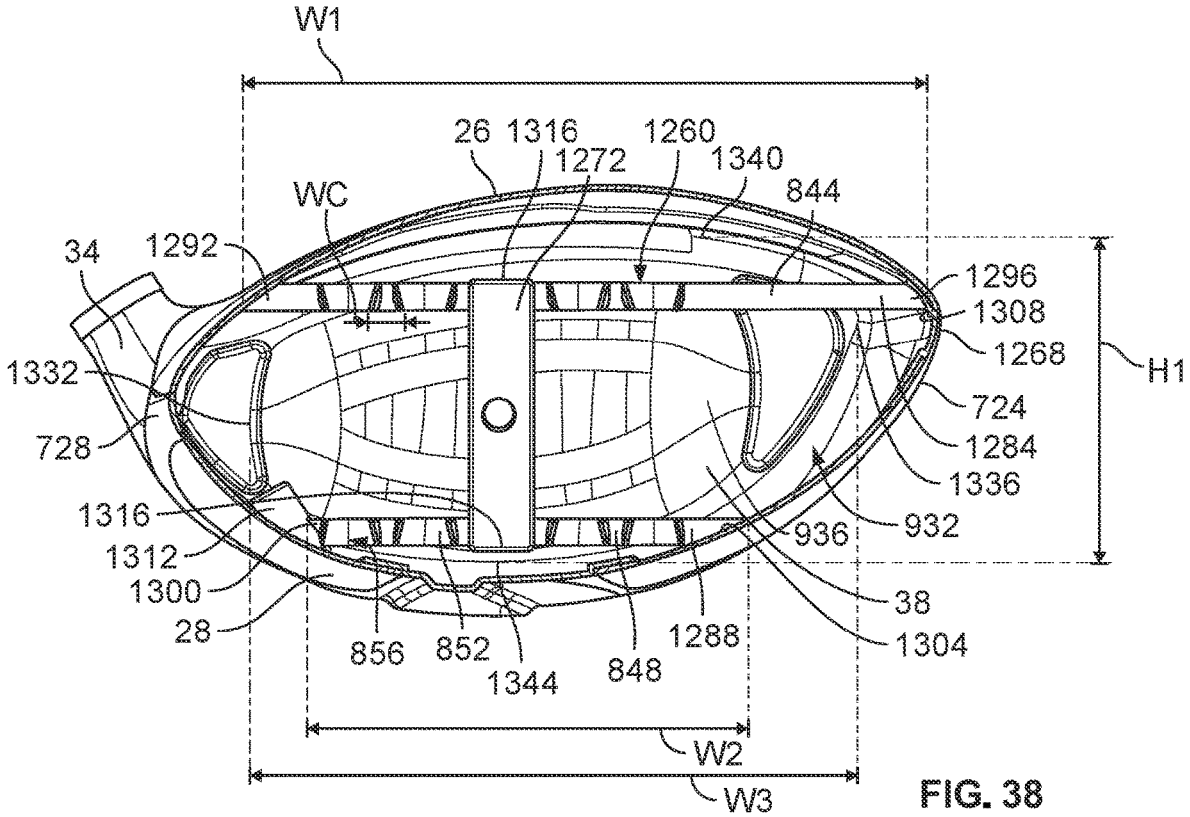
FIG. 38 illustrates a partial, cut-away view of the weighting system installed within the golf club head of FIG. 37.

FIGS. 37 and 38 illustrate another embodiment of a weighting system 1260 including a cage 1264 in connection with a club head 1268. For purposes of clarity and brevity, like reference numerals will be used to indicate like elements, and the disclosure will focus on features and aspects of the cage 1264 and club head 1268 which differ from embodiments described above and shown in FIGS. 1-36. Referring to FIG. 37, the weighting system 1260 is provided inside the interior volume 932 of the club head 1268 to permit adjustment of a weight component 1272, e.g., an elongated rectangular bar, between the toe side 724 and the heel side 728 of the club head 1268, e.g., in the H-T direction or lateral direction. The weighting system 1260 includes a shaft 1276 that couples the weight 1272 to a pivot housing 1280 for adjustment among the plurality of positions 856 arranged between the heel side 728 and the toe side 724 of the club head 1268. The weighting system 1260 includes first and second rails 1284, 1288 extending substantially parallel with one another and laterally across the interior volume 932 of the club head 1268. In the illustrated embodiment, the first and second rails 1284, 1288 are spaced apart from one another in a C-S direction.

Referring to FIGS. 37 and 38, the first rail 1284 extends between a first heel end 1292 and a first toe end 1296 to define a first width W1, the second rail 1288 extends between a second heel end 1300 and a second toe end 1304 to define a second width W2, and the first width W1 is greater than the second width W2. Both the first rail 1284 and the second rail 1288 extend in a curvilinear fashion, e.g., convexly relative to the rear surface 936 of the face 38, within the toe region 44 of the club head 1268. The first heel end 1292 of the first rail 1284 is coupled to an inner surface or interior surface 1308 of the club body 24 adjacent the crown 26 and the hosel 34 within the heel region 40. The first toe end 1296 of the first rail 1284 is coupled to the inner surface 1308 of the club body 24 adjacent the crown 26 in the toe region 44, which is opposite the first heel end 1292. The second heel end 1300 of the second rail 1288 is coupled to an internally protruding well structure 1312 that extends into the interior cavity 932 from the sole 28 in alignment with the hosel 34. The second toe end 1304 of the second rail 1288 is coupled to the inner surface 1308 of the club body 24 adjacent the sole 28 at the toe side 724, which is opposite the second heel end 1300. Both the first and second rails 1284, 1288 vary in a thickness dimension, e.g., in the F-R direction, therealong between the heel side 728 and the toe side 724. Further, each of the first and second rails 1284, 1288 includes the plurality of catches 848 and the plurality of recesses 852 arranged along the back side 844 and spaced apart from one another. The plurality of catches 848 and the plurality of recesses 852 of the first rail 1284 are vertically aligned with the plurality of catches 848 and the plurality of recesses 852 of the second rail 1288. Accordingly, the plurality of positions 856 are configured to receive the weight component 1272 mated to and extending between the first and second rails 1284, 1288.

Still referring to FIGS. 37 and 38, the weight component 1272 includes flanges 1316 that define notches 1320 which are sized and shaped to mate tightly within the plurality of recesses 852 formed on the first and second rails 1284, 1288. The plurality of catches 848 of the first and second rails 1284, 1288 have triangular profiles and vary in a width dimension WC, e.g., in the H-T direction, moving inwardly from the outer side 832 of each of the rails 1284, 1288 to the inner side 836 of each of the rails 1284, 1288. As such, the plurality of catches 848 are configured to retain the weight component 1272 in secured engagement and prevent dislodgement or displacement in multiple directions, e.g., lateral or vertical directions. As illustrated in FIG. 37, the pivot housing 1280 is configured to be accessible from a port 1324 formed through the club body 24 in the rear region 50. The port 1324 provides access to a set screw 1328 which, operates similarly to the pivot housing and set screw of FIGS. 7 and 8. However, the pivot housing 1280 and set screw 1328 are configured to provide lateral, side-to-side adjustment of the weight component 1272 within the club head 1268 between the heel side 728 and the toe side 724. Accordingly, the weight component 1272 can be adjusted to a heelward position or to a toeward position of the plurality of positions 856 to move the CG location of the club head 1268 toward the heel side 728, which may be advantageous for imparting side-spin to a golf ball (not shown) during impact.

It will be appreciated that the plurality of positions 856 are provided across at least 50% of a total width W3 of the face 38, as defined between a heel bound 1332 and a toe bound 1336 of the face 38 (see FIG. 38). In some embodiments, the plurality of positions 856 are provided across less than 50% of the total width W3 of the face 38, or across more than 80% of the total width W3 of the face 38. Accordingly, by locating the weight component 1272 adjacent and just rearward of the face 38 on the first and second rails 1284, 1288, within the front region 46, the CG location of the club head 1268 is positioned forwardly on the club head 1268. Additionally, by selectively adjusting the weight component 1272 among the plurality of positions 856 along the first and second rails 1284, 1288, the CG location can be moved heelward or toeward on the club head 1268. Accordingly, the weighting system 1260 of FIGS. 37 and 38 permits users to adjust the CG location of the club head 1268 to impart a desired side-spin to the golf ball (not shown) during impact. For example, the user can be provided with a tool, e.g., the tool 130, to operate the weighting system 1260 in accordance with the method of FIG. 8 for adjusting the weight component 1272 among the plurality of positions 856. Depending on the spacing and arrangement of the plurality of positions 856, the weighting system 1260 can provide adjustment of the CG location between the heel side 728 and the toe side 724 in increments defined relative to the total width W3 of the face 38 (see FIG. 38). In some embodiments, the weighting system 1260 provides for adjustment in increments of about 5%, or about 10%, or about 20%, or about 30%. In some embodiments, the weighting system 1260 provides for adjustment in increments of less than 5%. It will be appreciated that the increments provided by the weighting system 1260 may be within a range of between about 0.5 mm and about 3 mm, or between about 0.8 mm and about 2.5 mm, or between about 1 mm and about 2 mm. It will be appreciated that the magnitude of the increments is a function of, at least, the mass or weight of the weight component 1272, the mass ratio of the weight component 1272 as compared to the entire club head 1268, and the distance between plurality of positions 856 provided by the weighting system 1260. For example, a heavier weight component can cause greater incremental adjustment of the CG location as when a lighter weight component is moved the same distance.

Figure 39:
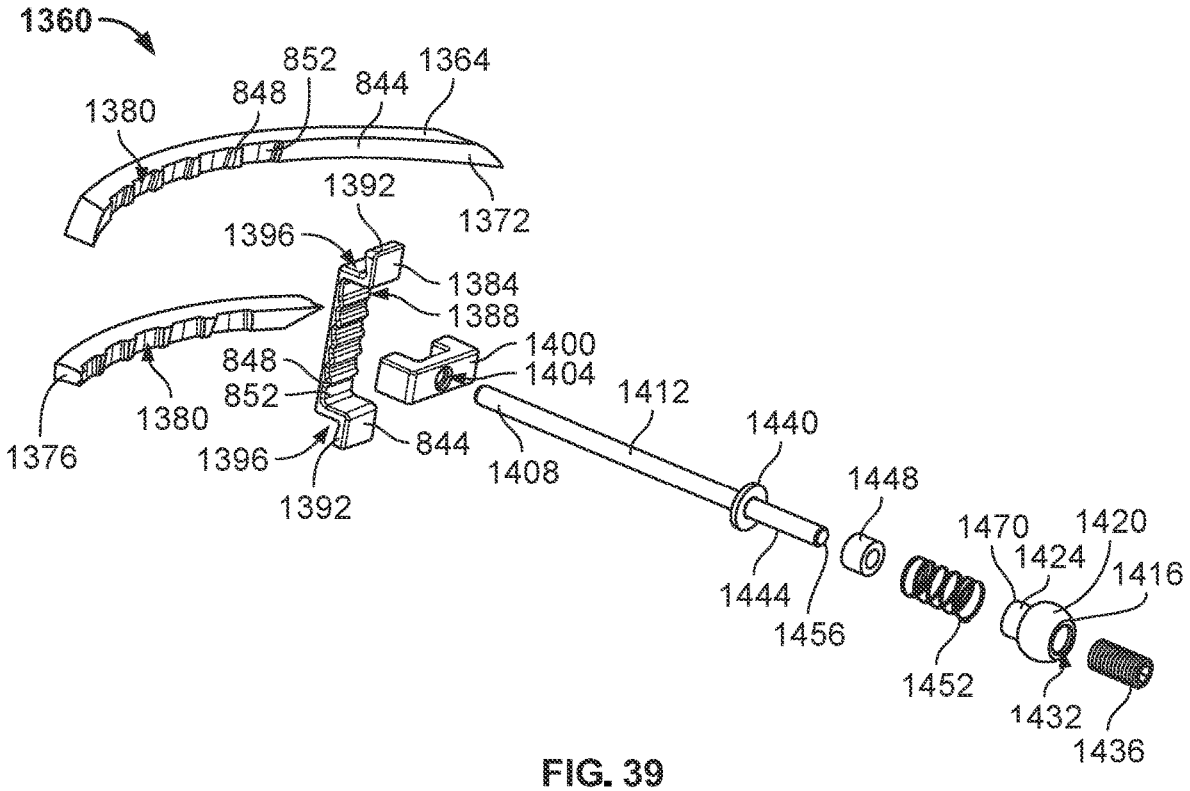
FIG. 39 illustrates an exploded view of another embodiment of a weighting system for a golf club head in accordance with the present disclosure.

FIGS. 39-42 illustrate another embodiment of a weighting system 1360 including a cage 1364 in connection with a club head 1368. For purposes of clarity and brevity, like reference numerals will be used to indicate like elements, and the disclosure will focus on features and aspects of the cage 1364 and club head 1368 which differ from embodiments described above and shown in FIGS. 1-38. As depicted in FIG. 39, the weighting system 1360 includes the cage 1364 having first and second rails 1372, 1376 that are configured to be similar to the first and second rails 1284, 1288 of the embodiment of FIGS. 37 and 38. Accordingly, the first and second rails 1372, 1376 are configured to provide for adjustment among a first plurality of positions 1380 arranged between the heel side 728 and the toe side 724 of the club head 1368 to impart varying degrees of side-spin to the golf ball (not shown) during impact. In addition, the weighting system 1360 of FIG. 39 includes a third rail 1384 that is configured to provide a second plurality of positions 1388 arranged in the vertical direction, e.g., the C-S direction, between the first and second rails 1372, 1376. The third rail 1384 is provided with flanges 1392 at opposing ends which form notches 1396 that are configured to be received by the plurality of recesses 852 defined among the plurality of catches 848 formed on the back side 844 of the first and second rails 1372, 1376. Accordingly, the third rail 1384 is configured to be removably coupled to the first and second rails 1372, 1376 among the first plurality of positions 1380 for adjustment of the CG location between the heel side 728 and the toe side 724 of the club head 1368. The third rail 1384 also includes the plurality of catches 848 and the plurality of recesses 852 arranged along the back side 844 thereof to provide the second plurality of positions 1388 in which a weight component 1400 can be selectively located for adjusting the CG location of the club head 1368 in the vertical direction, e.g., the C-S direction.

It will be appreciated that the third rail 1384 is provided to function as both a connection member for the weight component 1400 and also as an additional weight component, such that a mass of the third rail 1384 contributes to adjustment of the CG location in combination with the weight component 1400. It is contemplated that the mass of the third rail 1384 may be different than a mass of the weight component 1400. In some embodiments, the mass of the third rail 1384 is greater than the mass of the weight component 1400. In some embodiments, the mass of the third rail 1384 is smaller than the mass of the weight component 1400. For example, the mass of the third rail 1384 may be about 50% or about 60% or about 70% of the mass of the weight component 1400. In some instances, the mass of the third rail 1384 and the mass of the weight component 1400 are selected so that adjustment of the weight component 1400 has a proportional incremental impact on the CG location to adjustment of the third rail 1384. In some embodiments, the mass of the third rail 1384 is equal to the mass of the weight component 1400.

Still referring to FIG. 39, the weight component 1400 is provided as "U-shaped" member with a threaded mounting hole 1404 that is configured to be engaged with a distal end 1408 of a shaft 1412. The shaft 1412 extends across the club head 1368 within the interior cavity 932 to couple the weight component 1400 to a pivot housing 1416 that is configured to permit displacement, e.g., rotation, of the weight component 1400 in at least vertical and lateral directions. To that end, the pivot housing 1416 is provided in the form of a spherical or ball-shaped housing having a conical, smooth exterior surface 1420 and a cylindrical flange 1424 extending outwardly therefrom. The pivot housing 1416 is configured to be received within a socket 1428 (see FIG. 46) formed on the inner surface 1308 within the cub head 1368. The socket 1428 is configured to engage the smooth, exterior surface 1420 for allowing the pivot housing 1416 to freely rotate and/or tilt therein while retaining the pivot housing 1416 in connection with the club head 1368. The pivot housing 1416 further includes a threaded bore 1432 that is axially aligned with the flange 1424 and in which a set screw 1436 is configured to be received. The shaft 1412 further includes a seating flange 1440 disposed on the shaft 1412 and interposed between the distal end 1408 and a proximal end 1444 that receives a collar 1448 and a spring 1452 thereon. The collar 1448 is an annular member configured to abut the seating flange 1440 and the spring 1452 is provided in the form of a helical component that fits over the collar 1448 and abuts the seating flange 1440 when inserted onto the proximal end 1444 of the shaft 1412. The set screw 1436 includes a shaft receptacle (not shown) in which a tip 1456 of the proximal end 1444 of the shaft 1412 is received when the set screw 1436 is threaded into the bore 1432 of the pivot housing 1416. The spring 1452 is also engaged by an outwardly protruding lip 1470 formed on the cylindrical flange 1424 to retain the spring 1452 on the pivot housing 1416 when assembled (see FIG. 46).

Figure 40:
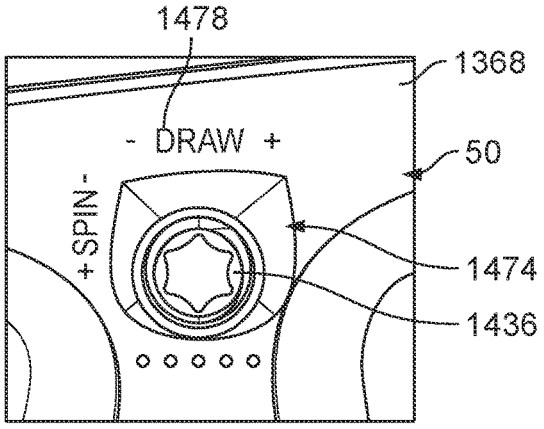
FIG. 40 illustrates a partial view of a control port in a rear region of a golf club head in accordance with the present disclosure.
Figure 41:
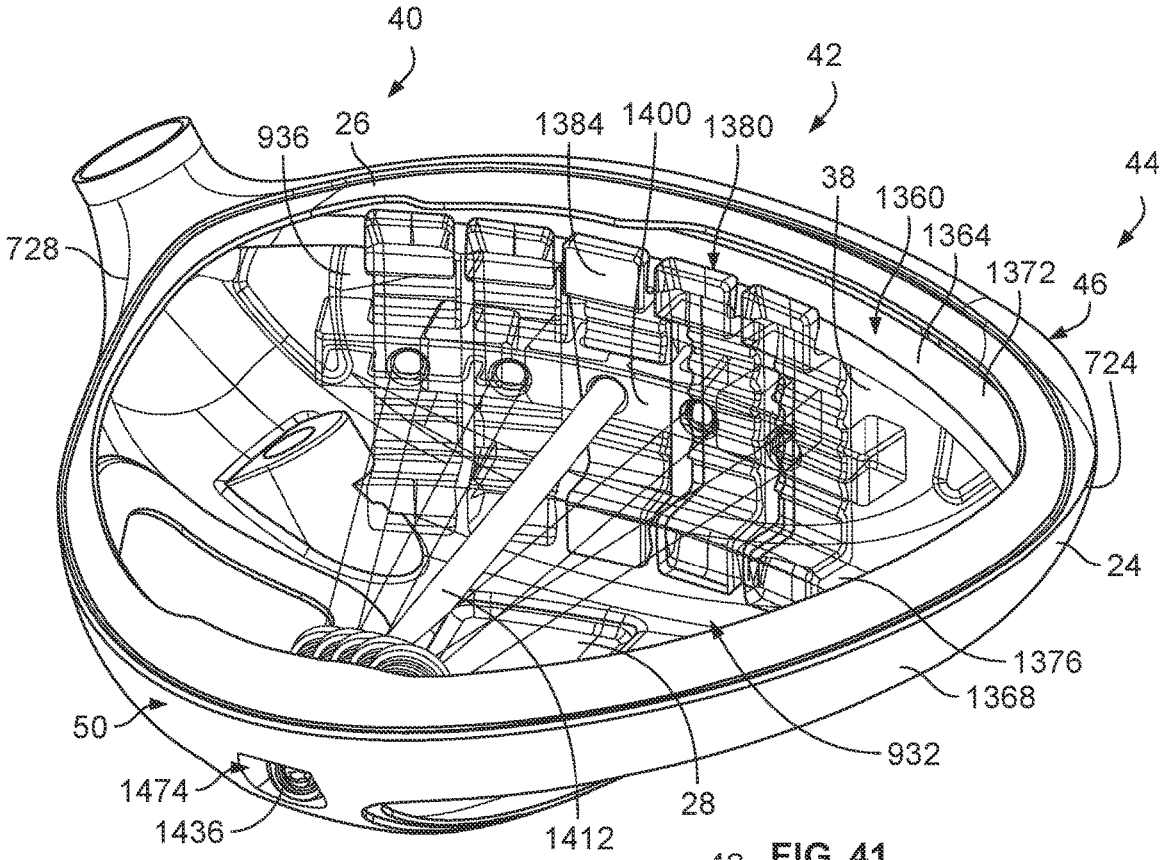
FIG. 41 illustrates a schematic representation of the weighting system of FIG. 38 installed within a golf club head in various engagement positions spanning a first direction.
Figure 42:
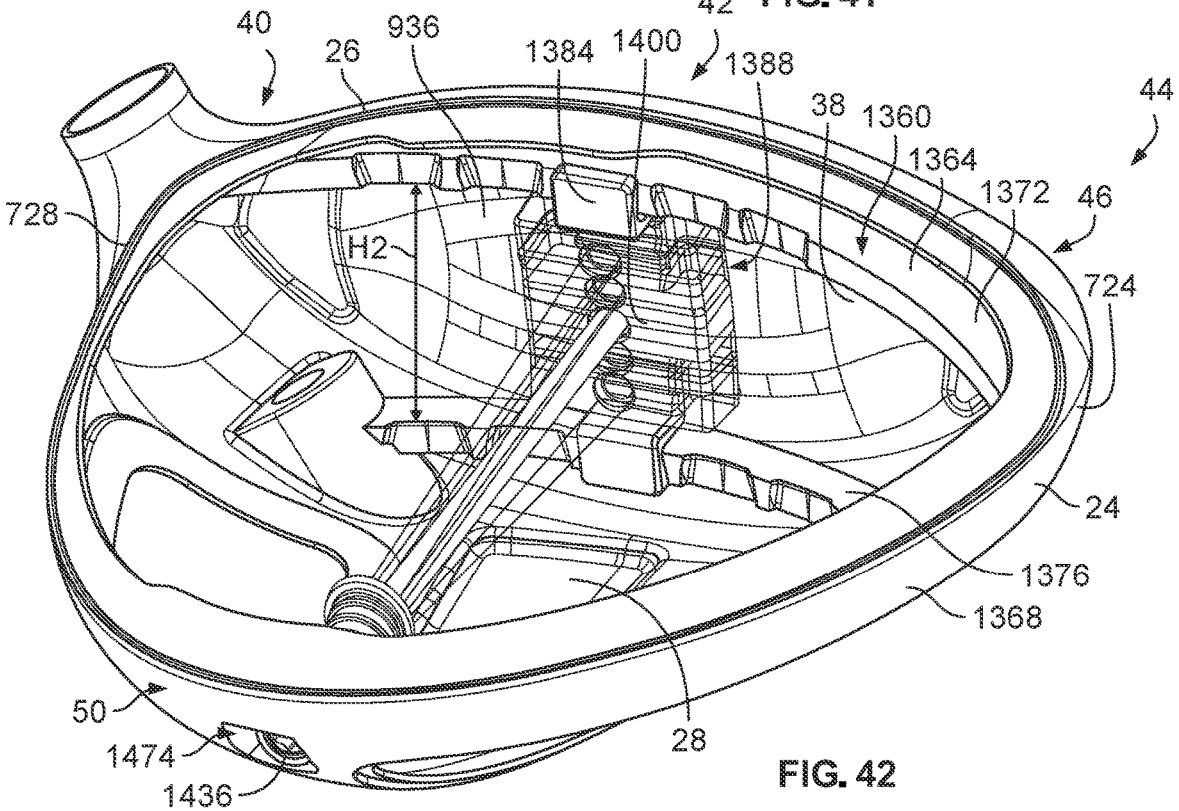
FIG. 42 illustrates a schematic representation of the weighting system of FIG. 38 installed within the golf club head in various engagement positions spanning a second direction.

Turning to FIG. 40, the set screw 1436 is provided within a port 1474 formed in the club head 1368. The port 1474 may be surrounded by markings or indicia 1478 corresponding to the various adjustment provided by the weighting system 1360. For example, the markings 1478 may correspond to incremental adjustments to the CG location of the club head 1368 in the vertical direction, the horizontal direction, or both. The markings 1478 may be provided to indicate levels or magnitudes of sidespin or backspin that can be imparted to the golf ball (not shown) during impact based on the adjustment of the weighting system 1360. The markings 1478 may be provided in the form of computer-readable markings or symbols which are readably by, e.g., scanners, readers, mobile devices, or the like. The markings 1478 may be provided in the form of alphanumeric symbols, mathematical symbols, or the like for human comprehension without the aid of an electronic device.

Accordingly, by tightening the set screw 1436 into the bore 1432 of the pivot housing 1416, the shaft 1412 is urged toward the face 38, thereby compressing the spring 1452 between the pivot housing 1416 and the seating flange 1440. In this way, the weight component 1400 at the distal end 1408 of the shaft 1412 is moved toward the face 38 and into engagement with the third rail 1384 that is, simultaneously, moved toward the face 38 and into engagement with the first and second rails 1372, 1376. By further tightening the set screw 1436, a compression force is applied to press the weight component 1400 against the third rail 1384 and to press the third rail 1384 against the first and second rails 1372, 1376, thereby securing the weighting system 1360 against displacement and dislodgment during impact with the golf ball (not shown).

When the set screw 1436 is loosened, the compression force is reduced to a default amount exerted by the spring 1452. The default amount of compression force is tuned to allow adjustment of the weight component 1400 among the second plurality of positions 1388 on the third rail 1384 (see FIG. 42), such that movement of the weight component 1400 over the plurality of catches 848 overcomes the default force enough to cause displacement of the shaft 1412 rearwardly to compress the spring 1452 until the weight component 1400 is aligned and received within the desired position of the plurality of positions 1388 formed by the plurality of recesses 852, such that the default amount of compression force causes the weight component 1400 to snap or click into the desired position. The snap or click generated by movement of the weight component 1400 into the recess 852 and against the back side of the third rail 1384 may provide a user with audible verification of proper placement. Similarly, the default amount of compression force is tuned to allow adjustment of the third rail 1384 among the first plurality of positions 1380 along the first and second rails 1372, 1376. Accordingly, movement of the third rail 1384 over the plurality of catches 848 overcomes the default force enough to cause displacement of the shaft 1412 rearwardly to compress the spring 1452 until the third rail 1384 is aligned and received within the desired position of the first plurality of positions 1380 formed by the plurality of recesses 852 (see FIG. 41), such that the default amount of compression force causes the third rail 1384 to snap or click into the desired position, which may provide for audible verification of proper placement.

Accordingly, the weighting system 1360 is configured to permit adjustment of the weight component 1400 among the first plurality of positions 1380 via the third rail 1384 and among the second plurality of positions 1388 along the third rail 1384. As such, the weighting system 1360 allows for the CG location of the club head 1368 to be adjusted in the vertical, C-S direction (see FIG. 42) and the lateral, H-T direction (see FIG. 41). The second plurality of positions 1388 provided on the third rail 1384 are arranged between a total height H1 of the face 38, as defined between the upper bound 1340 and the lower bound 1344 of the face 38 (see FIG. 38). The second plurality of positions 1388 are configured for adjustment of the weight component 1400 across at least 50% of the total height H1 of the face 38, or at least 60% of the total height H1 of the face 38, or at least 70% of the total height H1 of the face 38. Further the second plurality of positions 1388 arranged along the back side 844 of the third rail 1384 are provided in increments, which may be defined in relation to the total height H1 of the face 38. In some embodiments, the increments may be about 5% of the total height H1 of the face 38, or about 10%, or about 20%, or about 30% or about 40% of the total height H1 of the face 38. In some embodiments, the increments may be less than 5% of the total height H1 of the face 38, such that the weighting system 1360 allows for fine adjustment of the weight component 1400 in the vertical direction. Adjustment of the weight component 1400 among the second plurality of positions 1388 on the third rail 1384 is determined in part by the spacing of the first and second rails 1372, 1376 from one another. A distance H2 is defined between the inner sides 836 of the first and second rails 1372, 1376, and that distance H2 represents the maximum amount of vertical displacement available for the weight component 1400 in the illustrated embodiment of the weighting system 1360. In some embodiments, the weighting system 1360 may be configured to permit maximum vertical displacement of the weight component 1400 that exceeds the distance H2 between the first rail 1372 and the second rail 1376.

Further, the golf club head 1368 is provided with the adjustable weight component 1400 that is configured to be adjusted by engaging the shaft 1412, the spring 1452, and the set screw 1436 for manipulation of the CG location. The weighting system 1360 is provided to permit articulation of the shaft 1412 and the weight component 1400 within the club head 1368 via the set screw 1436 at the port 1474 on the exterior of the club head 1368. The weight component 1400 is further configured to be adjusted via the port 1474 at the rear region 50 of the club head 1368 by rotation and tilting of the set screw 1436 and the shaft 1412. It is contemplated that the shaft 1412 can be rotated via the pivot housing 1416 at the rear region 50 of the club head 1368 to adjust the CG location in at least one of the vertical direction, i.e., C-S direction, the lateral direction, i.e., the H-T direction, or the longitudinal direction, i.e., the F-R direction. It is further contemplated that because of the "U-shaped" design of the weight component 1400, as well as the elongated shape of the third rail 1384, rotation thereof about a longitudinal axis (not shown) defines along the shaft 1412 degrees may further adjust the CG location by repositioning the specific CG of the weight component 1400 and/or the third rail 1384 relative to the sole 28, crown 26, and face 38. In other words, due to the non-spherical or conical shape of the weight component 1400 and third rail 1384, rotation about the shaft 1412 via the pivot housing 1416 can further adjust the CG location of the club head 1368.

Figure 43:
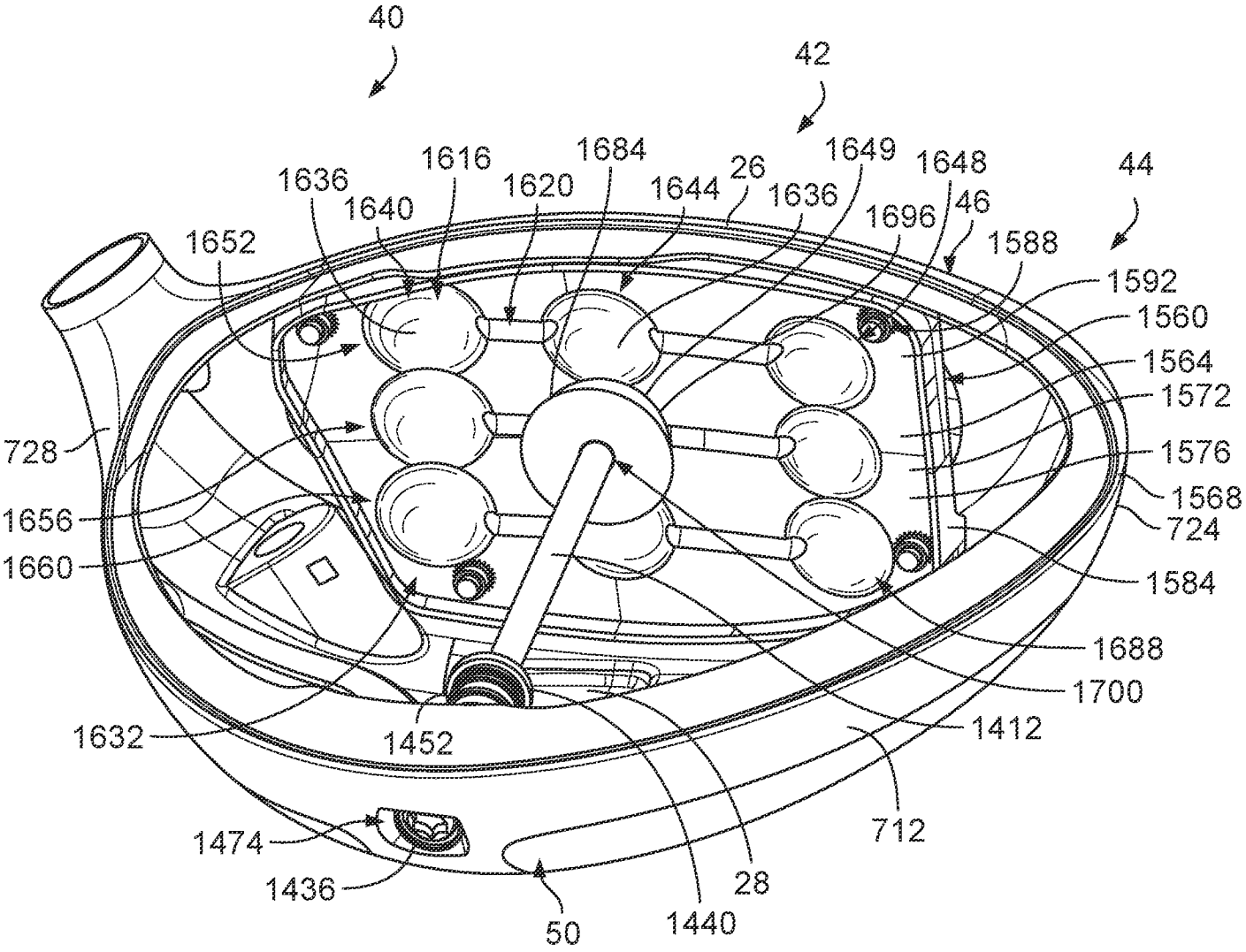
FIG. 43 illustrates a partial, perspective view of another embodiment of a weighting system for a golf club head in accordance with the present disclosure.

FIGS. 43-49 illustrate another embodiment of a weighting system 1560 including a cage 1564 in connection with a club head 1568. For purposes of clarity and brevity, like reference numerals will be used to indicate like elements, and the disclosure will focus on features and aspects of the cage 1564 and club head 1568 which differ from embodiments described above and shown in FIGS. 1-42. As depicted in FIG. 43, the weighting system 1560 includes the cage 1564 in the form of a panel 1572 that includes a back side 1576, a front side 1580 opposite the back side 1576 and configured to face the rear surface 936 of the face 38, and a perimeter wall 1584 extending about the panel 1572. In the illustrated embodiment, the perimeter wall 1584 extends in a direction away from the front side 1580, e.g., rearwardly, although other configurations are possible. The panel 1572 comprises a plurality of openings 1588 located at corners 1592 thereof for connection to the club head 1568, as will be described herein.

Referring to FIG. 43, a raised or thickened area 1596 is formed on the front side 1580 at each corner 1592 of the panel 1572, which provides increased strength and resilience for connection to the club head 1568. In addition, the panel 1572 includes a top edge 1600 that bows or curves between corners 1592, a heel side edge 1604 that is extends substantially linearly at an angle between two corners 1592, a bottom edge 1608 that bows or curves between two corners 1592, and a toe side edge 1612 that extends substantially linearly at an angle between two corners 1592. The top edge 1600 and the bottom edge 1608 both curve or bow outwardly relative to one another, such that the top edge 1600 is concavely curved between the corners 1592 relative to the bottom edge 1608 and such that the bottom edge 1608 is concavely curved between the corners 1592 relative to the top edge 1600. It will be appreciated that the curvatures of the top edge 1600 and the bottom edge 1608 are configured to conform or complement the curvatures and shape of the club head 1568. In a similar fashion, the heel side edge 1604 of the panel 1572 extends from the bottom edge 1608 to the top edge 1600 substantially obliquely away from the toe side edge 1612, with exception to a slanted edge portion 1614 of the heel side edge 1604 that interrupts the heel side edge 1604 at the corner 1592 to form an inflection point 1615. In this way, the panel 1572 is configured to be shaped to fit within the club head 1568 without contacting the inner surface 1308 in the interior cavity 932. In some embodiments, one or more of the edges 1600, 1604, 1608, 1612 may be extended to abut or contact the inner surface 1308 of the club head 1568.

Figure 44:
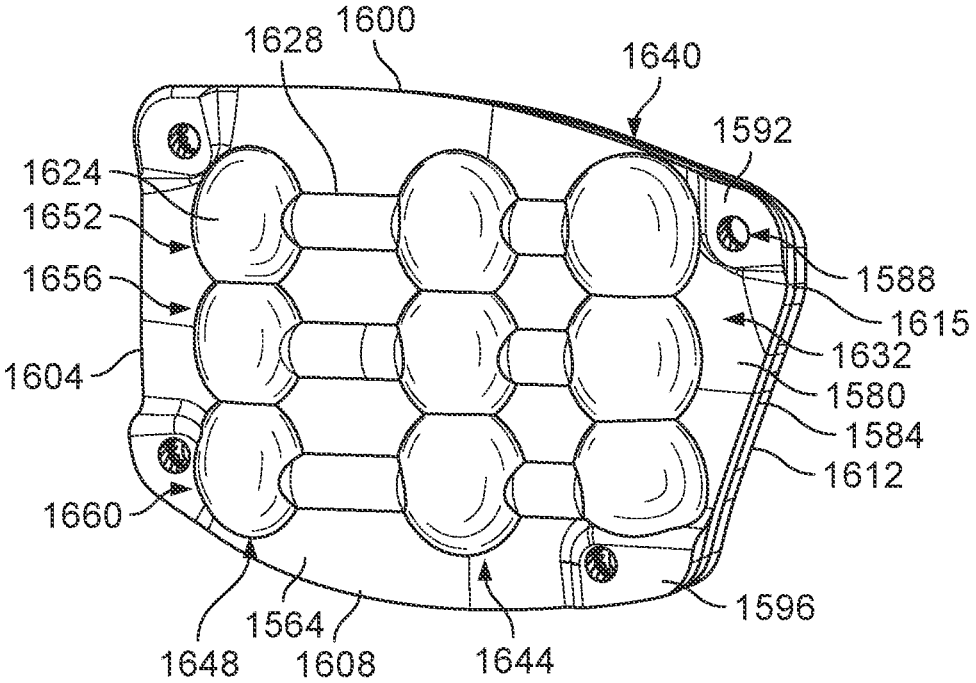
FIG. 44 illustrates a perspective view of a front side of a panel of the weighting system of FIG. 43.
Figure 45:
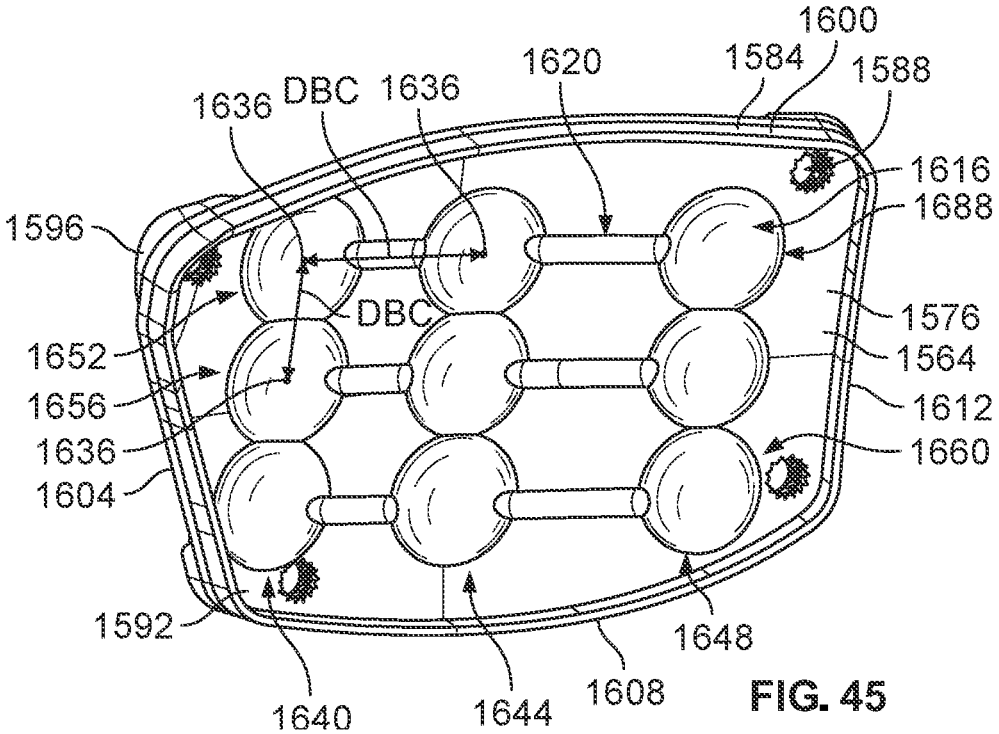
FIG. 45 illustrates a perspective view of a back side of the panel of FIG. 44.

Referring to FIGS. 44 and 45, the panel 1572 includes a plurality of recesses 1616 and a plurality of slots 1620 formed along the back side 1576. The plurality of recesses 1616 are provided as curved, hemi-spherical voids depressed into the back side 1576 and, as a result, form corresponding projections 1624 on the front side 1580 of the panel 1572 (see FIG. 44). Similarly, the plurality of slots 1620 are provided as curved, elongated channels that extend between and interconnect immediately adjacent recesses 1616. The plurality of slots 1620 form corresponding ribs 1628 on the front side 1580 of the panel 1572 that span between and interconnect immediately adjacent projections 1624 (see FIG. 44). The panel 1572 may have a uniform thickness TP, e.g., measured in the F-R direction, between the front side 1580 and the back side 1576, such that a depth DR of each recess 1616 equates to an extent ER of each corresponding projection 1624 on the front side 1580 of the panel 1572. In some embodiments, a depth of each slot 1620 on the back side 1576 equates to an extent of each corresponding rib 1628 on the front side 1580 of the panel 1572. In some embodiments, the panel 1572 varies in thickness, such that the depths of the recesses 1616 and slots 1620 does not equate to the extents of the corresponding projections 1624 and ribs 1628. In the illustrated embodiment, and with reference to a representative recess 1616 and a representative slot 1620, the depth of the recess 1616 is greater than the depth of the slot 1620. In some embodiments, the depth of the recess 1616 is equal to or smaller than the depth of the slot 1620.

In the illustrated embodiment, the plurality of recesses 1616 are provided in an M×N grid pattern 1632, where M represents rows and is equal to three, and where N represents columns and is equal to three. The grid pattern 1632 is offset or asymmetrical such that a distance DBC between centers 1636 of adjacent recesses 1616 is not uniform. A first column 1640 is arranged closest to the heel side edge 1604 of the panel 1572 and a second column 1644 is disposed DBC between the first column 1640 and a third column 1648 that is disposed closest the toe edge 1612 of the panel 1572. A first row 1652 is arranged closest to the top edge 1600 of the panel 1572 and a second row 1656 is disposed between the first row 1652 and a third row 1660 that is disposed closest to the bottom edge 1608 of the panel 1572. The distance DBC between centers 1636 of the recesses 1616 varies across the grid pattern 1632, such that the first column 1640 is spaced apart from the second column 1644 a different distance DBC, e.g., a smaller distance, than a distance DBC between the second column 1644 and the third column 1648. In other words, the first column 1640, the second column 1644, and the third column 1648 may be spaced apart unequal distances from one another. Likewise, the first row 1662, the second row 1656, and the third row 1660 may be spaced apart unequal distances from one another. In some embodiments, the first, second, and third columns 1640, 1644, 1648 may be spaced apart equal distances from one another. In some embodiments, the first, second, and third rows 1652, 1656, 1660 may be spaced apart equal distances from one another. It will be appreciated that the grid pattern 1632 may include any number of rows or columns. In some embodiments, the grid pattern 1632 has a number of rows that is different from the number of columns.

Referring back to FIG. 43, the weighting system 1560 includes the shaft 1412, pivot housing 1416, spring 1452, and set screw 1436 for adjustment of a weight component 1684 among a plurality of positions 1688 provided by the panel 1572. The plurality of positions 1688 correspond to the plurality of recesses 1616 and the grid pattern 1632 discussed above. The weight component 1684 is configured, e.g., sized and shaped, to be received within the recesses 1616 of the panel 1572 and, further, to slide along the slots 1620 of the panel 1572 during adjustment. To that end, the weight component 1684 includes a hemi-spherical surface 1692 that is configured to contact the back side 1576 of the panel 1572 when assembled. The weight component 1684 further includes a planar back 1696 on which an aperture 1700 is located centrally to receive the distal end 1408 of the shaft 1412. The weight component 1684 may be engaged with the shaft 1412 using any suitable connection method, such as, e.g., threading, fastening, welding, molding, or the like.

Figure 46:
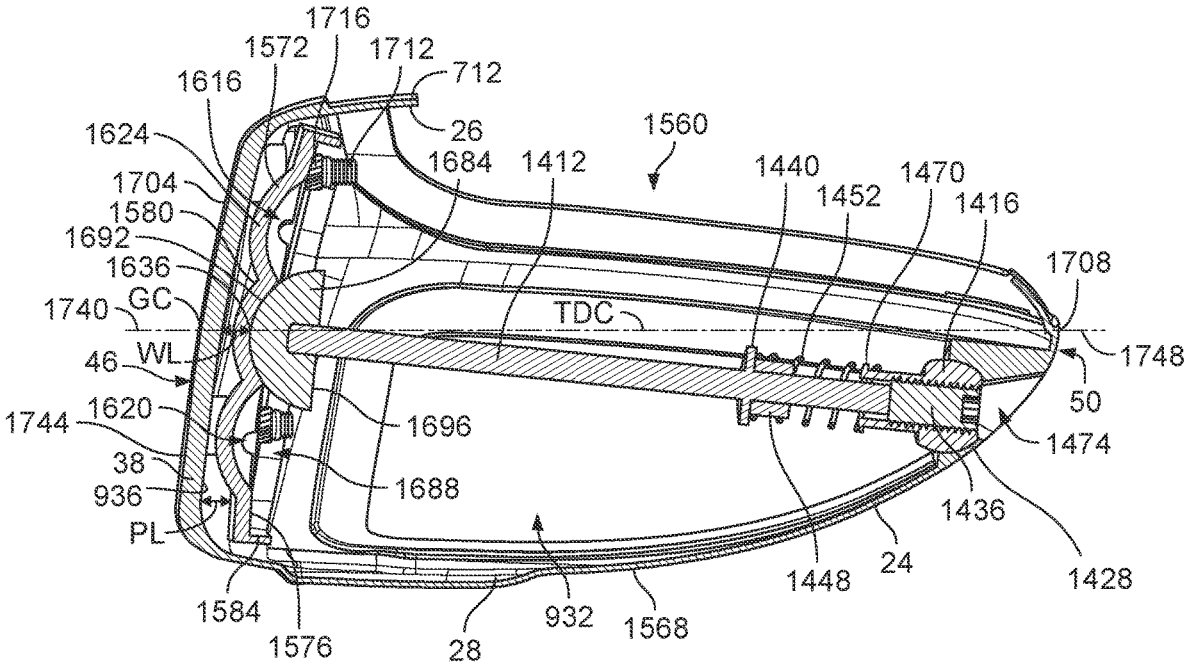
FIG. 46 illustrates a partial, sectional view of the weighting system installed within the golf club head of FIG. 43, in which a weight component is located in a neutral position along a neutral axis.

With reference to FIG. 46, the panel 1572 is located just behind the rear surface 936 of the face 38 when installed within the interior cavity 932 of the club head 1568. In the illustrated embodiment, a distance WL between the weight component 1684 and the rear surface 936 of face 38 is comparatively small, so as to be adjacent. In some embodiments, the distance WL between the weight component 1684 and the rear surface 936 of the face 38 can be understood in relation to a distance TCD between a geometric center GC of a front surface or striking surface 1704 of the face 38 and the rearmost point 1708 of the club head 1568. The WL may be less than about 5% of the TCD, or less than about 4% of the TCD, or less than about 3% of the TCD, or less than about 2% of the TCD. In some embodiments, the WL may be greater than about 5% of the TCD. In some embodiments, the WL is between about 5% and about 10% of the TCD. It will be appreciated that the WL may be adjustable by relocating the weight component 1684 among the plurality of positions 1688 along the panel 1572 to be within a range of between about 1% to about 5% of the TCD. In a similar manner, a distance between the front side 1580 of the panel 1572 and the rear surface 936 of the face 38 is about 4 mm, or about 3 mm, or about 2 mm, or about 1 mm, or about 0.5 mm, or about 0.4 mm, or about 0.3 mm, or about 0.2 mm, or about 0.1 mm. Accordingly, the distance PL between the panel 1572 and the rear surface 936 is between about 1% and about 10%.

Figure 47:
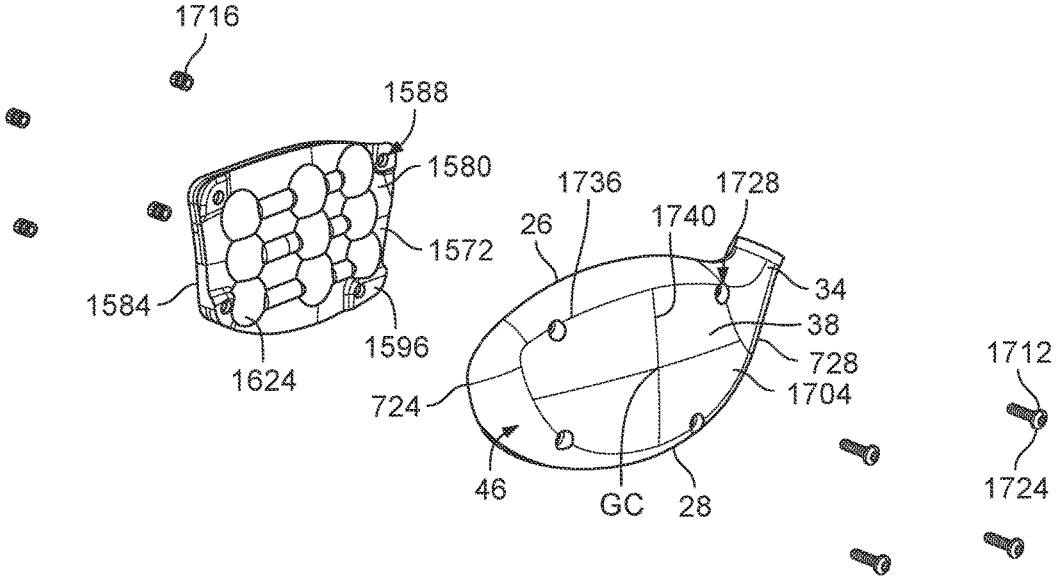
FIG. 47 illustrates a partial, exploded view of a front side of the golf club head and weighting system of FIG. 43.
Figure 48:
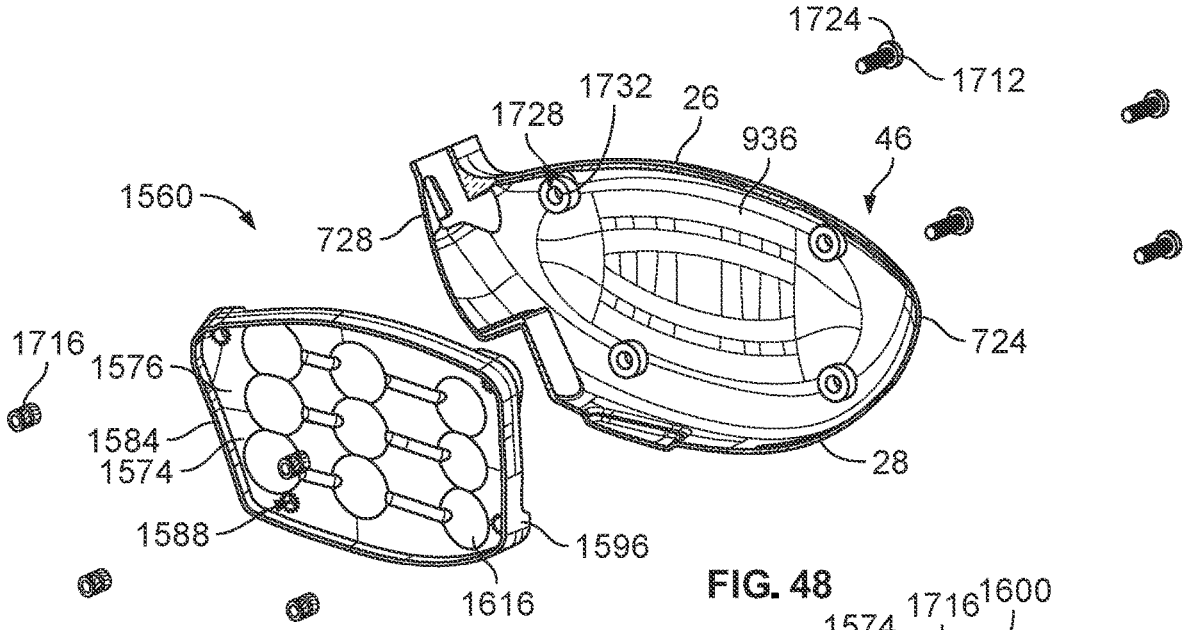
FIG. 48 illustrates a partial, exploded view of a back side of the golf club head and weighting system of FIG. 43.
Figure 49:
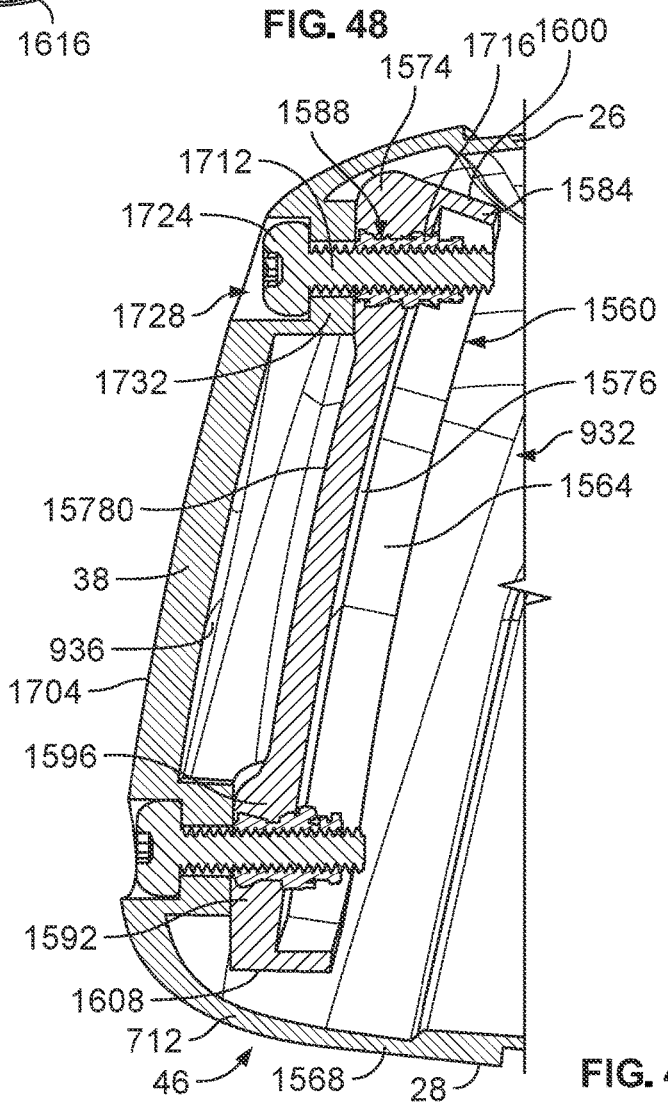
FIG. 49 illustrates a partial, sectional view of the weighting system installed within the golf clubhead of FIG. 43.

As illustrated in FIG. 46-49, the panel 1572 is attached to the face 38 using fasteners 1712. In the illustrated embodiment, threaded sleeves 1716 are provided within the openings 1588 of the panel 1572 to removably receive the fasteners 1712 in threading engagement. In some instances, the threaded sleeves 1716 are coupled to the panel 1572 within the openings 1588 using any suitable manufacturing technique, such as, e.g., bonding or adhering, interference or deformation fits, or the like. In some embodiments, the threaded sleeves 1716 are integrally provided as part of the panel 1572 using any suitable technique, such as, e.g., molding or overmolding or co-molding, 3D printing, welding, fusing, or the like. The fasteners 1712 include a head 1724 that is received within a mounting bore 1728 formed in the face 38, such that the head 1724 of the fastener 1712 is recessed from the front surface 1704 and located entirely within the mounting bore 1728. To that end, the face 38 may be provided with a mounting flange 1732 that protrudes from the rear surface 936 and away from the front surface 1704 of the face 38, e.g., in the rearward direction. The mounting flanges 1732 may be threaded or unthreaded, and the raised areas 1596 of the corners 1592 on the front side 1580 of the panel 1572 may be configured to contact or abut the mounting flanges 1732 of the face 38 when the panel 1572 is installed in the club head 1568. As illustrated in FIGS. 47 and 48, the mounting holes 1728 and mounting flanges 1732 are located along or near a perimeter 1736 of the face 38 to be spaced apart from one another and spaced apart from the geometric center GC of the face 38. In this way, the mounting holes 1728 and mounting flanges 1732 are distanced from the frequent or optimal impact location of the face 38, e.g., the "sweet spot," to avoid dampening or reducing the flexibility of the face 38 that is associated with desirable performance, e.g., feel, sound, spin, and shot distance.

With reference to FIG. 46, a neutral axis 1740 is defined through the geometric center GC of the face 38 and perpendicular to a face plane 1744 that is coplanar with and tangent to the front surface of the face 38. The weight component 1684 is illustrated as being received within the recess 1616 located in the second row 1656 and the second column 1644 of the face plane 1744, such that the weight component 1684 is in a neutral position NP and intersected by the neutral axis 1740. Adjusting the weight component 1684 above or below the neutral axis 1740 varies the CG location of the club head 1568 relative to the neutral axis 1740. Further, a neutral plane 1748 is defined through the neutral axis 1740 and extends in the C-S direction through the sole 28 and the crown 26 of the club head 1568. As illustrated in FIG. 43, the weight component 1684 is positioned in the neutral position NP and intersected by the neutral plane 1748. Adjusting the weight component 1684 toeward or heelward of the neutral plane 1748 varies the CG location of the club head 1568 relative to the neutral plane 1748.

Figure 50:
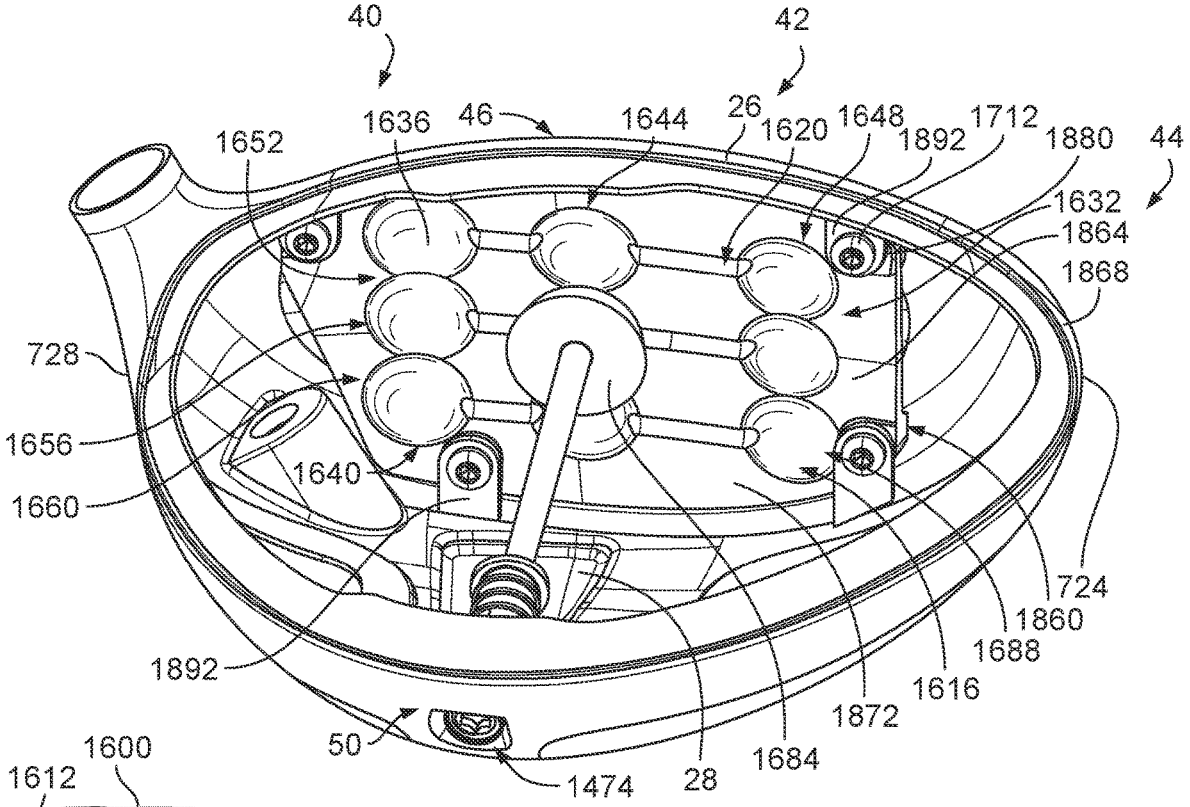
FIG. 50 illustrates a partial, perspective view of another embodiment of a weighting system for a golf club head in accordance with the present disclosure.
Figure 51:
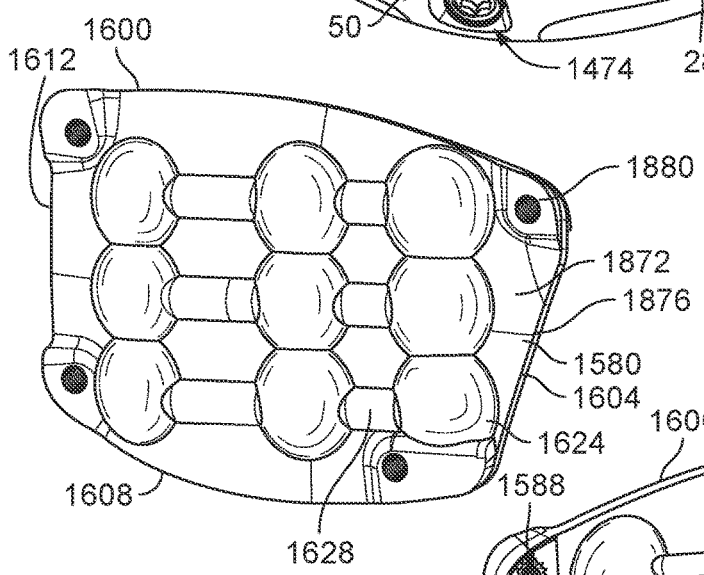
FIG. 51 illustrates a perspective view of a front side of a panel of the weighting system of FIG. 50.
Figure 52:
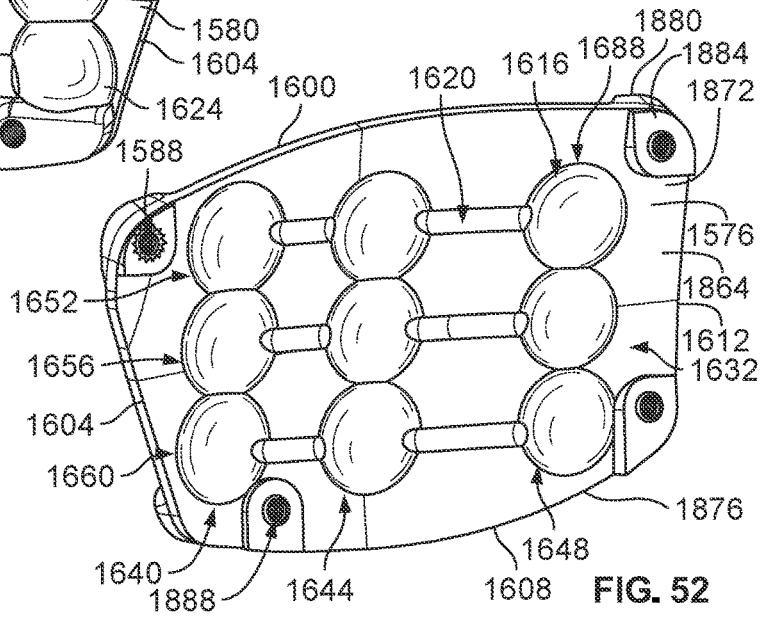
FIG. 52 illustrates a perspective view of a back side of the panel of FIG. 51.

FIGS. 50-54 illustrate another embodiment of a weighting system 1860 including a cage 1864 in connection with a club head 1868. For purposes of clarity and brevity, like reference numerals will be used to indicate like elements, and the disclosure will focus on features and aspects of the cage 1864 and club head 1868 which differ from embodiments described above and shown in FIGS. 1-49. As depicted in FIG. 50, the cage 1864 of the weighting system 1860 includes a panel 1872 that has the plurality of recesses 1616 and the plurality of slots 1620 on the back side 1576. The plurality of recesses 1616 are formed in the panel 1872 as curved, hemi-spherical depressed areas that form the plurality of corresponding projections 1624 on the front side 1580 of the panel 1872. Further, the plurality of slots 1620 are formed on the back side 1576 of the panel 1872 as curved, elongated depressed areas that form the plurality of corresponding ribs 1628 on the front side 1580. The slots 1620 interconnect adjacent recesses 1616 and, in a similar fashion, the ribs 1628 interconnect adjacent projections 1624 of the panel 1872. The panel 1872 of FIGS. 50-54 includes corners 1592 formed along a periphery 1876. Referring to FIG. 51, the front side of the panel 1872 includes raised or thickened areas 1880 protruding outwardly from the front side 1580 in a direction away from the back side 1576. Referring to FIG. 52, the back side of the panel 1872 includes raised or thickened areas 1884 protruding outwardly from the back side 1576 in a direction away from the front side 1580. The openings 1588 are formed through the panel 1872 for receiving fasteners 1712 and threaded sleeves 1716 therein. A bottom heel opening 1888 is spaced inwardly from the heel side edge 1604 of the panel 1872, and the raised area 1884 surrounds the opening 1588 on the back side 1576. Similarly, the heel bottom opening 1888 on the front side 1580 is surrounded by the raised area 1880, which extends inwardly across the front side 1580 from the corner 1592 of heel side edge 1604 to form a thickened rectangular area along the bottom edge 1608. Accordingly, each of the openings 1588 is reinforced and strengthened by the raised areas 1880 on the front side 1580 and raised areas 1884 on the back side 1576 of the panel 1872. It will be appreciated that the panel 1872 of FIGS. 50-54 does not include the perimeter wall 1584 as illustrated in FIGS. 44 and 45. In some embodiments, the perimeter wall 1584 may be formed along portions or edges of the panel 1872 to increase rigidity or strength.

Figure 53:
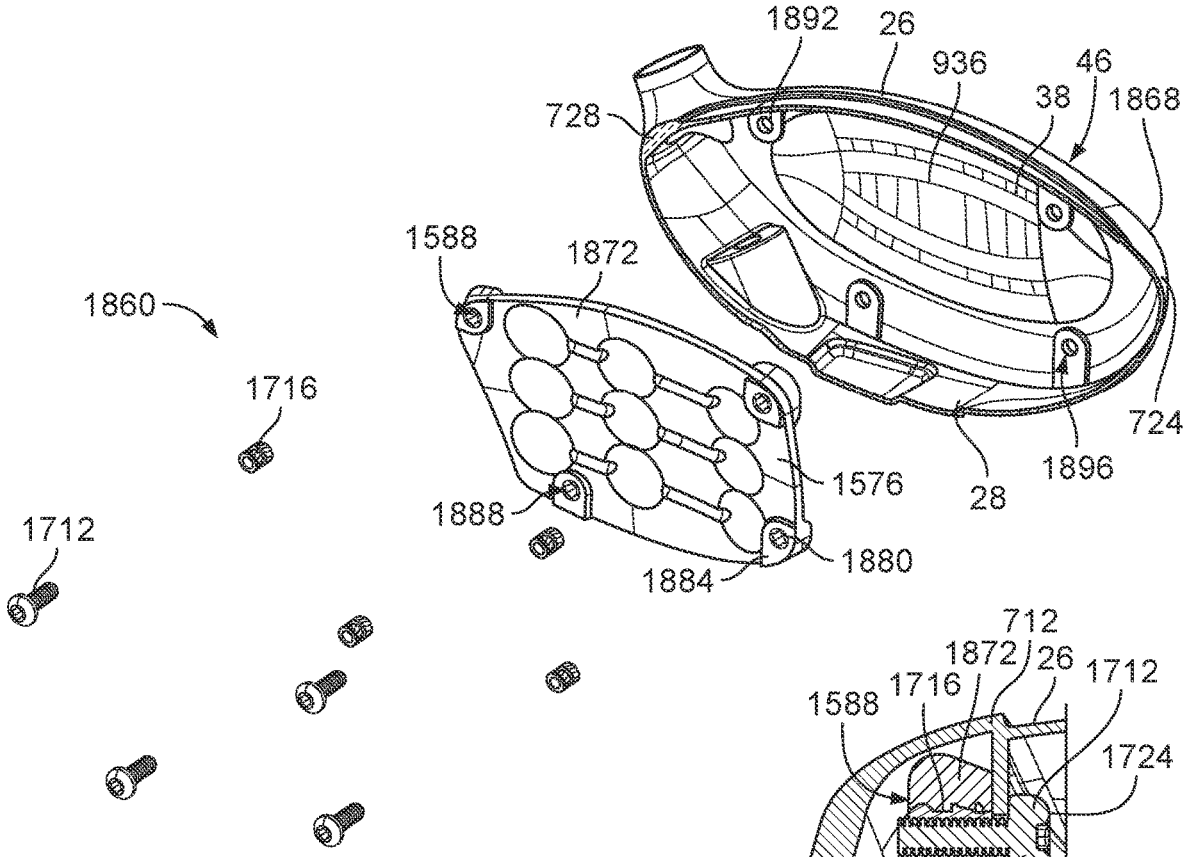
FIG. 53 illustrates a partial, exploded view of a back side of the weighting system and golf club head of FIG. 50.
Figure 54:
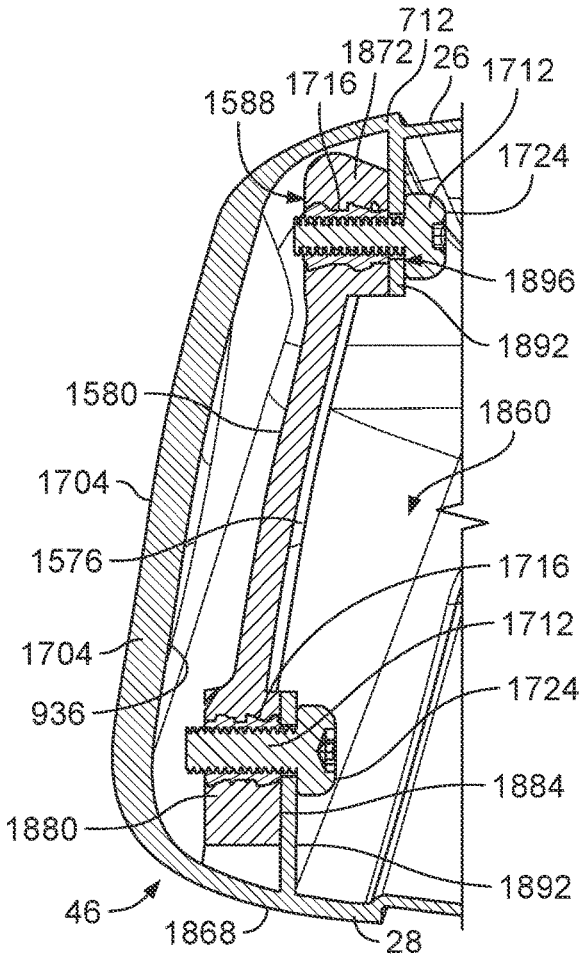
FIG. 54 illustrates a partial, sectional view of the weighting system installed within the golf club head of FIG. 50.

Referring to FIGS. 50 and 53, the club head 1868 includes a plurality of tabs 1892 disposed within the interior cavity 932 of the club head 1868. Each tab 1892 includes a hole 1896 for receiving the fastener 1712 when the panel 1872 is installed within the club head 1868. With reference to FIG.

54, the tabs 1892 are provided as cantilevered beams or ribs that support the panel 1872 within the interior cavity 932 in the front region 46 of the club head 1868. The plurality of tabs 1892 are disposed on the chassis 712 of club head 1868. In the illustrated embodiment, the plurality of tabs 1892 are integrally formed with the chassis 712 of the club head 1868. In some embodiments, the tabs 1892 are attached to the club head 1868 using any suitable technique, such as, e.g., fastening, welding, adhering, or the like. The panel 1872 is disposed between the rear surface 936 of the face 38 and the plurality of tabs 1892, such that each fastener 1712 is inserted through the hole 1896 of each tab 1892 before engaging the threaded insert 1716 in the opening 1588 of the panel 1872. The fasteners 1712, the panel 1872, and the tabs 1892 are all spaced, e.g., rearwardly, from the face 38. In this way, the fasteners 1712 and the tabs 1892 are arranged to permit the panel 1872 to be mounted to the club head 1868 without directly contacting the face 38. Accordingly, the face 38 is free from openings or holes or connection points formed thereon or therethrough.

Figure 56:
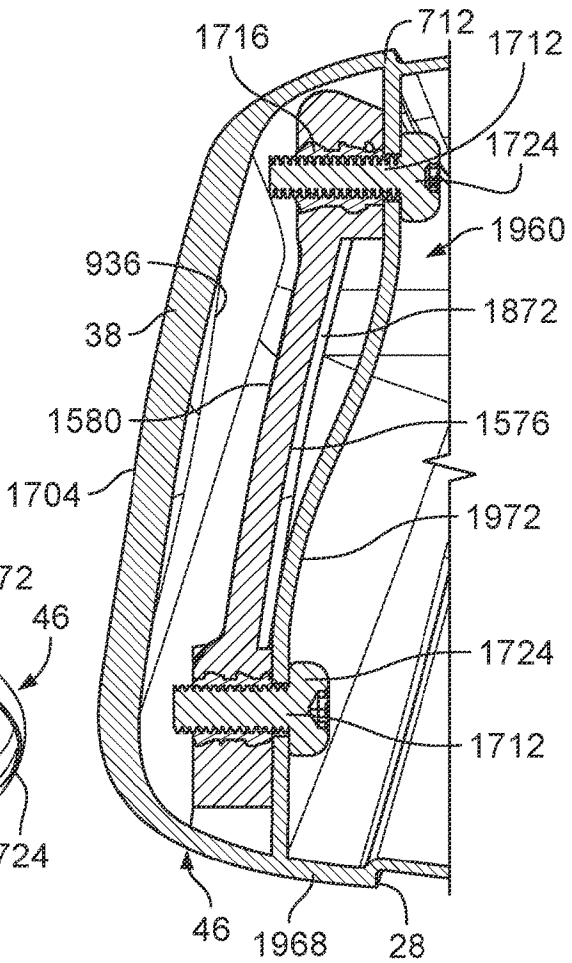
FIG. 56 illustrates a partial sectional view of the weighting system installed within the golf club head of FIG. 55.
Figure 55:
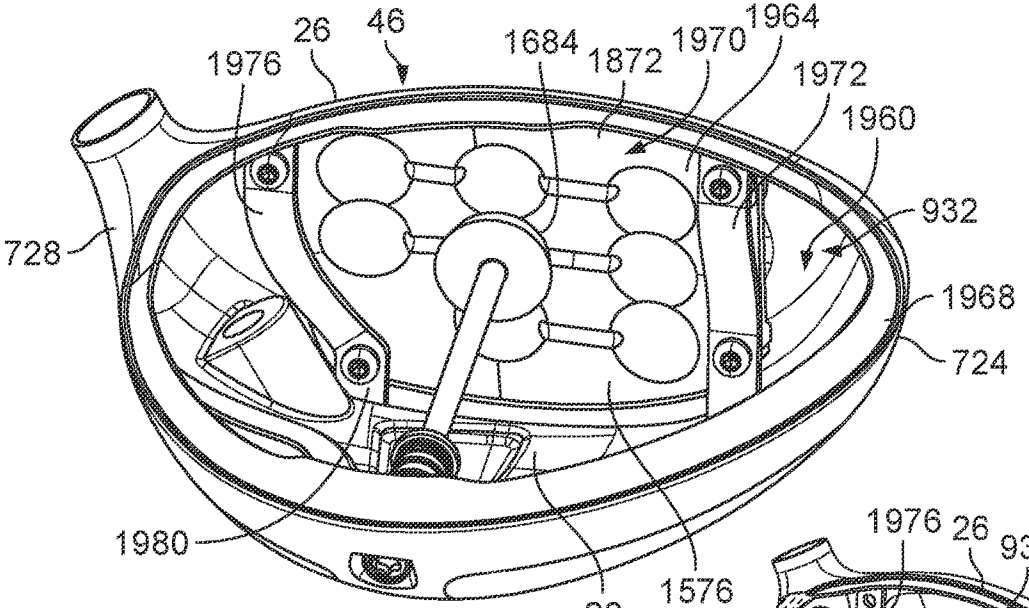
FIG. 55 illustrates a partial, perspective view of another embodiment of a weighting system for a golf club head in accordance with the present disclosure.
Figure 57:
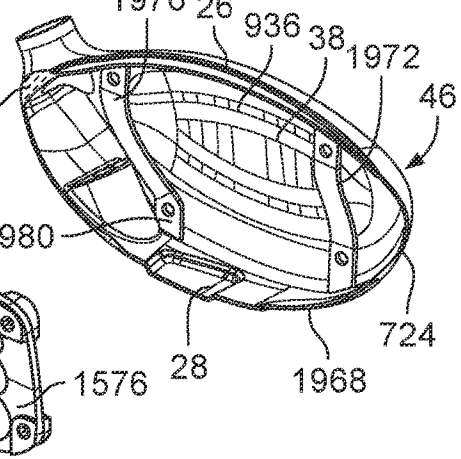
FIG. 57 illustrates a partial, perspective view of a back side of the weighting system and golf club head of FIG. 55.
Figure 57:
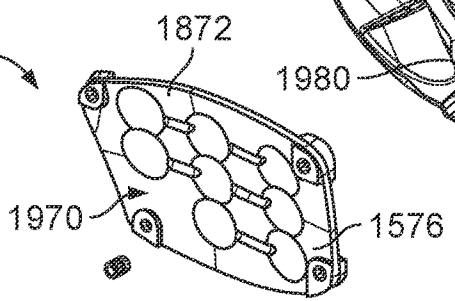
Figure 57:
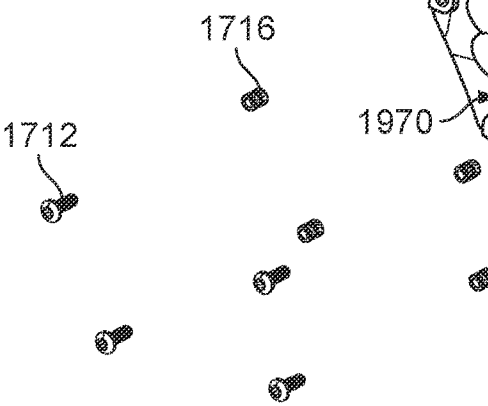

FIGS. 55-57 illustrate another embodiment of a weighting system 1960 including a cage 1964 in connection with a club head 1968. For purposes of clarity and brevity, like reference numerals will be used to indicate like elements, and the disclosure will focus on features and aspects of the cage 1964 and club head 1968 which differ from embodiments described above and shown in FIGS. 1-54. As depicted in FIG. 55, the weighting system 1960 includes the panel 1872 of FIG. 54 having a modified grid pattern 1970 mounted to a toe side rail 1972 and a heel side rail 1976 within the club head 1968. It will be appreciated that the toe side rail 1972 and the heel side rail 1976 are provided in lieu of the plurality of tabs 1892 described above and shown in FIGS. 50, 53, and 54. Referring to FIG. 55, the toe side rail 1972 is positioned within the toe region 44 of the club head 1968 adjacent the toe side 724. The toe side rail 1972 extends continuously from the crown 26 to the sole 28 in the interior cavity 932 of the club head 1968. The heel side rail 1976 is positioned within the heel region 40 of the club head 1968 adjacent the heel side 728. The heel side rail 1976 extends continuously from the crown 26 to the sole 28 within the interior cavity 932 of the club head 1968. The heel side rail 1976 curves inwardly toward the toe side rail 1972 as it extends from the crown 26 toward the sole 28 until a bottom segment 1980 that extends substantially parallel with the toe side rail 1972 to connect the heel side rail 1976 to the sole 28. With reference to FIGS. 56 and 57, the toe side rail 1972 curves outwardly relative to the rear surface 936 of the face 38 as it extends from the sole 28 to the crown 26. In other words, the toe side rail 1972 defines a concave curvature between the sole 28 and the crown 26 relative to the rear surface 936 of the face 38. It will be appreciated that the heel side rail 1976 similarly curves outwardly relative to the face 38. Both the heel side rail 1976 and the toe side rail 1972 include this outward curvature to correspond to the loft of the face 38. As with the plurality of tabs 1892 in the embodiment of FIGS. 50-54, the toe side rail 1972 and the heel side rail 1976 are provided with holes 1896 for receiving fasteners 1712 to mount the panel 1872 to the club head 1968 without directly contacting the face 38.

Figure 58:
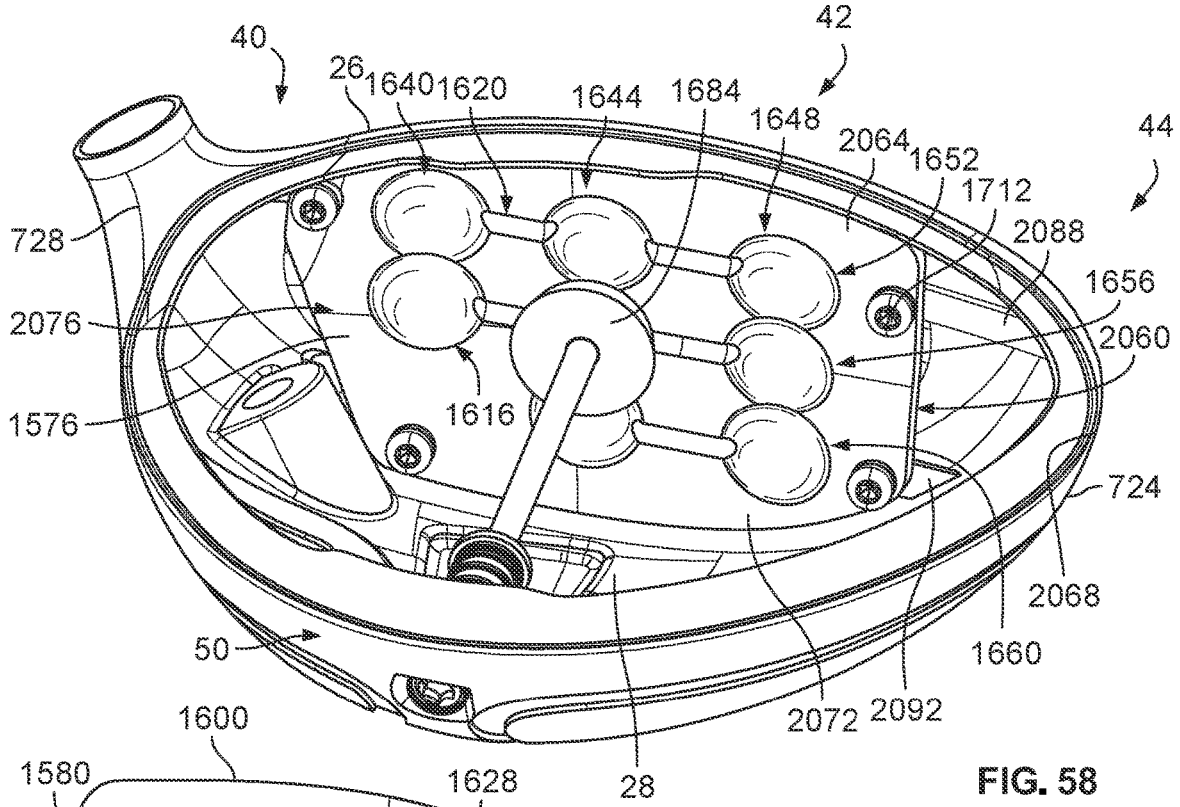
FIG. 58 illustrates a partial, perspective view of another embodiment of weighting system for a golf club head in accordance with the present disclosure.

FIGS. 58-62, illustrate another embodiment of a weighting system 2060 including a cage 2064 in connection with a club head 2068. For purposes of clarity and brevity, like reference numerals will be used to indicate like elements, and the disclosure will focus on features and aspects of the cage 2064 and club head 2068 which differ from embodiments described above and shown in FIGS. 1-57. As depicted in FIG. 58, the cage 2064 of the weighting system 2060 includes a panel 2072 having the plurality of recesses 1616 formed on the back side 1576 and the plurality of corresponding projections 1624 formed on the front side 1580. Similarly, the panel 2072 includes the plurality of slots 1620 on the back side 1576 of the panel 2072 and the plurality of corresponding ribs 1628 on the front side 1580. The panel 2072 includes a modified grid pattern 2076 in which only two recesses 1616 are provided in the third row 1660 adjacent the sole 28 and only two recesses 1616 are provided in the first column 1640 adjacent the heel side edge 1604. The openings 1588 are formed through the panel 2072 and about which raised flanges 2080 protrude from the back side 1576 for reinforcement and rigidity when securing the panel 2072 to the club head 2068 via the fasteners 1712.

Figure 59:
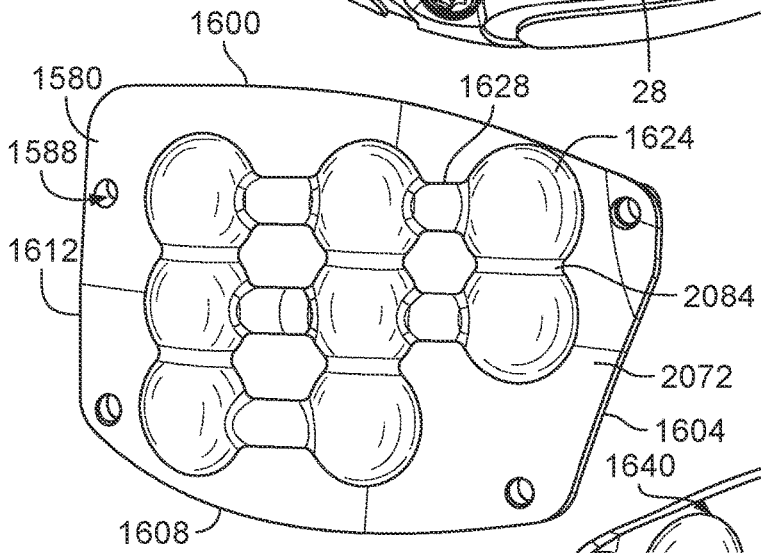
FIG. 59 illustrates a perspective view of a front side of a panel of the weighting system of FIG. 58.
Figure 60:
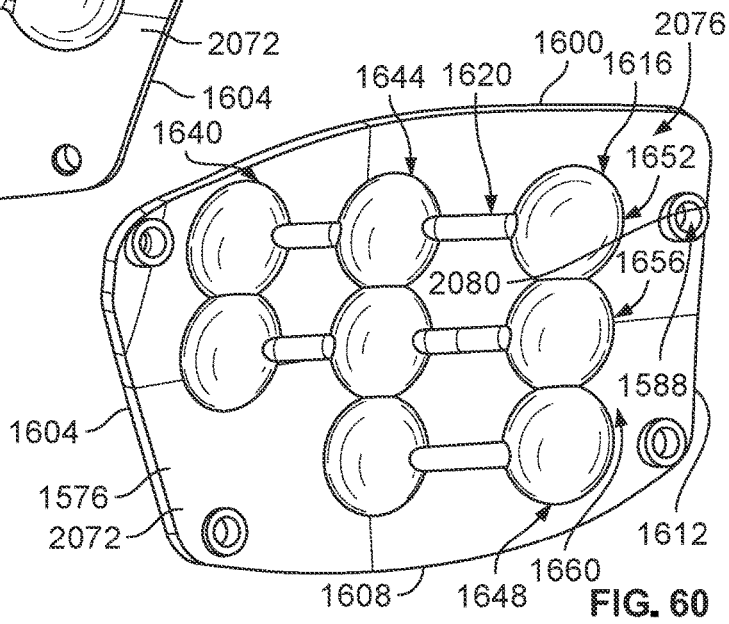
FIG. 60 illustrates a perspective view of a back side of the panel of FIG. 59.

Referring to FIG. 59, a plurality of transition areas 2084 are formed between adjacent projections 1624 in the first row 1662 and the second row 1656 and between the second row 1656 and the third row 1660. The transition areas 2084 are provided where the adjacent projections 1624 overlap one another at a reduced extent when compared to the extent of the projection 1624 at the center 1636 relative to the front side 1580. Accordingly, the front side 1580 of the panel 2072 includes a varied topology of different extents among the plurality of projections 1624 and the plurality of ribs 1628. The panel 2072 lacks the perimeter wall 1584 depicted in FIGS. 44 and 45. In some embodiments, the perimeter wall 1584 may be formed along portions or edges of the panel 2072 to increase rigidity or strength.

Figure 61:
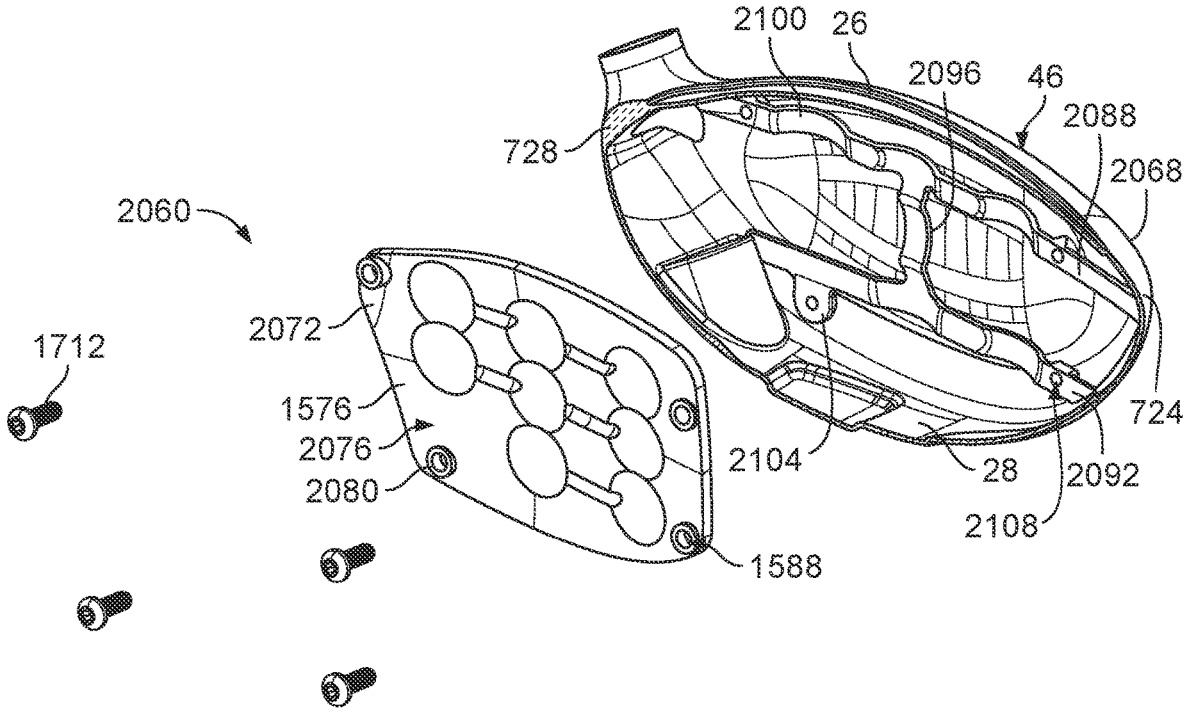
FIG. 61 illustrates a partial, exploded view of a back side of the weighting system and golf club head of FIG. 58.
Figure 62:
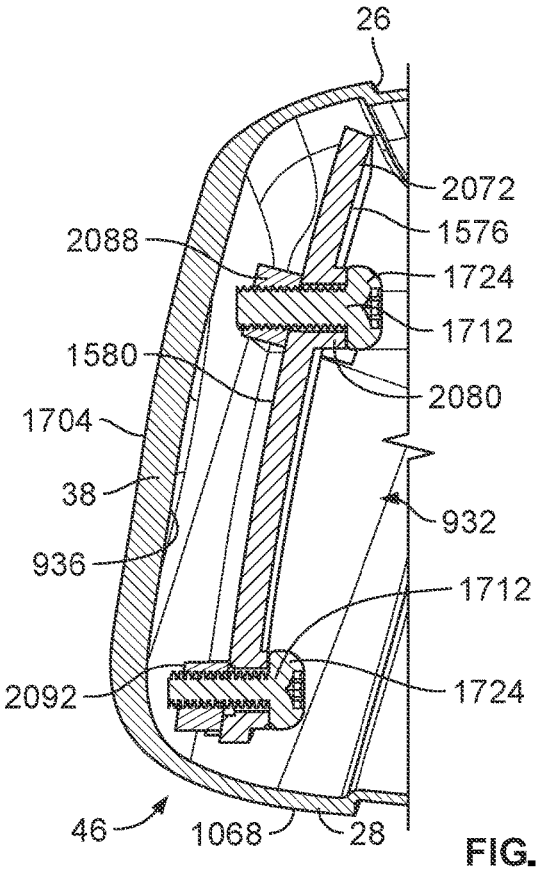
FIG. 62 illustrates a partial, sectional view of the weighting system installed within the golf club head of FIG. 58.

Referring to FIGS. 61 and 62, the club head 2068 includes a first bar or upper bar 2088 and a second bar or lower bar 2092 extending laterally, e.g., in the H-T direction, within the interior cavity 932 in the toe region 44 of the club head 2068. A third bar or medial bar 2096 extends between the upper bar 2088 and the lower bar 2092 within the medial region 42 of the club head 2068. A plurality of pockets 2100 are formed along the upper bar 2088, the lower bar 2092, and the medial bar 2096 for receiving the plurality of projections 1624 on the front side 1580 of the panel 2072. To that end, the plurality of pockets 2100 are sized and shaped to match a curvature of the plurality of projections 1624 arranged in the modified grid pattern 2076 provided on the panel 2072. The plurality of pockets 2100 curved convexly relative to the rear surface 936 of the front face 38. A bottom heel tab 1892 extends from the lower bar 2092 adjacent the heel side 728 within the heel region 40 of the club head 1868. The bottom heel tab 2104 extends substantially linearly toward the sole 28 but suspended above the sole 28. A plurality of holes 2108 are formed through the upper bar 2088 and the lower bar 2092 to receive the fasteners 1712 for mounting the panel 2072. In the illustrated embodiment, the bottom heel tab 2104 carries one of the plurality of holes 2108 for mounting the panel 2072. Accordingly, the front side 1580 of the panel is configured to be secured against the upper bar 2088, the lower bar 2092, and the medial bar 2096 by inserting the fastener 1712 through the openings 1588 in the panel 2072 and the holes 2108 without directly contacting the face 38, as illustrated in FIG. 62.

Figure 63:
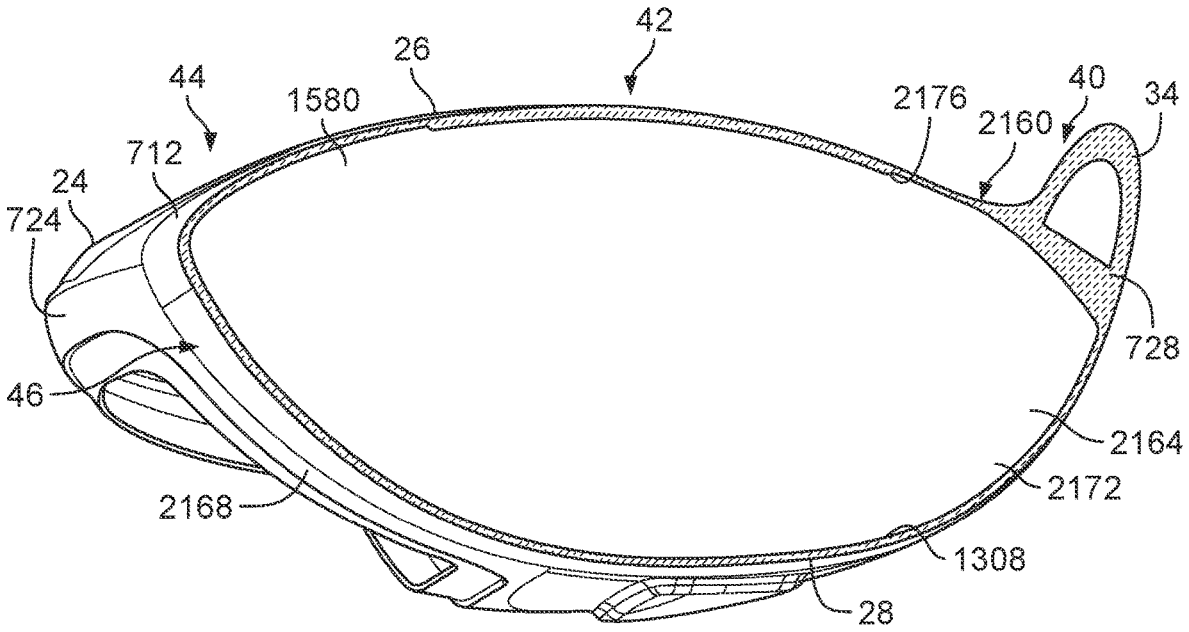
FIG. 63 illustrates a sectional view of a front side of another embodiment of a panel disposed within a golf club head in accordance with the present disclosure.

FIG. 63 illustrates another embodiment of a weighting system 2160 including a cage 2164 in connection with a club head 2168. For purposes of clarity and brevity, like reference numerals will be used to indicate like elements, and the disclosure will focus on features and aspects of the cage 2164 and club head 2168 which differ from embodiments described above and shown in FIGS. 1-62. As depicted in FIG. 63, a panel 2172 is molded to the club head 2168 within the interior cavity 932. A periphery 2176 of the panel 2172 is configured to directly and continuously contact inner surfaces 1308 of the club head 2168 to secure the panel 2172 thereto. To that end, the panel 2172 may be attached to the club head 2168 by molding, e.g., co-molding or injection molding, or by 3D printing, or any suitable technique. Further, any of the fastening techniques and structures described above in connection with the embodiments of FIGS. 43-62 may be used to secure the panel 2172 to the club head 2168. In this way, the panel 2172 is provided with increased surface area SA along which the weight component 1684 can be located for adjusting the CG location of the club head 2168. In the illustrated embodiment, the panel 2172 extends continuously between the toe side 724 and the heel side 728 of the club head 2168, without forming a space or gap between the inner surface 1308 of the club head 2168 at the heel side 728 or toe side 724. In other words, the panel 2172 abuts the inner surface 1308 of the club head 2168 at the heel side 728 and the toe side 724, as well as abutting the inner surface 1308 at the crown 26 and the sole 28, although other configurations are possible. Depending on the particular size and shape of the club head 2168, the panel 2172 may be disposed various distances from the rear surface 936 of the face 38 (see, e.g., FIG. 62). For example, the panel 2172 may be disposed within and molded to the club head 2168 at a distance ranging between about 1 mm and about 35 mm, or about 2 mm and about 30 mm, or about 5 mm and about 35 mm between the front side 1580 of the panel 2172 and the rear surface 936 of the face 38.

In some embodiments, the surface area SA of the panel 2172 may vary as a function of the distance between the panel 2172 and the rear surface 936. For example, the surface area SA may be largest, i.e., maximum, when the panel 2172 is disposed the smallest distance from the rear surface 936. The surface area SA may be decrease when the panel 2172 is disposed greater distances from the rear surface 936. It will be appreciated that when the panel 2172 is molded to the club head 2168, the surface area SA provided for connection to the weight component 1684 is relatively greater than a surface area afforded by the previous embodiments of the panel 2172 that are fastened to the club head 2168 (see FIGS. 43-62). Accordingly, the panel 2172 of FIG. 63 may permit greater variability and increased options for adjusting the CG location, e.g., in the H-T direction, of the club head 2168 than previous embodiments and, especially when compared to conventional golf clubs and weighting systems. It is further contemplated that the panel 2172 may not include recesses or pockets or projections on the front side 1580 or back side (not shown), such that the weight component 1684 may be incrementally adjusted among the entirety of the surface area SA instead of being limited to one of the plurality of positions 1688 corresponding to the plurality of recesses 1616.

Figure 66:
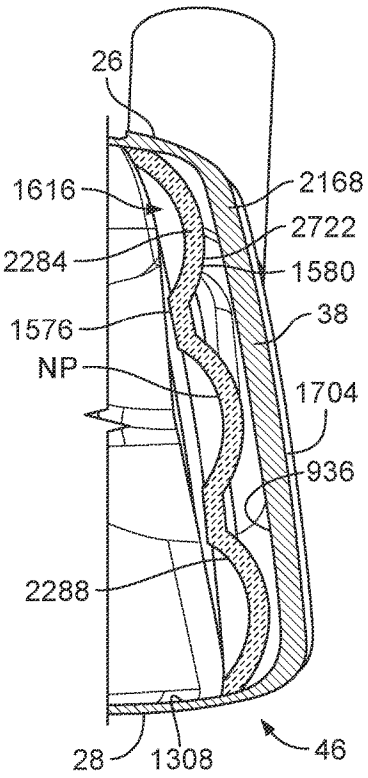
FIG. 66 illustrates a sectional view of the panel disposed within the golf club head of FIG. 64.
Figure 64:
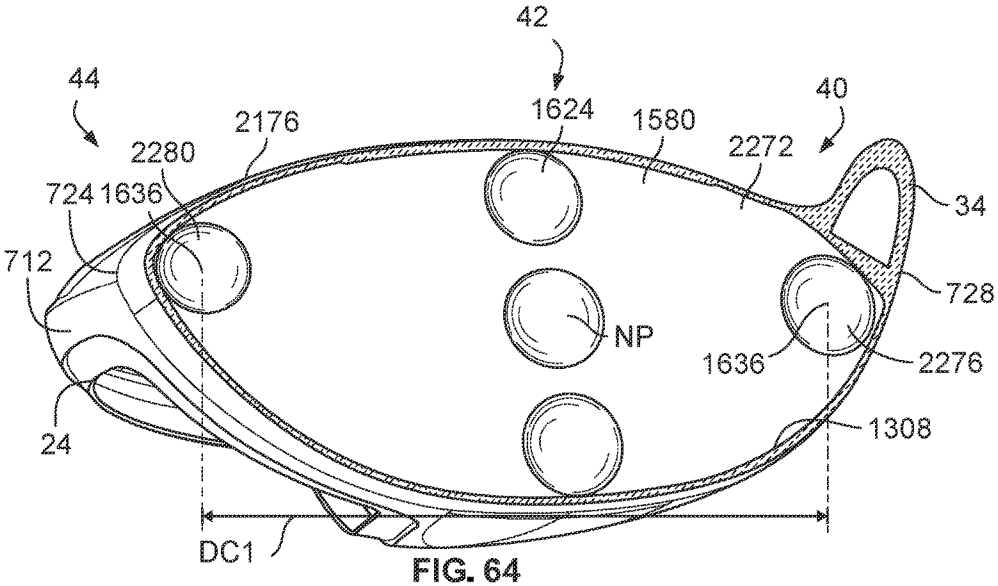
FIG. 64 illustrates a sectional view of a front side of another embodiment of a panel disposed within a golf club head in accordance with the present disclosure.
Figure 65:
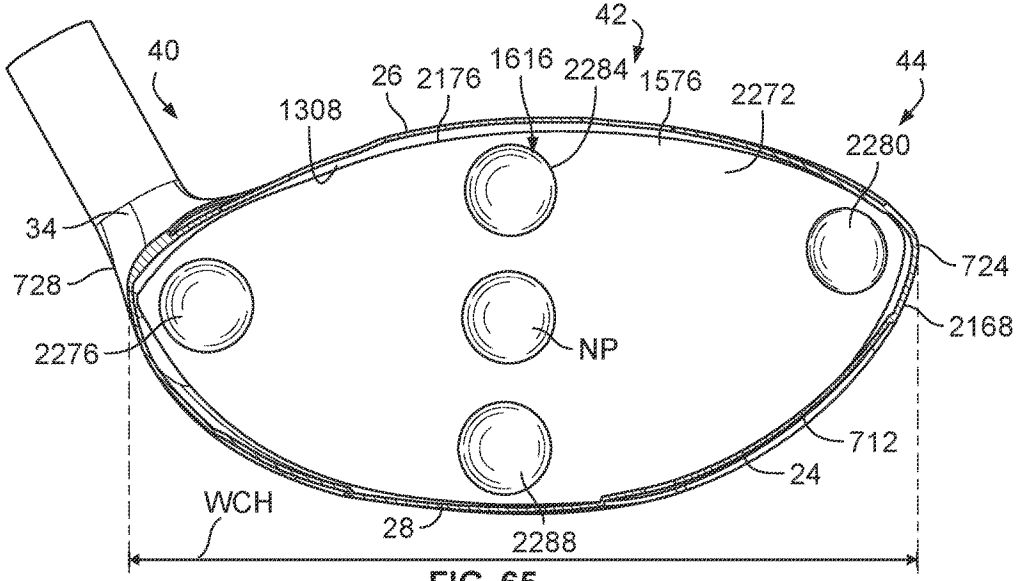
FIG. 65 illustrates a sectional view of a back side of the panel of FIG. 64.

Referring to FIGS. 64-66, another embodiment of a panel 2272 of the weighting system 2160 is depicted in connection with the club head 2168. In the illustrated embodiment, the panel 2272 is molded to the club head 2168, similar to the panel 2172 of FIG. 63, and the plurality of projections 1624 are provided on the front side 1580 thereof. Further, any of the fastening techniques and structures described above in connection with the embodiments of FIGS. 43-62 may be used to secure the panel 2272 to the club head 2168. The plurality of projections 1624 correspond to the plurality of recesses 1616 that form the plurality of positions 1688 in which a weight component, such as the weight component 1684 of FIG. 43, may be received for adjusting the CG location of the club head 2168. As shown in FIGS. 64 and 65, the plurality of positions 1688 include a heelward position 2276 located adjacent the heel side 728 and a toeward position 2280 located adjacent the toe side 724. Due in part to the panel 2272 being molded to the club head 2168, the heelward position 2276 and the toeward position 2280 are spaced a distance from one another, when measured as a distance DC1 between centers 1636, which is substantially greater than 50% of a total width WCH of the club head 2168 defined between the toe side 724 and the heel side 728 (see FIG. 65). In some embodiments, the distance between the heelward position 2276 and the toeward position 2280 is at least about 60% of the total width, or at least about 70% of the total width, or at least about 80% of the total width. In some embodiments, the distance is between about 80% and about 95% of the total width.

Referring to FIGS. 65 and 66, the plurality of positions 1688 include a top position 2284 located adjacent the crown 26 and a bottom position 2288 located adjacent the sole 28. Due in part to the panel 2272 being molded to the club head 2168, the top position 2284 and the bottom position 2288 are spaced a distance from one another, when measured as a distance between centers 1636, which is substantially greater than 50% of a total height of the club head 2168 between the crown 26 and the sole 28. In some embodiments, the distance between the top position 2284 and the bottom position 2288 is at least about 60% of the total height, or at least about 70% of the total height, or at least about 80% of the total height. In some embodiments, the distance is between about 80% and about 95% of the total height.

Turning to FIG. 66, a distance between the front side 1580 of the panel 2272 and the rear surface 936 of the face 38 may vary. The distance may be between about 0.05 mm and about 30 mm, or between about 0.08 mm and about 28 mm, or between about 0.1 mm and about 25 mm. It will be appreciated that the distance may be represented as a ratio relative to the total depth TCD of the club head 2168 between the front surface 1704 and the rearmost point 1708, as described and illustrated in connection with FIG. 46. The panel 2272 may further be provided with features for increasing rigidity or strength in certain areas, or with recesses or notches for spacing the panel 2272 away from a portion of the inner surface 1308 of the club head 2168, or with any number of recesses or projections for receiving and retaining a weight component.

Figure 67:
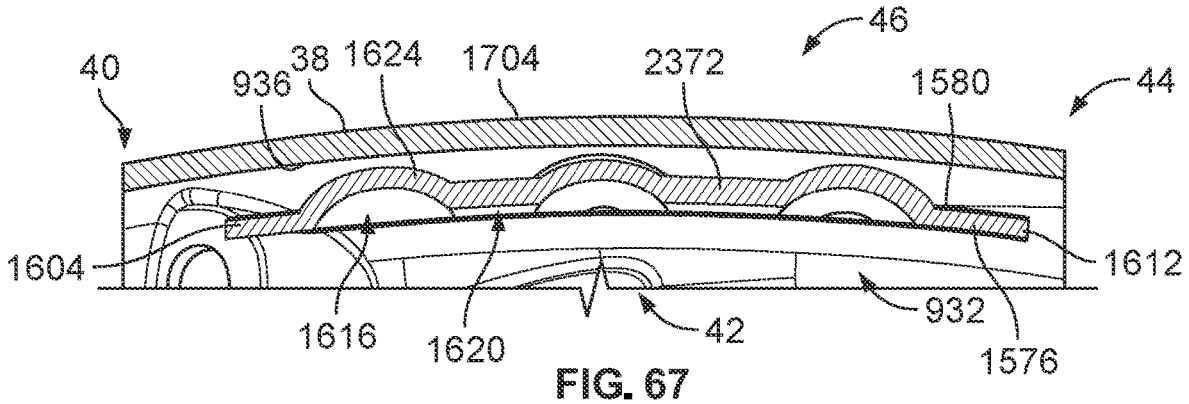
FIG. 67 illustrates a partial, sectional, plan view of a representative panel disposed within a golf club head in accordance with the present disclosure.

Referring to FIG. 67, a representative panel 2372, or any of the panels described herein, can be curved or bowed between the heel side edge 1604 and the toe side edge 1612 for maintaining proximity, e.g., reduced distance, with the rear surface 936 of the face 38 in the H-T direction. To that end, the panel 2372 may curve convexly relative to the rear surface 936 of the face 38. In some embodiments, the curvature of the panel 2372 is substantially parallel with the curvature of the face 38. In some embodiments, the curvature of the panel 2372 is different from, e.g., having a greater or smaller radius of curvature than, that of the face 38. In some embodiments, the panel 2372 curves inversely to the curvature of the face 38, such that the panel 2372 curves concavely relative to the rear surface 936 of the face 38 in the H-T direction, which can provide increased strength and/or durability to the panel 2372, or which can distribute mass rearward of the face 38. In some embodiments, the panel 2372 is generally planar or flat and does not curve in the H-T direction.

Figure 68:
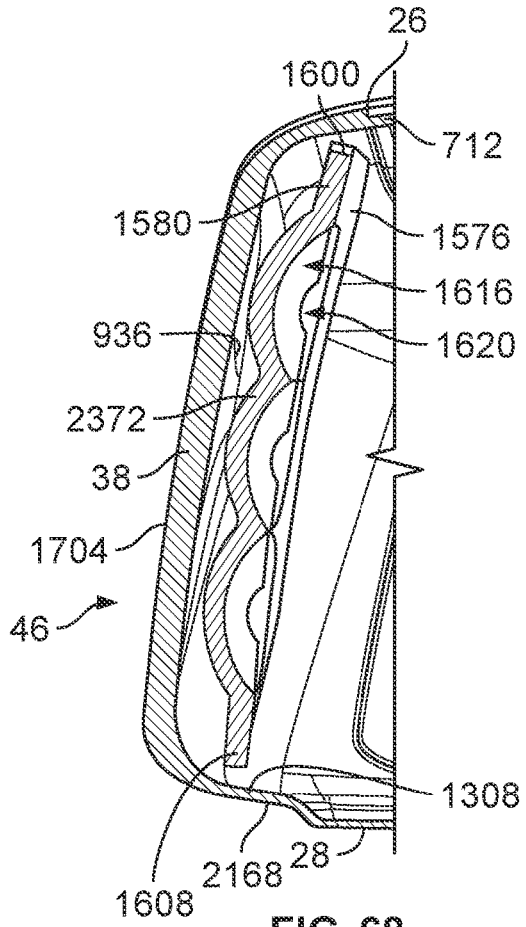
FIG. 68 illustrates a partial, sectional, side view of the panel disposed within the golf club head of FIG. 68.

Turning to FIG. 68, the panel 2372, and any of the panels described herein, can be curved or bowed between the top edge 1600 and the bottom edge 1608 for maintaining proximity, e.g., reduced distance, with the rear surface 936 of the face 38. To that end, the panel 2372 may curve convexly relative to the rear surface 936 of the face 38 in the C-S direction. In some embodiments, the curvature of the panel 2372 is substantially parallel with the curvature of the face 38. In some embodiments, the curvature of the panel 2372 is different from, e.g., having a greater or smaller radius of curvature than, that of the face 38. In some embodiments, the panel 2372 curves inversely to the curvature of the face 38, such that the panel 2372 curves concavely relative to the rear surface 936 of the face 38 in the C-S direction, which can provide increased strength and/or durability to the panel 2372, or which can distribute mass rearward of the face 38. In some embodiments, the panel 2372 is generally planar or flat and does not curve in the C-S direction.

Figure 69:
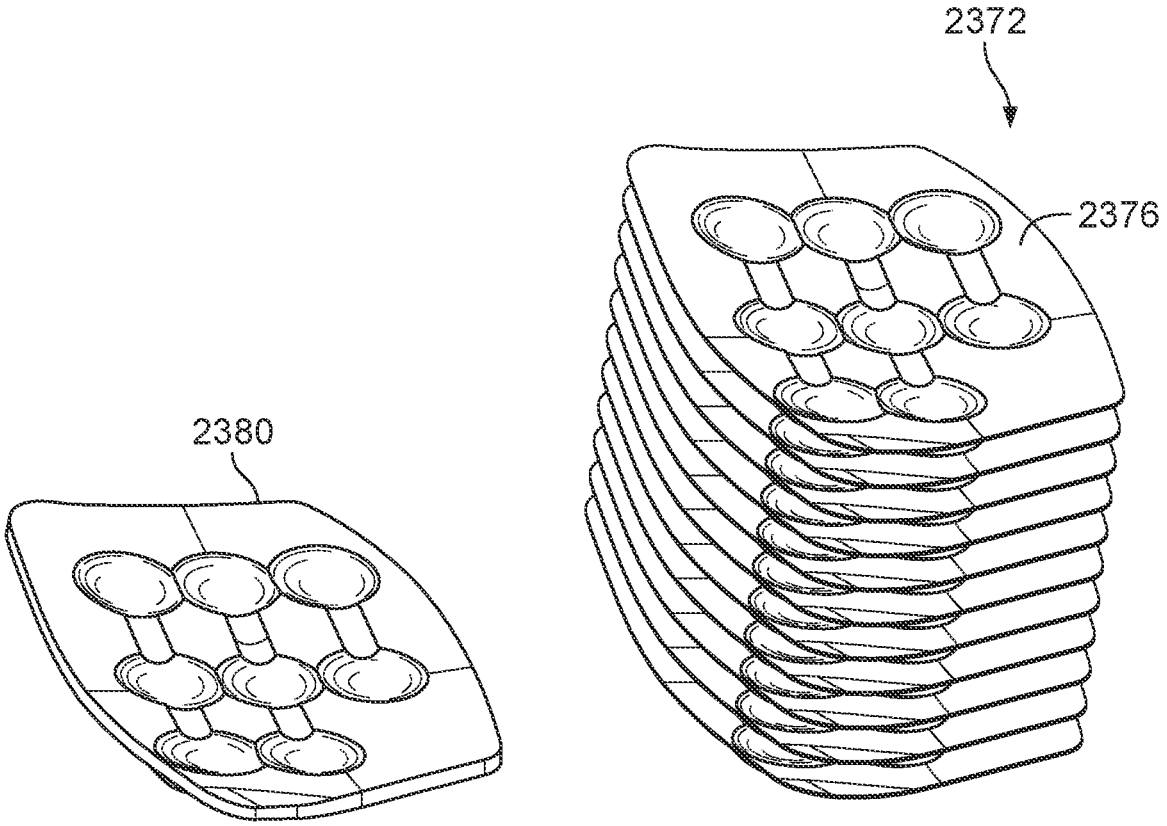
FIG. 69 illustrates an exploded view of the representative panel of FIG. 67 in accordance with the present disclosure.

FIG. 69 depicts an example of a deconstructed, exploded view of the panel 2372. The panel 2372 and any of the panels described herein may be formed in accordance with the following manufacturing techniques and materials. The panel may be formed integrally as a unitary component. In some embodiments, the panel can be formed using compression molding, expansion core molding, vacuum bag molding, injection molding, overmolding, additive manufacturing, e.g., 3D printing, or the like. It is further contemplated that the panel 2372 may be formed of a bulk molding compound (BMC) or sheet molding compound (SMC). In some embodiments, the panel 2372 may be formed of natural materials, e.g., wood materials, or lignin-free cellulose fibers, or ply-wood materials, or plant-based materials, or recycled materials, or combinations thereof. In some embodiments, the panel 2373 is comprised of a combination of natural materials and composite materials or metal materials.

The panel 2372 may have a thickness, i.e., measured in the F-R direction between opposing front and back sides (see FIG. 46), of between about 0.25 mm and about 15 mm or between about 0.3 mm and about 13 mm, or between about 0.5 mm and about 12 mm, or between about 0.6 mm and about 10 mm. As described above, the thickness of the panel 2372 may be uniform, or, alternatively, the thickness of the panel 2372 may vary therealong. In some instances, the panel can be formed of a composite material having a substrate and a matrix of embedded fibers. In some embodiments, the panel may comprise a plurality of composite layers or sheets 2376. Each of the plurality of composite layers may include a substrate and a matrix of embedded fibers. The fibers may all be arranged in the same direction, i.e., uni-drectional or uni-axial, or in various directions, i.e., multi-directional or multi-axial. In some embodiments, the fibers are chopped and randomly oriented relative to one another. In some embodiments, the fibers are continuous strands of material embedded within the substrate. In some embodiments, the panel may be a woven graphite composite of pre-preg sheets layered with certain fiber orientations. For example, the fiber orientation of each composite layer is different from the fiber orientations of adjacent or surrounding sheets. In some embodiments, the panel 2372 may include a metal sheet 2380 in between or among the plurality of composite layers 2376. The metal sheet 2380 may be made of, e.g., aluminum or alloys thereof, titanium or alloys thereof, steel or alloys thereof, or any suitable metal material or alloy.

Panels 2372 constructed of composite fiber materials, such as Kevlar®, carbon fiber, and fiberglass, among others, have improved strength-to-weight ratios in comparison to plates made entirely of metals, substrate materials, or without the addition of fibers. However, composite fiber materials are strongest in tension, which is limited to a particular direction, i.e., the axial direction in which the composite fiber material is in tension. Accordingly, composite layers having fiber materials arranged in a single, uniaxial direction are strongest in that direction, but exhibit different, e.g., weaker, properties in other directions. As such, the composite layer is considered to have anisotropic properties, i.e., exhibiting different sets of strength properties in different directions.

Composite laminates or structures manufactured using continuous fiber fabrication (CFF) techniques may exhibit quasi-isotropic (QI) properties, e.g., substantially similar properties in most directions, by way of a construction including multiple layers or plies having arrays of fiber disposed at particular angles relative to a reference plane. In some instances, one or more layers are formed of fiber arrays disposed at 0 degrees relative to the reference plane, some other layers are formed of fiber arrays disposed at +/−45 degrees relative to the reference plane, and still other layers are formed of fiber arrays disposed at 90 degrees relative to the reference plane. Further, anisotropically biased layers may be formed of fiber arrays disposed at 0 degrees, +/−30 degrees, and 90 degrees. Composite laminates with QI properties, i.e., QI laminates, may have substantially isotropic properties in-plane, e.g., increased tensional strength or stiffness, similar to an isotropic material. A substantially QI laminate may include fibers or fiber arrays that are randomly oriented or oriented such that substantially equal strength is provided in all directions of a single plane. In general, a QI laminate includes unidirectional layers, e.g., 3D printed layers, oriented at 0 degrees, 90 degrees, 45 degrees, and −45 degrees, with at least 12.5 percent of the layers disposed in each of these directions. QI properties can also be achieved with layers disposed at 0 degrees, 60 degrees, and 120 degrees, among other configurations.

In a first fabrication method, which may be referred to herein as expansive core molding (EMC), pre-impregnated ("pre-preg") sheets comprise a multiple fibers embedded within a resin film or substrate. The pre-preg sheets are partially hardened or staged, e.g., B-staged, for ease of handling and use in manufacturing. The substrate of the pre-preg sheets may be formed of any suitable polymer material, such as, e.g., a thermoset resin, including epoxy, vinyl ester, or cyclic ester, or a thermoplastic resin, including polyamides, polyethylene, polycarbonate, polypropylene, polystyrene, acrylonitrile butadiene styrene (ABS), alloys, co-polyester, ethylene vinyl acetate (EVA), plastomers, acrylic, thermoplastic polyurethane (TPU), thermoplastic elastomers (TPE), post-consumer recyclate (PCR), polyphthalamides (PPA), compostable plastics, or the like. The fibers may be formed of any suitable material, such as, e.g., carbon fibers, including low modulus carbon fibers (LMCF), intermediate modulus carbon fibers (IMCF), high modulus carbon fibers (HMCF), vertically aligned carbon nanotubes (VACNT), multi-walled carbon nanotubes (MWCNT), boron, hydrogel fibers, synthetic spider silk, graphene having multiple layers or single layers, graphite filaments of low, medium, or high modulus, fiberglass, aramid fibers such as Kevlar® (K29, K49, K100, K119, AP, XP, KM2), or the like. The fibers are provided in lay-up within a mold, in a pre-compaction fixture, or on a core. It will be appreciated that the lay-up of pre-preg sheets with differing fiber constructions and orientations can be arranged to selectively distribute and conserve weight within the part and to achieve desire characteristics, such as certain dimensions, tensile strengths, bending strengths, compression strengths, and durability. The composite panel, due to its engineered structure, can offer substantially increased strength-to-weight ratios in comparison with metal only panels made of, e.g., titanium, steel, aluminum, or the like.

During the EMC process, the shape of the mold is produced on an outer mold line (OML) side of the part, which may be limited to one side of the part. Consequently, only the OML side includes the dimensional details of the mold. In some embodiments, the OML side corresponds to the back side of the panel which engages with the weight component. The opposite side of the part, which may be referred to as the inner mold line (IML), is held against an expansion member that is expanded to press against the OML of the mold. The expansion member may be a pliable or flexible bladder made of latex, silicone, or elastomeric material. The expansion member may be a rigid Memory Shaped Mandrel (MSM) bladder. The expansion member may have a solid metal core, such as e.g., aluminum or a eutectic alloy. The expansion of the expansion member can be caused by the application of air pressure and/or heating. A dimensional and textural quality of the IML side of the part is a function of the number of pre-preg sheets or plies used and how the expansion member material pushes the pre-preg sheets against the shape of the mold cavity. Consequently, the EMC process may produce the IML side with relatively wider tolerances and coarser details in comparison with the OML side.

A second fabrication method, which may be referred to herein as compression molding (CM), can be used with same materials and material combinations as described in the first fabrication method, i.e., EMC. Further the second fabrication method can include Staged Compression Molding (SCM) material, such as Sheet Molding Compound (SMC). The SMC uses longer length, e.g., 1 to 2 inches, graphite (LMCF, IMCF, HMCF) fibers. In some embodiments, the second fabrication method can include Bulk Molding Compound (BMC). The BMC uses shorter length, e.g., 0.25 to 1 inch, graphite (LMCF, IMCF, HMCF) fibers. The SCM graphite fibers are randomly mixed at different orientations which are then joined with a substrate or resin, which may be any of the materials described above, to make the material easier to handle and form for manufacturing. The SCM material is formed into a charge which is then weighed and, in some instanced, shaped to help fill the mold. Preferably, the mold consists of two halves including the outer side and the inner side. The outer side and the inner side of the mold close together to form a volume which defines the shape and size of the part being molded. When a pre-preg sheet lay-up or SCM charge is placed into the volume of the mold and then the mold is closed, the substrate and fiber are forced to move and/or flow to fill the shape and empty volume between the outer side and inner side of the mold. Using the second fabrication methods with SCM material, the finished part, also referred to as a finished compression molded graphite composite part, is composed of randomly distributed fibers, such as graphite fibers, in all directions throughout its volume. By contrast, using the first fabrication method or EMC process, the finished part includes the composite pre-preg sheets with fibers oriented in the arrangement in which they were cut and placed into the mold. The graphite composite part that comes from the second fabrication method or CM process has dimensionally accurate features on both the OML side and the IML side. Accordingly, the second fabrication method or CM process is preferable when dimensional accuracy is necessary for mating to other parts. Further, the second fabrication method or CM process enables intricate shapes to be produced, such as tight corners, pockets, ridges, rails, indentations, and fine contours, on both the OML and IML sides.

Figure 70:
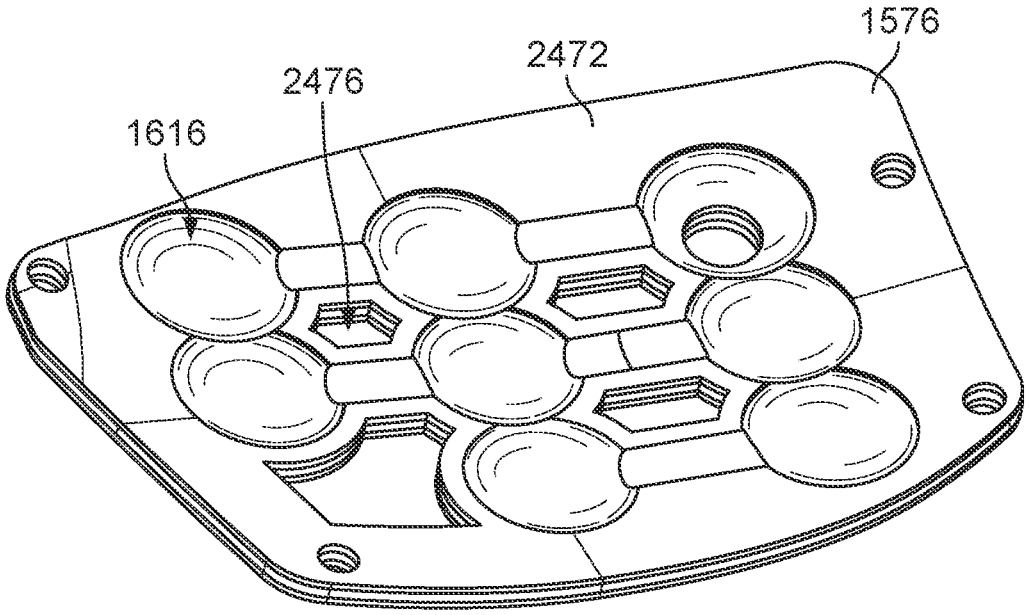
FIG. 70 illustrates a perspective view of a back side of another embodiment of a panel in accordance with the present disclosure.
Figure 71:
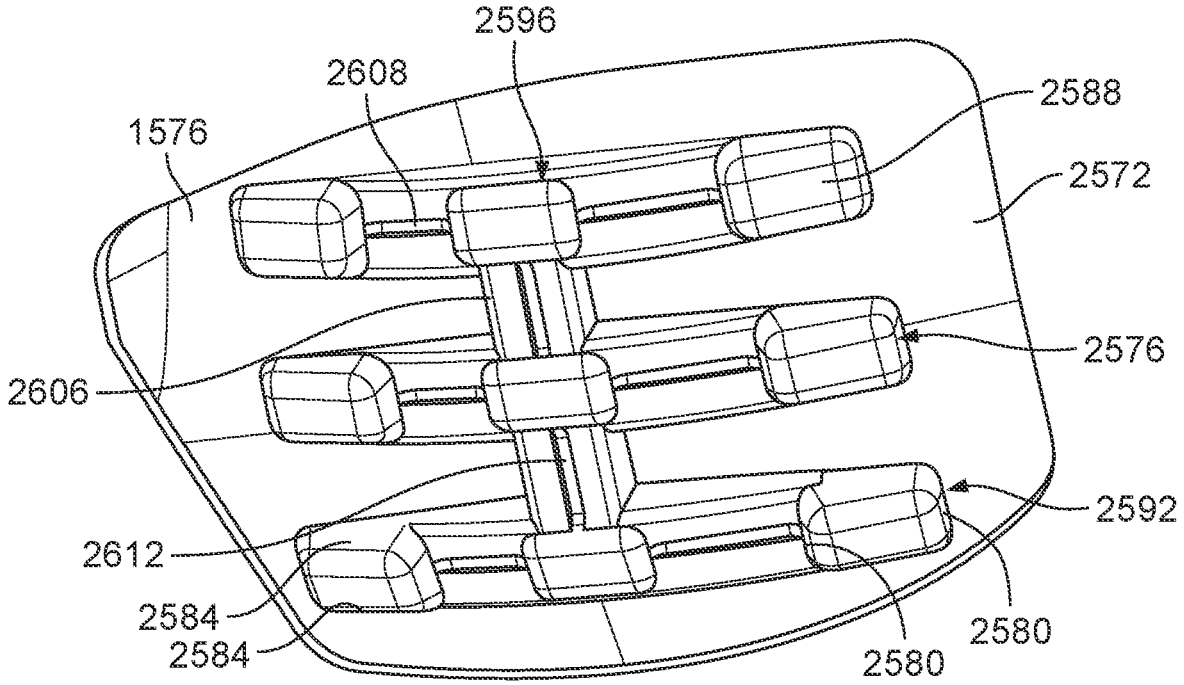
FIG. 71 illustrates a perspective view of a back side of yet another embodiment of a panel in accordance with the present disclosure.
Figure 72:
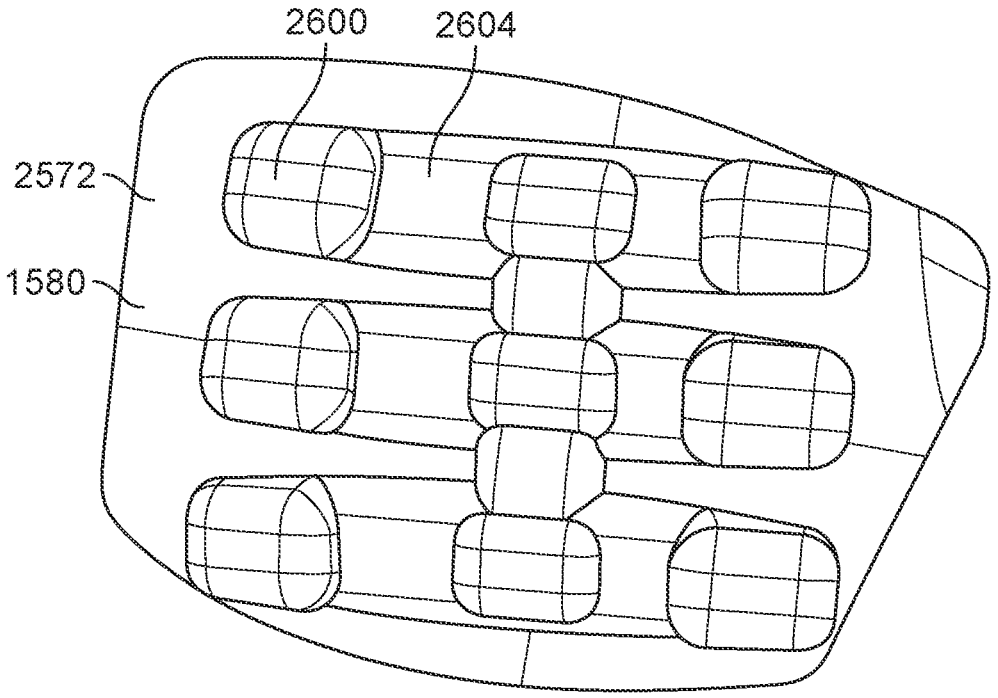
FIG. 72 illustrates a perspective view of a front side of the panel of FIG. 71.

Turning to FIG. 70, an embodiment of a panel 2472 includes voids 2476 formed therethrough. The voids 2476 may extend entirely through the back side 1576 and the front side 1580 (see FIG. 68) of the panel 2472. The voids 2476 may extend partially into the back side 1576 or the front side 1580 of the panel 2472, such as, e.g., blind holes or recesses. The voids 2476 may be provided to reduce an overall mass of the panel 2472, or to provide increased flexibility, or to accommodate structural features of the club head 2168, or to assist in mounting the panel 2472 to the club head 2168. The voids 2476 may be formed by subtractive manufacturing techniques, such as, e.g., by cutting or sawing or punching or milling or any other method for removing material. The voids 2476 may be formed during manufacture of the panel 2472 by, e.g., molding.

Referring to FIGS. 71-74, another embodiment of a panel 2572 includes a plurality of recesses 2576 arranged within the grid pattern 1632 and having opposing sets of flat sides 2580, 2584 to define a rectangular-shaped receptacle. The opposing sets of flat sides 2580, 2584 may be angled sloped between the back side 1576 and an inset wall 2588, so as to taper or narrow the shape of the recess 2576 between the inset wall 2588 and the back side 1576 of panel 2572. In addition, the back side 1576 of the panel 2572 includes a plurality of row channels 2592 extending between the heel side edge 1604 and the toe side edge 1612 in which the plurality of recesses 2576 are disposed. The plurality of row channels 2592 extend between adjacent recesses 2576 across the first, second, and third columns 1640, 1644, 1648 of the grid pattern 1632. Accordingly, each of the first, second, and third rows 1652, 1656, 1660 includes a corresponding first, second, and third row channel 2592, although other configurations are possible. A medial column channel 2596 extends transversely relative to the plurality of row channels 2592 and intersects the plurality of row channels 2592 and the plurality of recesses 2576 within the second column 1644 of the grid pattern 1632. The plurality of recesses 2576 form a plurality of corresponding projections 2600 on a front side 1580 of the panel 2572 (see FIG. 72). The plurality of row channels 2592 form a plurality of corresponding bridges 2604 that interconnect adjacent projections 2600 on the front side 1580. The medial column channel 2596 forms a corresponding column bridge 2606 that interconnects the projections 1624 of the second column 1644 on the front side of the panel 2572. Further, a first plurality of ridges 2608 are formed on the back side 1576 of the panel 2572 within the plurality of row channels 2592 and extend between adjacent recesses 2576 in adjacent first, second, and third columns 1640, 1644, 1648. That is, the first plurality of ridges 2608 extend laterally between the first column 1640 and the second column 1644, and between the second column 1644 and the third column 1648. A second plurality of ridges 2612 extend within the medial column channel 2596 in the second column of the grid pattern 1632. One of the ridges 2612 extends within the second column 1644 between the recess 2576 in the first row 1662 and the recess 2576 in the second row 1644, and the other ridge 2612 extends between the recess 2576 in the second row 1644 and the recess 2576 in the third row 1660. It is contemplated that any number of ridges 2608, 2612 may be provided on the back side 1576.

Figure 73:
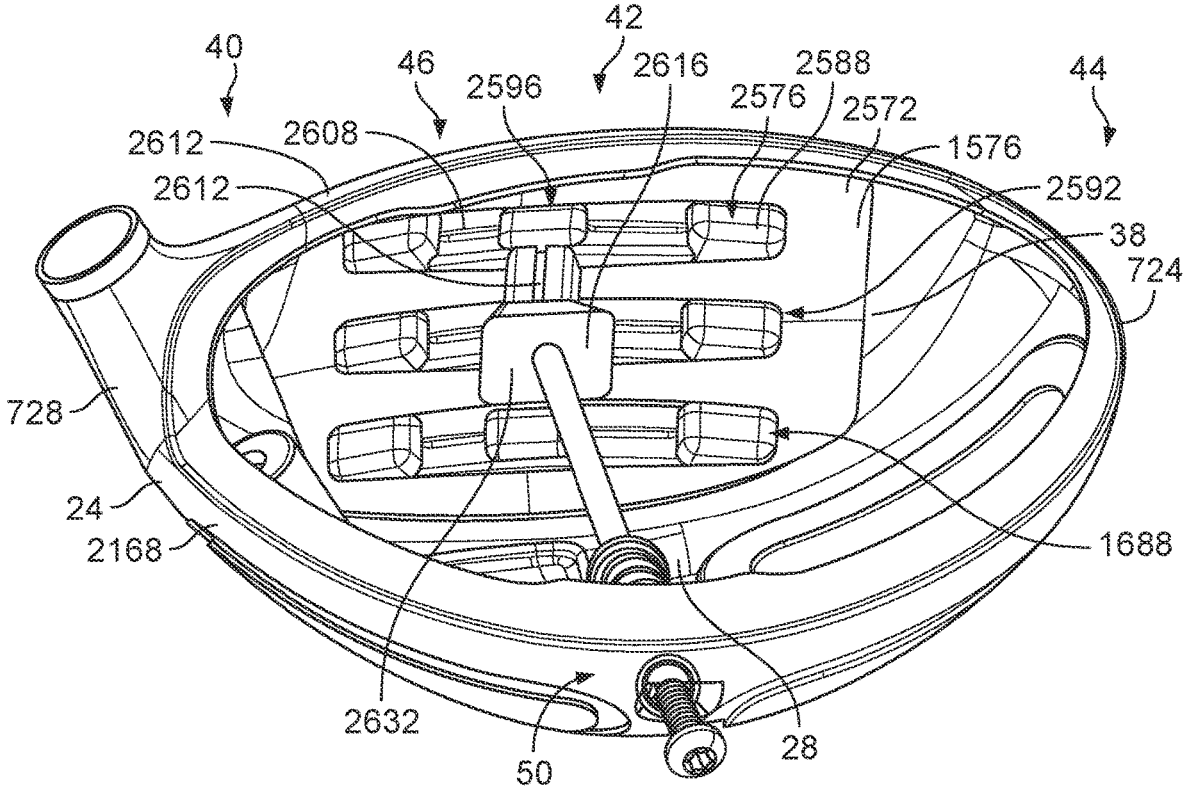
FIG. 73 illustrates a partial, perspective view of another embodiment of a weighting system for a golf club head having the panel of FIG. 71.
Figure 74:
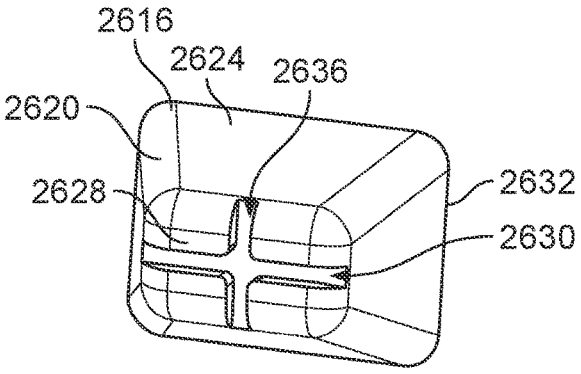
FIG. 74 illustrates a perspective view of a front side of a weight component of the weighting system o FIG. 73.

Turning to FIGS. 73 and 74, a weight component 2616 is provided for engagement with the back side 1576 of the panel 2572 in the club head 2168 to adjust the CG location. The weight component 2616 is configured to fit within the plurality of recesses 2576. Accordingly, the weight component 2616 is provided with a trapezoidal-shaped or frusto-pyramidal head 2620 having angled or slanted sides 2624 that extend between a face 2628 and a planar back surface 2632. The face 2628 of the weight component 2616 includes a first slot 2636 and a second slot 2640 that are provided in the form of grooves cut into the face 2628 and disposed orthogonally relative to one another. During use, the first slot 2636 is configured to receive and slide along the first plurality of ridges 2608 and the second slot 2640 is configured to receive and slide along the second plurality of ridges 2612 as the weight component 2616 is adjusted among the plurality of positions 1688 defined by the plurality of recesses 2576 of the panel 2572.

In accordance with the various embodiments of the present disclosure, it will be appreciated that the following aspects may be provided in connection with adjusting the CG location of a golf club head. A golf club head, such as any of the club heads described herein, includes weighting system, such as any of the weighting system described herein, and a panel, such as any of the panels described herein, which is formed of a panel material having a first density. The weighting system includes a weight component, such as any of the weight components described herein. The weight component is formed of a weight material having a second density. The second density is smaller than the first density. The golf club head includes a club body that is, at least partially, formed of a metallic material having a third density. The first density is smaller than the third density. The first density of the panel is within a range of between about 1 g/cc to about 3 g/cc, or between about 1.2 g/cc to about 2.8 g/cc, or between about 1.3 g/cc to about 2.5 g/cc. in some embodiments, the second density of the weight component is greater than the third density of the club body.

Additionally, the weighting system of the present disclosure are configured for adjusting the CG location to impart various performance properties to the golf ball (not shown) during impact, such as backspin or draw-spin or fade-spin. A magnitude of the backspin, draw-spin, and fade-spin may be represented in units of revolutions per minute (RPM). The weighting systems described herein provide a wide selection of adjustments or positions for increasing or decreasing the RPM of the golf ball (not shown) in one or more of the directions, i.e., backspin, draw, and fade. For example, a driver-type club head swung at a speed of 100 miles per hour (MPH) and striking the golf ball (not shown) at the geometric center (GC) of the face may impart a backspin of about 2,700 RPM to the golf ball. By adjusting the CG location of the driver-type club head 1.25 mm toward the sole, e.g., downward, the backspin imparted may be reduced by, e.g., 100 RPM, when struck by the driver-type club head at the geometric center (GC), which can result in greater shot distance. The weighting system described herein are configured to provide even greater selections for adjusting the CG location of the club head by locating the weight component forwardly in the front region and adjacent the rear surface of the face, as well as providing a wide array of positions spanning over, e.g., 90% of a vertical distance and/or 90% of a horizontal distance of the face.

Each of the panels 1572, 1872, 2072, 2172, 2272, 2372, 2472, 2572 described herein may be formed as a lightweight panel having a mass within a range of about 3 g to about 30 g, or about 4 g to about 25 g, or about, 5 g to about 20 g. Relatedly, each of the panels 1572, 1872, 2072, 2172, 2272, 2372, 2472, 2572 described herein defines a panel CG location (PCG) that is configured to be disposed adjacent to the face. In some embodiments, the PCG is located between about 0.1 mm and about 30 mm from the rear surface 936 of the face 38. In some embodiments, the PCG is located between about 0.2 mm and about 25 mm from the rear surface 936 of the face 38. Further, each of the movable weight components 62, 884, 888, 1008, 1016, 1272, 1400, 1684, 2616, including the weight assemblies 860, 1004, defines a weight CG location (WCG) that is configured to be disposed adjacent to the face 38. In some embodiments, the WCG is located between about 2 mm and about 30 mm from rear surface 936 of the face 38. Relatedly, the weight components 62, 884, 888, 1008, 1016, 1272, 1400, 1684, 2616, including the weight assemblies 860, 1004, described herein are configured to locate the WCG within a range of about 1 mm to about 55 mm from the inner surface 1308 of the sole 28, or about 2 mm to about 50 mm from the inner surface 1308 of the sole 28, or about 3 mm to about 45 mm from the inner surface 1308 of the sole 28. In some embodiments, the at least two positions afford the WCG to be located less than 5 mm from the inner surface 1308 of the sole 28. In some embodiments, the WCG is located between about 3 mm and about 28 mm from the rear surface 936 of the face 38. In some embodiments, the WCG is located between about 4 mm and about 25 mm from the rear surface 936 of the face 38. The movable weight components 62, 884, 888, 1008, 1016, 1272, 1400, 1684, 2616, including the weight assemblies 860, 1004, may have a mass in a range of about 5 g to about 50 g, or about 7 g to about 45 g, or about 8 g to about 40 g, or about 9 g to about 35 g, or about 10 g to about 30 g.

It is contemplated that any of the golf club heads described herein may be provided with a filler material (not shown) disposed in the interior volume of the hollow club body. The filler material may be any resilient and durable material, such as, e.g., a polymer, a thermoplastic, a natural material, or any other suitable material. In some embodiments, the filler material is injected into and partially fills the interior volume of the club head. In some embodiments, the filler material is injected into and entirely fills the interior volume of the club head. In some embodiments, the filler material is a porous substrate, such as, e.g., a foam. In some embodiments, the filler material is injected into the golf club head and cured by the application of heat, the duration of time, or some combination thereof. The filler material may be provided in the golf club head to surround any of the weighting systems described herein. The filler material may be provided within a compartment or regions of the club head that are distinct and separated from the weighting system. Accordingly, the filler material may be provided to attenuate vibration and/or sound, to plug openings or gaps or recesses, to reinforce components within or on the club head, or to selectively increase a weight of the club head.

Any of the embodiments described herein may be modified to include any of the structures or methodologies disclosed in connection with different embodiments. Further, the present disclosure is not limited to golf clubs of the type specifically shown. Still further, aspects of the club heads and weighting systems of any of the embodiments disclosed herein may be modified to work with any type of golf club.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the same. The exclusive rights to all modifications which come within the scope of the appended claims are reserved.

We claim:

1. A golf club for varying a position of a center of gravity of a club head, the golf club comprising:

a hollow club head including a face, a crown, and a sole; and a weighting system within an interior cavity formed by the hollow club head, the weighting system comprising:

a cage rigidly coupled to the hollow club head adjacent to an interior surface of the face;

a pivot housing pivotally coupled within an interior of the hollow club head;

a shaft coupled to the pivot housing and extending toward the cage;

a weight coupled to the shaft and configured to engage the cage; and a spring that is disposed around the shaft and is configured to bias the weight toward the cage, wherein the weight is configured to be moved along the cage as the pivot housing is rotated relative to the hollow club head.

2. The golf club of claim 1, wherein the weight defines a mass of at least 10 grams.

3. The golf club of claim 1, wherein the weight is pivotable between a first end position and a second end position, wherein movement of the weight from the first end position to the second end position adjusts the center of gravity of the hollow club head at least 3 mm.

4. The golf club of claim 1, wherein a center of gravity position of the weight is positioned within a distance range of about 4 mm to about 25 mm away from an interior surface of the face of the hollow club head in a face-aft direction.

5. The golf club of claim 1, wherein when the weight is in a lowermost position, a center of gravity position of the weight is less than or equal to about 15 mm away from an interior surface of the sole of the hollow club head in a crown-sole direction.

6. The golf club of claim 1, wherein the cage is integrally formed with the hollow club head.

7. The golf club of claim 1, wherein the cage includes at least one rail extending between a first end and a second end and oriented in a sole-crown direction.

8. The golf club of claim 7, wherein the weight is configured to be secured along the at least one rail in a plurality of distinct positions.

9. The golf club of claim 8, wherein the rotation between a first distinct position and an adjacent second distinct position among the plurality of distinct positions defines at least a 5 degree rotation.

10. The golf club of claim 7, wherein the at least one rail defines an arcuate shape.

11. The golf club of claim 10, wherein the at least one rail defines a radius of curvature of between about 200 mm and about 25 mm.

12. The golf club of claim 7, wherein the at least one rail is coupled to the face adjacent to the first end and coupled to the face adjacent to the second end, wherein the at least one rail is coupled to the face adjacent to the first end and coupled to the sole adjacent to the second end, wherein the at least one rail is coupled to the crown adjacent to the first end and coupled to the face adjacent to the second end, or wherein the at least one rail is coupled to the crown adjacent to the first end and coupled to the sole adjacent to the second end.

13. The golf club of claim 7, wherein the at least one rail includes a first rail and a second rail separated from the first rail in a heel-toe direction.

* * * * *